US006903654B2

(12) United States Patent
Hansen et al.

(10) Patent No.: US 6,903,654 B2
(45) Date of Patent: Jun. 7, 2005

(54) AUTOMATIC DISPENSER APPARATUS

(75) Inventors: Lawrence R. Hansen, Green Bay, WI (US); Thomas Michael Leiterman, Green Bay, WI (US); Larry Allen Schotz, Mequon, WI (US); William G. Haen, Lodi, WI (US); Alan P. Paal, New Franken, WI (US); Abtin Spantman, West Bend, WI (US); Patrick Gerald McCutcheon, Green Bay, WI (US)

(73) Assignee: Alwin Manufacturing Company, Inc., Green Bay, WI (US)

( * ) Notice: Subject to any disclaimer, the term of this patent is extended or adjusted under 35 U.S.C. 154(b) by 0 days.

(21) Appl. No.: 10/699,457

(22) Filed: Oct. 31, 2003

(65) Prior Publication Data

US 2004/0134924 A1 Jul. 15, 2004

Related U.S. Application Data

(63) Continuation-in-part of application No. 10/160,863, filed on Jun. 3, 2002.

(51) Int. Cl.[7] ..... G08B 13/26

(52) U.S. Cl. ..... 340/562; 340/565; 242/563; 242/563.1; 242/564.1; 242/570

(58) Field of Search ..... 340/562, 565, 340/593, 648, 686.1; 242/563, 563.1, 564.1, 570

(56) References Cited

U.S. PATENT DOCUMENTS 3,067,364 A 12/1962 Rosso ..... 222/641
3,317,150 A 5/1967 Summersby ..... 242/564

(Continued)

FOREIGN PATENT DOCUMENTS

CA 2294820 5/1999
CA 2342260 3/2001

(Continued)

OTHER PUBLICATIONS

U.S. Provisional application No. 60/130,137,Omdoll et al., filed Apr. 20, 1999.
U.S. Provisional application No. 60/159,006, Hoyt, filed Oct. 11, 1999.

(Continued)

*Primary Examiner*—Toan Pham
(74) *Attorney, Agent, or Firm*—Jansson, Shupe & Munger, Ltd.

(57) ABSTRACT

The invention is directed to improved automatic dispenser apparatus for dispensing sheet material and the like without contact between a user and the dispenser. Proximity detection apparatus is provided to detect the presence of a user in a detection zone generated outside the dispenser. Control apparatus controls actuation of the dispenser in response to the detected user. Preferred forms of the proximity detector include a sensor and a signal detection circuit operatively connected to the sensor. The sensor includes conductors configured to have a capacitance and positioned such that the capacitance is changed by the presence of a user within the detection zone. The signal detection circuit detects the change in capacitance and is provided with an oscillator having a frequency which is affected by the sensor capacitance and a differential frequency discriminator which detects changes in the oscillator frequency. The control apparatus receives the detected frequency change and generates a signal provided to actuate the dispenser to dispense the material. The dispenser control apparatus controls dispenser operation responsive to decreases in battery voltage which occur during the life cycle of the batteries and controls dispenser operation when the batteries near the end of such life cycle. Such control apparatus may be used with any type of battery powered dispenser, including hands-free dispensers and dispensers actuated by direct physical contact with the user.

37 Claims, 34 Drawing Sheets

U.S. PATENT DOCUMENTS

| | | | | |
|---|---|---|---|---|
| 3,450,363 | A | 6/1969 | Williams | 242/564 |
| 3,505,692 | A | 4/1970 | Forbes | 4/623 |
| 3,669,312 | A | 6/1972 | Kuckens et al. | 222/641 |
| 3,675,051 | A | 7/1972 | Mioduski | 327/205 |
| 3,730,409 | A | 5/1973 | Ratti | 225/14 |
| 3,892,368 | A | 7/1975 | Ricards | 242/564 |
| 3,971,607 | A | 7/1976 | Schnyder | 312/34.12 |
| 4,119,255 | A | 10/1978 | D'Angelo | 226/136 |
| 4,270,818 | A | 6/1981 | McCabe | 312/34.12 |
| 4,398,310 | A | 8/1983 | Lienhard | 4/623 |
| 4,449,122 | A | 5/1984 | Whitmer | 340/562 |
| 4,666,099 | A | 5/1987 | Hoffman et al. | 242/564.1 |
| 4,722,372 | A | 2/1988 | Hoffman et al. | 141/98 |
| 4,738,176 | A | 4/1988 | Cassia | 83/208 |
| 4,765,555 | A | 8/1988 | Gambino | 242/564.4 |
| 4,786,005 | A | 11/1988 | Hoffman et al. | 242/564.1 |
| 4,796,825 | A | 1/1989 | Hawkins | 242/564 |
| 4,826,262 | A | 5/1989 | Hartman et al. | 312/34.12 |
| 4,879,461 | A | 11/1989 | Philipp | 377/237 |
| 4,921,131 | A | 5/1990 | Binderbauer et al. | 222/52 |
| 4,938,384 | A | 7/1990 | Pilolla et al. | 222/52 |
| 4,946,070 | A | 8/1990 | Albert et al. | 222/52 |
| 4,960,248 | A | 10/1990 | Bauer et al. | 242/564.4 |
| 4,967,935 | A | 11/1990 | Celest | 222/52 |
| 5,031,258 | A | 7/1991 | Shaw | 4/623 |
| 5,060,323 | A | 10/1991 | Shaw | 4/623 |
| 5,086,526 | A | 2/1992 | Van Marcke | 4/623 |
| 5,105,992 | A | 4/1992 | Fender et al. | 222/52 |
| 5,199,118 | A | 4/1993 | Cole et al. | 4/619 |
| 5,217,035 | A | 6/1993 | Van Marcke | 137/1 |
| 5,255,822 | A | 10/1993 | Mease et al. | 222/63 |
| 5,291,534 | A | 3/1994 | Sakurai et al. | 377/20 |
| 5,340,045 | A | 8/1994 | Arabian et al. | 242/535.2 |
| 5,452,832 | A | 9/1995 | Niada | 225/11 |
| 5,490,722 | A | 2/1996 | Sonnett et al. | 312/237 |
| 5,492,247 | A | 2/1996 | Shu et al. | 222/63 |
| 5,573,318 | A | 11/1996 | Arabian et al. | 312/34.11 |
| 5,625,908 | A | 5/1997 | Shaw | 4/623 |
| 5,632,414 | A | 5/1997 | Merriweather, Jr. | 222/52 |
| 5,651,044 | A | 7/1997 | Klotz, Jr. et al. | 378/117 |
| 5,665,961 | A | 9/1997 | Matzka | 290/221 |
| 5,694,653 | A | 12/1997 | Harald | 4/623 |
| 5,695,091 | A | 12/1997 | Winings et al. | 222/1 |
| 5,730,165 | A | 3/1998 | Philipp | 137/1 |
| 5,772,291 | A | 6/1998 | Byrd et al. | 312/34.22 |
| 5,781,942 | A | 7/1998 | Allen et al. | 4/623 |
| 5,806,203 | A | 9/1998 | Robinsin | 34/90 |
| 5,810,201 | A | 9/1998 | Besse et al. | 222/39 |
| 5,862,844 | A | 1/1999 | Perrin | 141/351 |
| 5,933,288 | A | 8/1999 | Plesko | 359/896 |
| 5,943,712 | A | 8/1999 | Van Marcke | 4/623 |
| 5,952,835 | A | 9/1999 | Coveley | 324/671 |
| 5,960,991 | A | 10/1999 | Ophardt | 222/1 |
| 5,961,066 | A | 10/1999 | Hambleton | 242/588.1 |
| 5,992,430 | A | 11/1999 | Chardack et al. | 134/115 G |
| 6,000,429 | A | 12/1999 | Van Marcke | 137/624.11 |
| 6,025,782 | A | 2/2000 | Newham | 340/573.1 |
| 6,069,354 | A * | 5/2000 | Alfano et al. | 250/221 |
| 6,082,419 | A | 7/2000 | Skell et al. | 141/198 |
| 6,098,917 | A | 8/2000 | Cruz | 242/564.1 |
| 6,105,898 | A | 8/2000 | Byrd et al. | 242/564.1 |
| 6,119,285 | A | 9/2000 | Kim | 4/665 |
| 6,125,482 | A | 10/2000 | Foster | 4/662 |
| 6,128,826 | A | 10/2000 | Robinson | 34/90 |
| 6,131,587 | A | 10/2000 | Chardack et al. | 134/95.2 |
| 6,178,572 | B1 | 1/2001 | Van Marcke | 4/623 |
| 6,189,163 | B1 | 2/2001 | Van Marcke | 4/623 |
| 6,195,588 | B1 | 2/2001 | Gauthier et al. | 700/11 |
| 6,206,340 | B1 | 3/2001 | Paese et al. | 251/129.04 |
| 6,209,751 | B1 | 4/2001 | Goodin et al. | 222/52 |
| 6,209,752 | B1 | 4/2001 | Mitchell et al. | 222/63 |
| 6,250,530 | B1 | 6/2001 | LaCount et al. | 225/10 |
| 6,283,504 | B1 | 9/2001 | Stanley et al. | 280/735 |
| 6,288,707 | B1 | 9/2001 | Philipp | 280/735 |
| 6,293,486 | B1 | 9/2001 | Byrd et al. | 242/564.1 |
| 6,297,738 | B1 | 10/2001 | Newham | 340/573.1 |
| 6,412,655 | B1 | 7/2002 | Stuetzel et al. | 221/13 |
| 6,412,679 | B2 | 7/2002 | Formon et al. | 225/14 |
| 6,419,136 | B2 | 7/2002 | Formon et al. | 225/14 |
| 6,446,901 | B1 | 9/2002 | Haen et al. | 242/564.1 |
| 6,460,798 | B1 | 10/2002 | Haen et al. | 242/560 |
| 6,695,246 | B1 * | 2/2004 | Elliott et al. | 242/564.1 |
| 2001/0001475 | A1 | 5/2001 | Formon et al. | |
| 2001/0017309 | A1 | 8/2001 | Formon et al. | |
| 2002/0088837 | A1 | 7/2002 | Formon et al. | |
| 2002/0109034 | A1 | 8/2002 | Moody et al. | |
| 2002/0109035 | A1 | 8/2002 | Denen et al. | |
| 2002/0109036 | A1 | 8/2002 | Denen et al. | |
| 2002/0117578 | A1 | 8/2002 | Denen et al. | |

FOREIGN PATENT DOCUMENTS

| | | |
|---|---|---|
| DE | 19820978 A1 | 11/1999 |
| EP | 1231823 | 6/2002 |
| EP | 1230886 | 8/2002 |
| EP | 1232715 | 8/2002 |
| GB | 2299306 | 9/1990 |
| WO | WO 99/58040 | 11/1999 |
| WO | WO 99/59457 | 11/1999 |
| WO | WO 00/63100 | 10/2000 |

OTHER PUBLICATIONS

Bay West Paper Corporation Web site excerpt (www.bay-westpaper.com) and photograph of Bay West Wave 'n Dry dispenser. (2 total pages) Date: 1997.

Ille Papier–Service GmbH product literature and excerpts from Ille web site (www.ille:de). Undated. (7 pages).

* cited by examiner 10
21
35
25
31
19
23
131
125
133
33
135
109
101
137
51
15
77
13
55
19
103
53
259
256
59
247
261
171
43
91
243
63
141
45
193
213
173
29
215
188
191
179
207
183
187
65

10
25
19
41
125
109
133
137
117
75
113
256
227
251
250
249
17
241
253
141
289
111
155
245
107
283
139
287
39
279
263
157
257
115
276
123
275
71
281
183
69
119
47
331
333
311
111
271
187
67
337
49
309
65
273
309
312
335

AUTOMATIC DISPENSER APPARATUS

RELATED APPLICATIONS

This application is a continuation-in-part of co-pending U.S. patent application Ser. No. 10/160,863 filed Jun. 3, 2002, said application being pending at issuance of this patent, the entire content of which is incorporate herein by reference.

FIELD OF THE INVENTION

This invention is related generally to dispenser apparatus and, more particularly, to apparatus for dispensing of sheet material.

BACKGROUND OF THE INVENTION

Apparatus for use in dispensing paper towel, personal care products and the like are often provided in public restrooms, commercial food preparation areas and similar settings in order to assist patrons and employees in maintaining personal hygiene. These dispensers are typically provided to supply the user with a product such as a sheet of paper towel. A lever, push bar or other device is commonly provided to actuate the dispenser. Product is dispensed when the user grasps and pulls the lever or presses her hand against the push bar or other actuator. These dispensers have proven to be reliable and cost effective and are completely satisfactory for their intended purpose.

In certain applications there has been a recent trend toward the use of automatic dispenser apparatus in place of, or in addition to, manually-operated dispensers. In theory, automatic dispensers operate by dispensing the towel in response to the proximity of the user and without contact between the user and the dispenser device. The dispenser detects the presence of the user (typically the user's hand) adjacent the dispenser housing and automatically discharges the towel in response to a signal generated by detection of the user.

It can be appreciated that there are benefits potentially associated with automatic dispenser apparatus. For example, automatic dispensers may limit the transfer of germs or other agents to the user's hand because the user is, in theory, not required to physically contact the dispenser device. The appearance and cleanliness of the dispenser may be enhanced through reduced physical contact between the dispenser and the user. This not only improves the appearance of the dispenser but has related benefits in terms of reducing the effort required to maintain the dispenser. Yet another potential benefit is that the dispenser may be more effective in controlling or limiting the amount of product dispensed from the device thereby providing uniform amounts of dispensed product and reducing waste.

Efforts have been made to develop automatic dispenser apparatus which utilize proximity sensors of various types to detect the presence of the user and to dispense in response to the presence of the user. One approach has been to utilize photoelectric dispensers of various types. Examples include U.S. Pat. No. 6,069,354 (Alfano et al.) and U.S. Pat. No. 4,786,005 (Hoffman et al.). For example, the dispenser apparatus of Alfano and Hoffman utilize reflectance-type infrared detection systems to actuate the dispenser. The user places his hand adjacent a localized infrared light generator and changes in light reflectance are detected by a photo transistor to generate a signal actuating the dispenser. Hoffman includes a further photo transistor detector provided to detect changes in ambient light resulting from the presence of the user's hand.

The generator and detector of Alfano are localized at a specific position on the front side of the dispenser while in the Hoffman dispenser these elements are located in a cavity formed in the dispenser housing where ambient light conditions can be controlled. None of these detection components are positioned at the location where the towel is dispensed, i.e., the position where the user's hand would naturally be expected to extend. As a result, these dispensers may not be ergonomic for all users. Further, such photoelectric-based systems may not operate properly in conditions of potentially variable ambient light, such as in a public restroom. Other examples of automatic dispensers utilizing photoelectric sensor devices include U.S. Pat. No. 6,293,486 (Byrd et al.), U.S. Pat. No. 6,105,898 (Byrd et al.) and U.S. Pat. No. 5,772,291 (Byrd et al.), U.S. Pat. No. 5,452,832 (Niada) U.S. Pat. No. 4,796,825 (Hawkins), U.S. Pat. No. 4,722,372 (Hoffman et al.) and U.S. Pat. No. 4,666,099 (Hoffman et al.).

Another approach has been to utilize detected changes in an electrical field as a means to actuate the dispenser. Examples include U.S. Pat. No. 6,279,777 (Goodin et al.), U.S. Pat. No. 5,694,653 (Harald), U.S. Pat. No. 4,921,131 (Binderbauer), U.S. Pat. No. 4,826,262 (Hartman et al.), U.S. Pat. No. 6,412,655 (Stützel et al.) and Canadian Patent Application Serial No. 2,294,820 (Stützel et al.).

For example, Hartman discloses an automatic cloth towel dispenser which dispenses clean cloth towel and takes up the soiled towel following use. Hartman utilizes a detection device which consists of a bulky, elongated coil which oscillates to generate a radio frequency field below the dispenser cabinet. The oscillator circuit is said to detect small changes in the RF field. Hartman requires unduly large components and may be prone to detection of false signals. Furthermore, such a system would likely be adversely affected by conditions of high humidity which are commonly encountered in environments where the dispenser might be expected to be located.

By way of further example, the dispenser apparatus of the Stützel patent describes what is called a capacitive sensor which includes a flat, two-dimensional pair of electrodes with very specific electrode surface area ratios and placement requirements. The electrodes are said to generate a rectified field. The patent asserts that placement of an object within 1.18" of the dispenser will produce changes in capacitance which, when detected, are used to actuate the dispenser. Such a system is disadvantageous at least because the range of detection is limited and the location of the field is not ergonomic. The user is required to be extremely close to the dispenser, potentially resulting in unwanted contact between the user and the dispenser apparatus.

The dispenser of the Goodin patent requires a "theremin" antenna which is said to detect changes in capacitance as the user's hand approaches the dispenser. In response, a solenoid is actuated to dispense liquid soap. To eliminate the risk of false detection, a second sensor may be provided to independently detect the presence of the user's hand. The need for primary and secondary sensors suggests that the system is not entirely reliable.

There is also a need to provide improved control over dispenser operation which compensates for changes in battery voltage which occur over the life cycle of the batteries used to power the dispenser. Improved control is useful to ensure that the length of sheet material dispensed is consistent in each dispense cycle even as battery voltage decreases as the batteries become discharged. This need for improved dispenser control exists for all types of battery powered dispensers including for hands-free dispensers with a proximity detector input device and for dispensers which utilize an input device such as a contact switch to initiate a dispense cycle.

It would be a significant improvement in the art to provide automatic dispenser apparatus with an improved proximity sensor wherein the proximity sensor would positively detect the presence of a user without physical contact by the user and dispense in response to the detection, which would operate in an ergonomic manner by detecting the user at a range and position from the dispenser along which the user would be expected to place his or her hand or other body part, which would discriminate between signals unrelated to the presence of the user, which would be compact permitting use in small dispenser apparatus and avoiding interference with the operation of other dispenser components, which would operate reliably under a wide range of ambient light, humidity and temperature conditions which could include certain other optional features provided to enhance the operation of the dispenser and which would include an improved control apparatus.

OBJECTS OF THE INVENTION

It is an object of the invention to provide improved automatic dispenser apparatus overcoming some of the problems and shortcomings of the prior art.

One of the other objects of the invention is to provide improved automatic dispenser apparatus which dispenses without contact between the user and the dispenser.

Another object of the invention is to provide improved automatic dispenser apparatus which positively detects the presence of a user in proximity to the dispenser.

Yet another object of the invention is to provide improved automatic dispenser apparatus which discriminates between the proximity of the user and other objects.

Still another object of the invention is to provide improved automatic dispenser apparatus which has an improved design versus prior art dispensers.

Yet another object of the invention is to provide improved automatic dispenser apparatus which includes a proximity sensor which generates an ergonomically-positioned detection zone.

It is also an object of the invention to provide improved automatic dispenser apparatus which includes a compact proximity sensor.

An additional object of the invention is to provide improved automatic dispenser apparatus which would reliably operate across a range of ambient light, humidity and temperature conditions.

A further object of the invention is to provide improved automatic dispenser apparatus which dispenses uniformly over the operational life of the dispenser power source.

Another object of the invention is to provide an automatic dispenser apparatus and method which provides improved control over the length of sheet material dispensed.

These and other objects of the invention will be apparent from the following descriptions and from the drawings.

SUMMARY OF THE INVENTION

In general, the invention comprises automatic dispenser apparatus for dispensing sheet material and the like. An improved proximity detector is provided for detecting the presence of a user and, ultimately, for actuating the dispenser without contact between the user and the dispenser. The sensitivity of the proximity detector causes the dispenser to dispense in a reliable manner. Moreover, the dispenser is actuated in an ergonomic manner because the dispenser is actuated in response to placement of the user's hand at positions adjacent the dispenser where the user's hand might naturally be expected to placed to receive the dispensed product.

The dispenser apparatus and dispensing methods described herein provide instructions for improved dispenser operation and improved control over the sheet material dispensed throughout the life cycle of the dispenser power source. Such improved instructions are useful for controlling operation of battery powered dispensers generally, including hands-free dispensers which utilize a proximity detector to input a user dispense request and dispensers requiring human contact actuation, for example by manually pushing a contact switch form of input device.

Preferred forms of sheet material dispensers for use in practicing the invention may include mechanical components known in the art for use in dispensing sheet materials. Such sheet materials include, for example, paper towel, wipers, tissue, etc. Typical mechanical components may include drive and tension rollers which are rotatably mounted in the dispenser. The drive and tension rollers form a nip. The tension roller holds the sheet material against the drive roller and rotation of the drive roller draws sheet material through the nip and, ultimately, the sheet material is fed out of the dispenser.

The drive roller is rotated by motor drive apparatus in power transmission relationship with the drive roller. Power supply apparatus, also referred to herein as a power source, is provided to supply electrical power to the motor drive. The preferred power supply apparatus also supplies electrical power to the electrical components of the proximity detector and control apparatus of the inventive dispenser.

The preferred proximity detector provided to actuate the dispenser comprises a sensor and a signal detection circuit. The sensor has a capacitance which is changed by the presence of a user within a "detection zone" projecting outwardly from the dispenser. The signal detection circuit is operatively connected to the sensor and detects the capacitance change.

A control apparatus receives the detected frequency change and generates a signal used to actuate the motor drive apparatus to dispense the sheet material. The control apparatus may include additional features to enhance operation of the dispenser.

In a preferred embodiment, the sensor is mounted within the dispenser housing and is provided with first and second conductors. The conductors are configured and arranged to have a capacitance. Most preferably, the sensor has a three-dimensional geometry and the sensor three-dimensional geometry generates a generally arcuate detection zone. The term detection zone refers to a region about the sensor into which the user places his or her hand or other body part to bring about a detectable change in capacitance. The detection zone most preferably projects outwardly from the dispenser at positions where the user's hand would naturally be placed to receive a segment of dispensed sheet material from the dispenser. In this most preferred embodiment, the three dimensional sensor geometry is achieved by depositing the first and second electrodes on a substrate with a three-dimensional geometry so that the electrodes take on the shape of the substrate.

In preferred forms of the invention, the sensor first and second conductors each include a plurality of parallel conductor elements deposited on the substrate. Each plural element of the first conductor is conductively connected to each other element of the first conductor. And, each plural element of the second conductor is conductively connected to each other element of the second conductor.

The plural parallel conductor elements are most preferably arranged in an "interdigital" array in which the elements are in an alternating arrangement. More specifically, the plural parallel elements of the first conductor and the plural parallel elements of the second conductor are substantially parallel to each other. The elements are arranged so that the nearest element to each element in the first conductor plurality is an element of the second conductor plurality and the nearest element to each element in the second conductor plurality is an element of the first conductor plurality.

Referring next to the preferred signal detection circuit embodiment, such circuit is powered by the power supply apparatus and includes an oscillator and a differential frequency discriminator. The oscillator has a frequency which is affected by the sensor capacitance when a user's hand is in the detection zone. The differential frequency discriminator detects changes in the oscillator frequency so that the detected change can be acted upon by the control apparatus. The signal detection circuit is sufficiently sensitive to permit detection of the presence of a user within the detection zone at distances spaced meaningfully from the dispenser yet is also sufficiently insensitive to avoid false positive signals caused by the mere presence of a person or other object in the vicinity of the dispenser.

A preferred form of differential frequency discriminator used in the signal detection circuit includes a signal conditioning circuit, first and second averaging circuits and a comparator. A set point circuit may also be provided. Most preferably, the signal conditioning circuit is generated by a monostable multivibrator. The multivibrator is configured to produce two outputs. The first output is a first series of pulses. Each pulse is of a fixed duration, and the series of pulses has a frequency corresponding to the oscillator frequency. The second output is a second series of pulses which is the complement of the first series of pulses.

The preferred first averaging circuit averages the first series of pulses and generates an output which is referred to herein as a first average. The second averaging circuit averages the second series of pulses and generates an output which is referred to herein as a second average.

The preferred comparator is a first comparator which receives the first and second averages generated by the averaging circuits. The comparator compares the first average and the second average and produces an output which is referred to herein as a discriminator difference. The discriminator difference represents the difference between the second average and the first average and the discriminator difference output corresponds to the presence of the user within the detection zone. If the selection of parameters are not such that the averages are equal when a user is not present then a set point circuit is further provided which sets the discriminator difference substantially to zero when the user is not present in the detection zone. The discriminator difference is subsequently multiplied by a gain factor of the first comparator to produce an output.

A further advantage of the invention is that the signal detection circuit may include circuitry for setting a detection zone volume thereby permitting the detection zone to be expanded or contracted as appropriate. The terms tuned and detuned are also used herein to describe, respectively, the expanded and contracted detection zones. In such embodiments, the signal detection circuit is configured to generate a predetermined threshold reference signal provided to set the detection zone volume. A second comparator is provided to compare the output of the first comparator with the threshold reference signal. The second comparator then provides an output which is the difference between the threshold reference signal and the output from the first comparator. The difference is then multiplied by a gain factor of the second comparator. The detection zone volume may be expanded and contracted simply by changing the threshold reference signal thereby adjusting the magnitude of the frequency changes at which the logical output of the second comparator switches.

As will be explained, the proximity detector of the invention is unaffected by conditions of temperature and humidity typical of those encountered at locations where the invention is intended to be used, i.e., in public restrooms, commercial food preparation areas and similar settings. The proximity detector is unaffected by lighting conditions because it does not require an optical detection system.

Preferred embodiments of the control apparatus are powered by the power supply apparatus and are included to control actuation of the motor drive. The output of the second comparator is received by the control apparatus and, in response, the control apparatus actuates the motor for a predetermined time. It is most preferred, but not required, that the control apparatus is in the form of a programmable controller including preprogrammed instructions.

The control apparatus may also include additional features provided to enhance operation of the apparatus. For example, the control apparatus may include a timer controller which sets a minimum time duration of a capacitance change required to actuate the dispenser. A preferred time interval is 30 ms. The control apparatus may further include a blocking controller which limits dispenser actuation to a single cycle for each detected capacitance change.

The control apparatus may further include a power supply voltage compensation circuit provided to ensure consistent dispensing irrespective of any voltage drop in the batteries or other power source. The preferred compensation circuit provides a reference voltage proportional to a power supply voltage and controls the duration of motor drive actuation such that the dispensing of sheet material is substantially independent of changes in the power supply voltage.

A further preferred embodiment controls dispenser operation based on the power source output, preferably represented by the battery voltage under load. The dispenser control apparatus adjusts the timed duration of subsequent dispense cycles to provide consistent lengths of sheet material discharged from the dispenser. Such embodiment is useful to control the operation of any battery powered dispenser device.

The control apparatus may further include a sheet material length selector. Such a length selector may comprise a control for selecting one of several sheet material lengths to be dispensed, a length signal corresponding to the selected control setting, two or more preset length reference signals corresponding to preselected lengths of sheet material to be dispensed and a sheet length comparator which compares the length signal with the preset length reference signals to determine which sheet material length has been selected. It is most preferred that the preset length reference signals and the sheet length comparator are in the form of a programmable controller including preprogrammed instructions.

Preferred embodiments of the control apparatus may also include a low-power-supply alarm. Preferably, this component element of the control apparatus also comprises a programmable controller including preprogrammed instructions and the low-power-supply alarm is included in the programmable controller. The control apparatus preferably includes a first preset voltage level, a second preset voltage level, a power-warning comparator which compares the power supply voltage to the first and second preset voltage levels, an indicator which provides a warning signal when the power supply voltage is below the first preset voltage level and a lockout circuit which blocks the dispensing of sheet material when the power supply voltage is below the second preset voltage level. The low battery alarm may include an audible sound generator.

Further preferred embodiments include a counter which increments and decrements counts when the open circuit and/or loaded battery voltages are determined to be either above or below one or more thresholds. The counts are used to ensure that any low battery alarm is responsive to decreases in the battery voltage which occur near the end of the battery life cycle.

The invention is not limited to sheet material dispensers and may include other types of automatic dispenser apparatus which are to be actuated without contact by the user. For example, the invention may be used with automatic liquid material dispenser apparatus for use in dispensing liquid products such as soaps, shaving creams, fragrances and the like.

BRIEF DESCRIPTION OF THE DRAWINGS

The drawings illustrate preferred embodiments which include the above-noted characteristics and features of the invention. The invention will be readily understood from the descriptions and drawings. In the drawings.

DETAILED DESCRIPTION OF PREFERRED EMBODIMENTS

The mechanical components comprising preferred embodiments of an exemplary automatic dispenser in the form of a sheet material dispenser 10 will be described with particular reference to FIGS. 1–14. Dispenser 10 is of a type useful in dispensing paper towel. The invention may be practiced with other types of dispensers. Certain of the mechanical components of the exemplary dispenser 10 are also described in U.S. Pat. No. 6,250,530 (La Count et al.) which is assigned to the assignee of the present application. The disclosure of the La Count patent is incorporated herein by reference.

Figure 1:
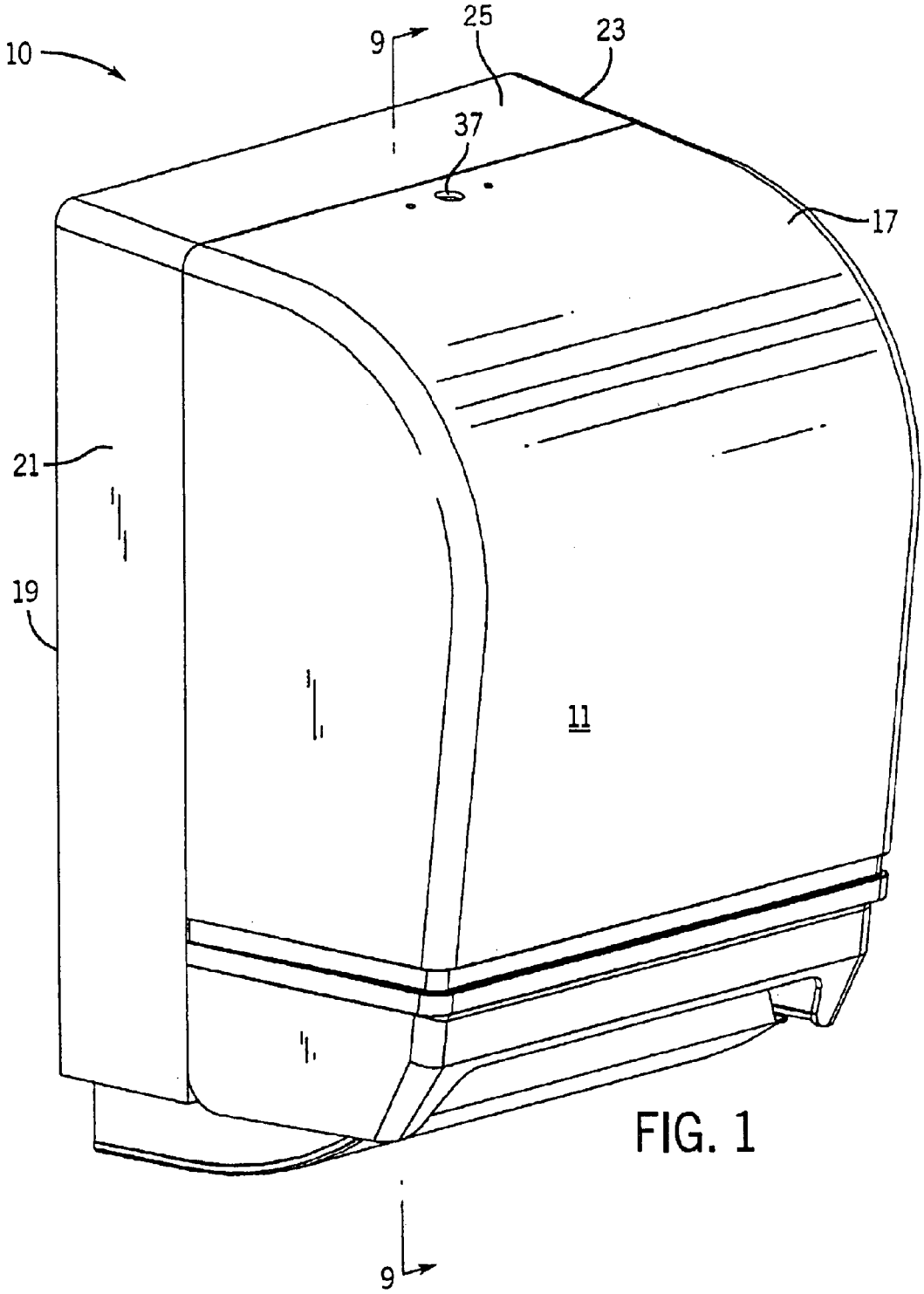
FIG. 1 is a perspective view of a preferred automatic dispenser apparatus according to the invention, such dispenser apparatus provided for dispensing sheet material.
Figure 2:
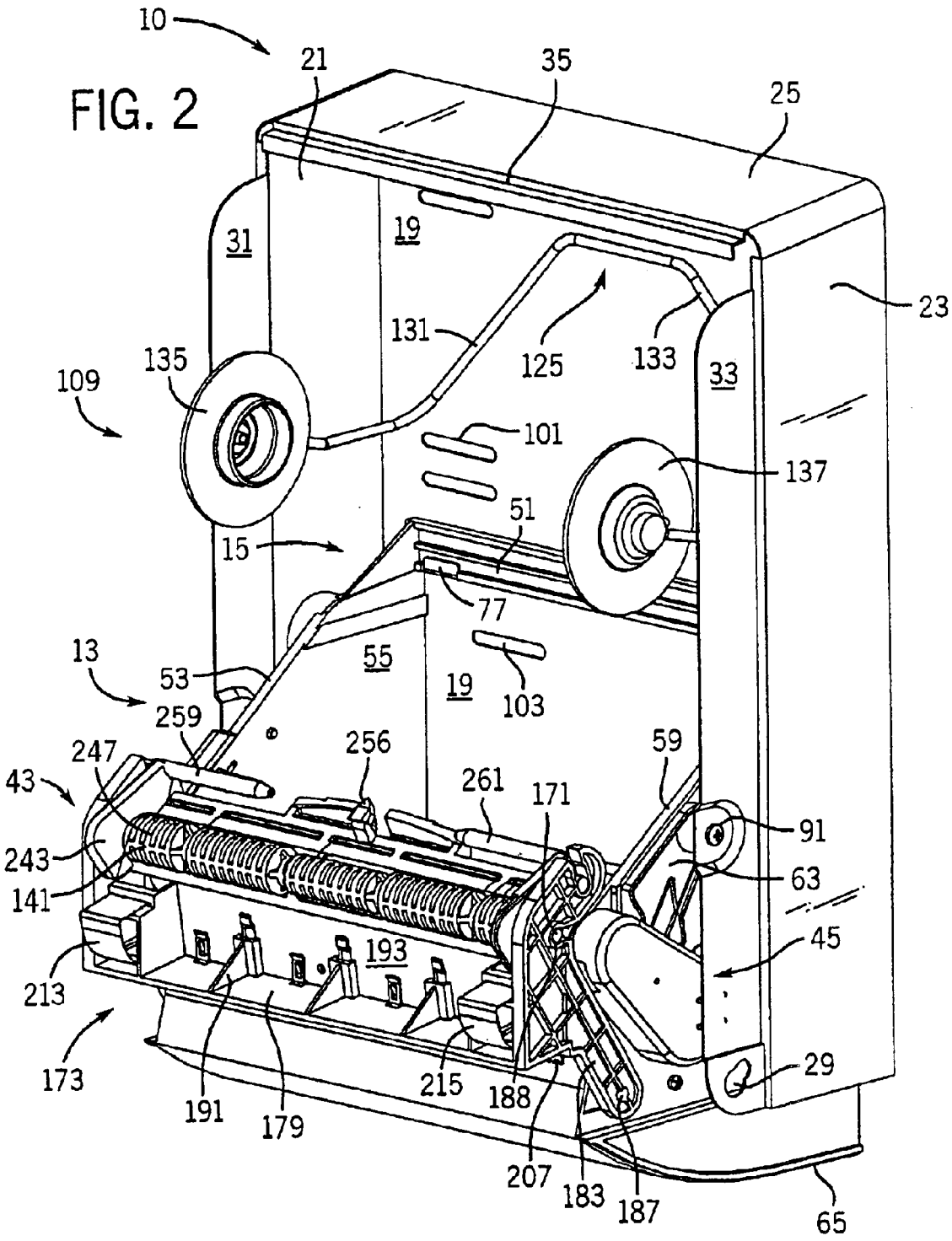
FIG. 2 is a perspective view of the dispenser of FIG. 1 with the housing cover removed.
Figure 3:
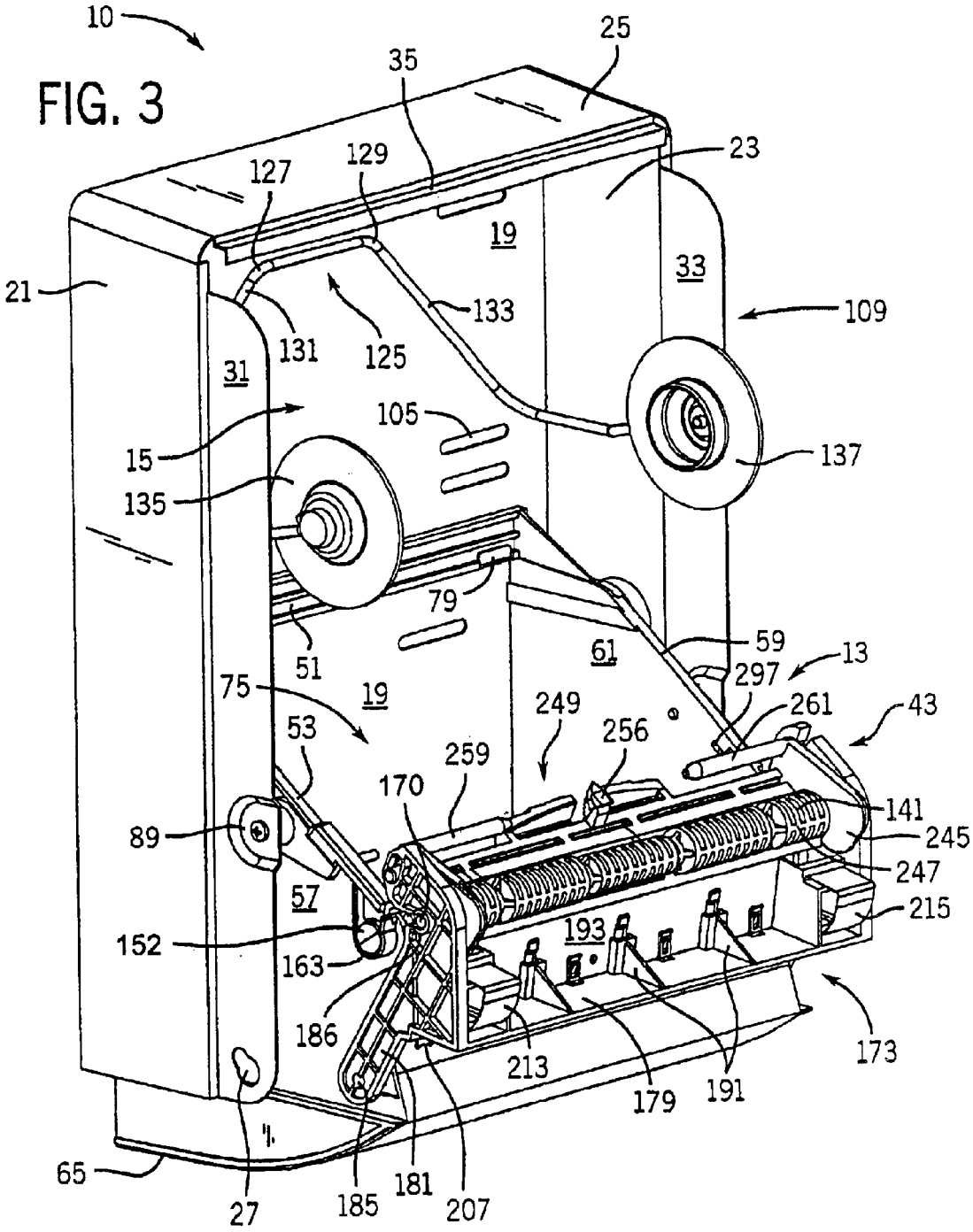
FIG. 3 is another perspective view of the dispenser of FIG. 1 also with the housing cover removed.
Figure 4:
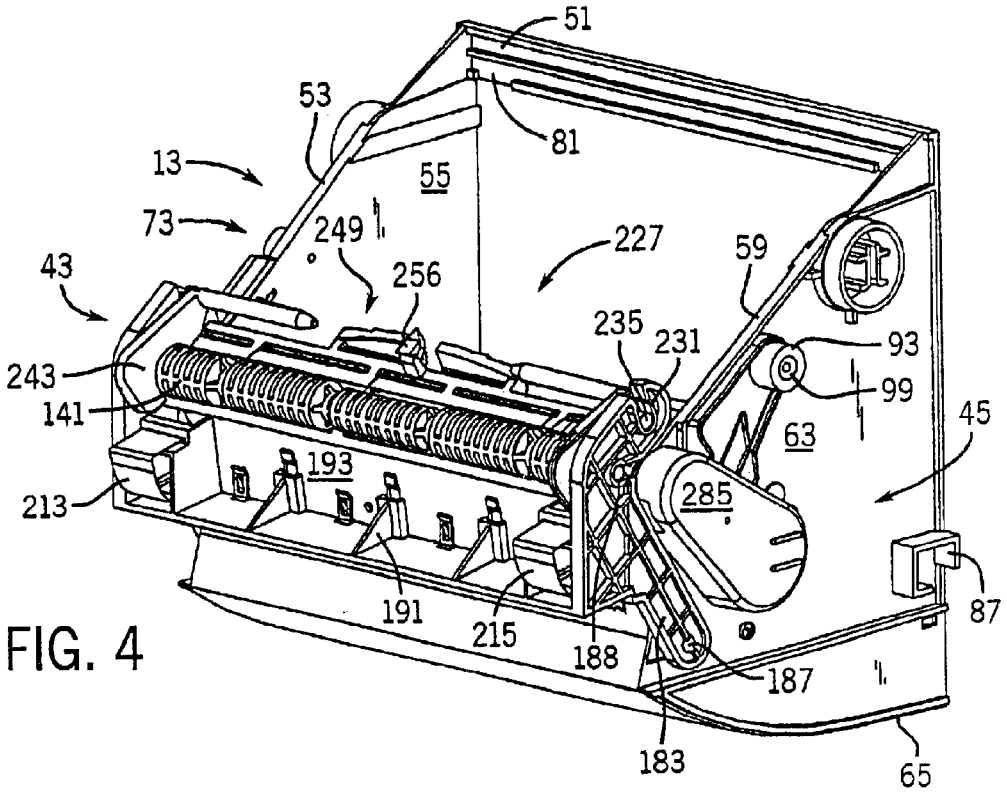
FIG. 4 is a perspective view of the front side of the dispenser frame.
Figure 5:
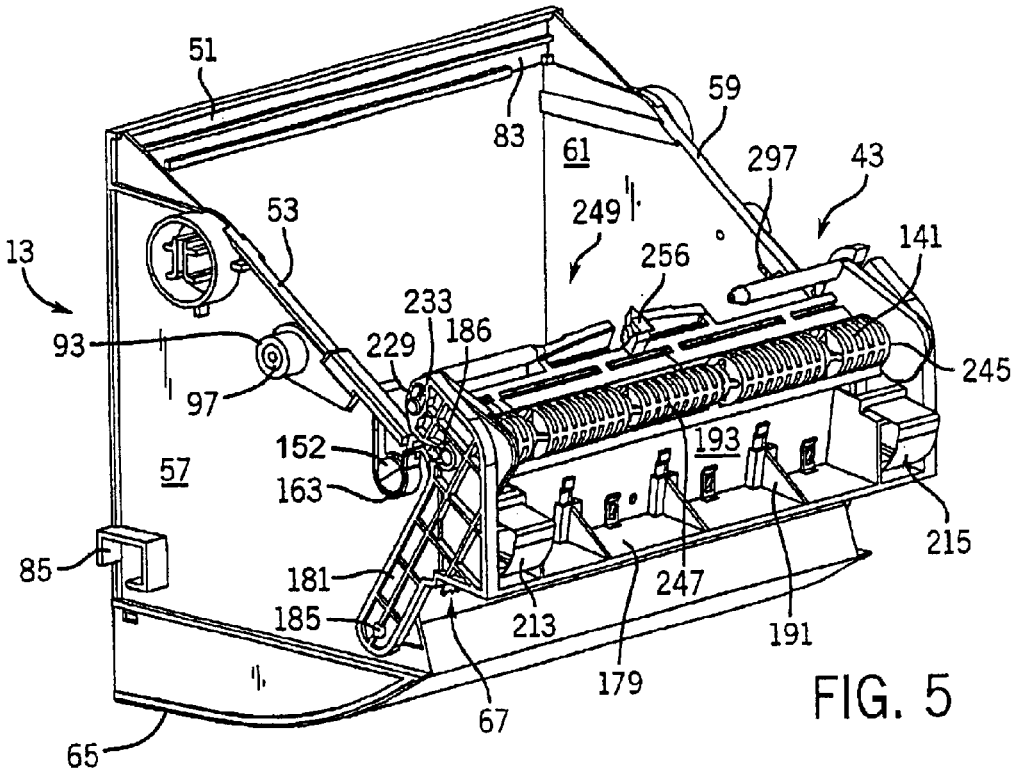
FIG. 5 is another perspective view of the front side of the dispenser frame.
Figure 6:
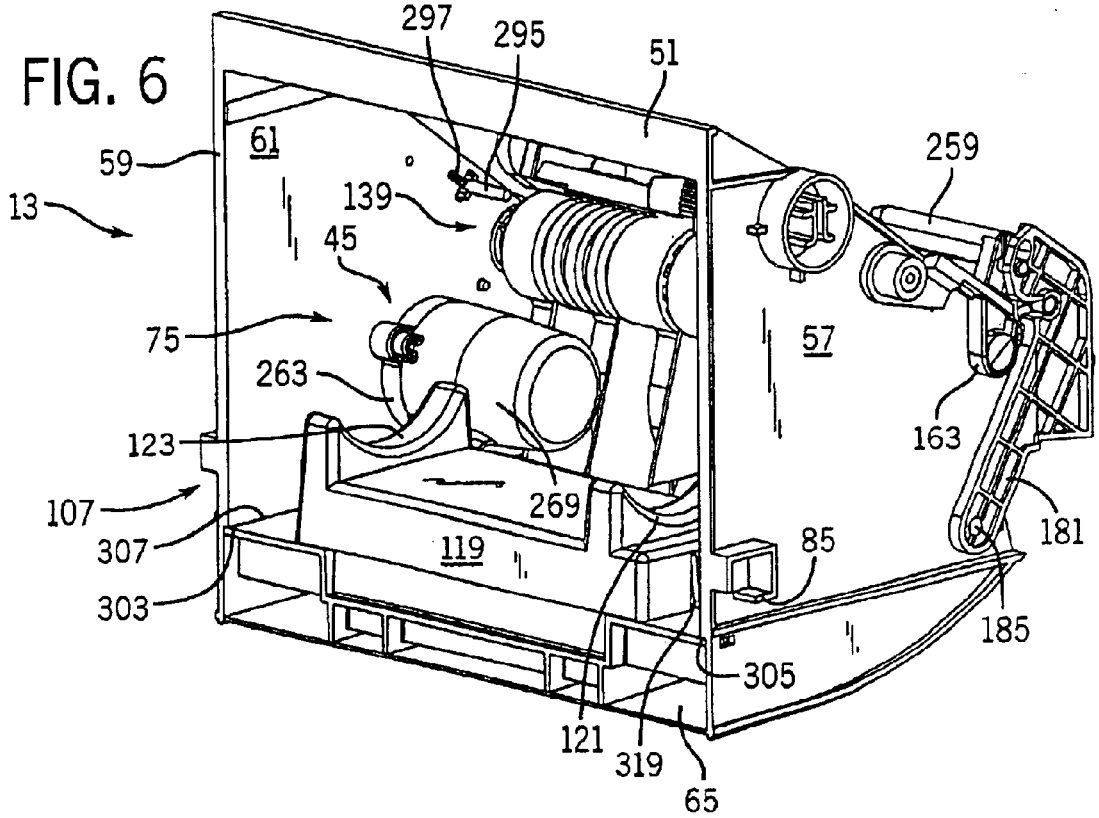
FIG. 6 is a perspective view of the rear side of the dispenser frame.
Figure 7:
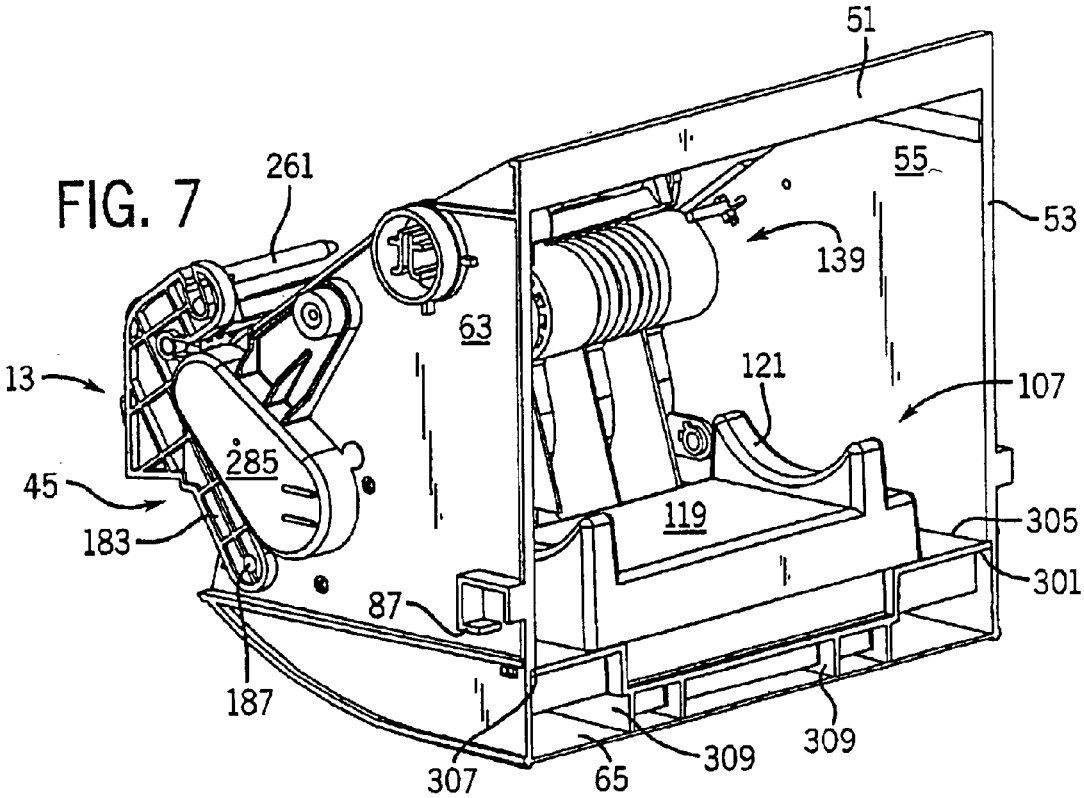
FIG. 7 is another perspective view of the rear side of the dispenser frame.

Dispenser 10 preferably includes housing 11 and frame 13 mounted within an interior portion 15 of housing 11. Housing 11 includes a front cover 17, rear wall 19, side walls 21, 23 and top wall 25. Cover 17 may be connected to housing 11 in any suitable manner. As shown in FIGS. 1–3, cover 17 is attached for pivotal movement to housing 11 by means of axially aligned pins (not shown) in cover 17 configured and arranged to mate with a respective axially aligned opening 27, 29 provided in housing side walls 21 and 23. Flanged wall surfaces 31–35 extend into cover 17 when the cover 17 is in the closed position shown in FIG. 1 to ensure complete closure of the dispenser 10. A lock mechanism 37 may be provided in cover 17 to prevent unauthorized removal of cover 17. Cover 17 is opened, for example, to load rolls 39, 41 (FIGS. 9–10) of sheet material in the form of a web into dispenser 10 or to service dispenser 10. Housing 11 and cover 17 may be made of any suitable material. Formed sheet metal and molded plastic are particularly suitable materials for use in manufacturing housing 11 and cover 17 because of their durability and ease of manufacture.

Frame 13 and the principal mechanical components of exemplary dispenser 10 are shown in FIGS. 2 and 3 in which cover 17 is removed from dispenser 10 and in FIGS. 4–8 and 11 in which frame 13 is apart from housing 11. Frame 13 is preferably positioned within a portion of housing interior 15 as shown in FIGS. 2 and 3. Frame 13 is provided to support the major mechanical and electrical components of dispenser 10 including the dispensable product discharge apparatus 43, drive apparatus 45, power supply apparatus 47, proximity detector apparatus 49 and control apparatus 50. Frame 13 is made of a material sufficiently sturdy to resist the forces applied by the moving parts mounted thereon. Molded plastic is a highly preferred material for use in manufacture of frame 13.

Frame 13 includes a rear support member 51 (preferred frame 13 does not include a full rear wall), a first sidewall 53 having sidewall inner 55 and outer 57 surfaces, a second sidewall 59 having sidewall inner 61 and outer 63 surfaces and bottom wall 65. Web discharge opening 67 is provided between web-guide surface 69 and tear bar 71. Side walls 53 and 59 define frame front opening 73. Housing rear wall 19 and frame walls 53, 59, 65 and 69 define a space 75 in which primary roll 39 can be positioned for dispensing or storage.

Frame 13 is preferably secured along housing rear wall 19 in any suitable manner such as with brackets 77, 79 provided in housing rear wall 19. Brackets 77, 79 mate with corresponding slots 81 and 83 provided in frame rear support member 51. Frame 13 may also be secured in housing 11 by mounting brackets 85, 87 provided along frame sidewall outer surfaces 57, 63 for mating with corresponding brackets (not shown) provided in housing 11. Frame 13 may further be secured to housing 11 by means of fasteners 89, 91 positioned through housing sidewalls 21, 23, bushings 93, 95 and posts 97, 99. Frame 13 need not be a separate component and could, for example, be provided as an integral part of housing 11.

The exemplary dispenser 10 may be mounted on a vertical wall surface (not shown) where dispenser 10 can be easily accessed by a user. As shown particularly in FIGS. 2 and 3, dispenser 10 could be secured to such vertical wall surface by suitable fasteners (not shown) inserted through slotted openings in rear wall 19 of which slots 101–105 are representative. Of course, dispenser 10 could be configured in other manners depending on the intended use of dispenser 10.

Figure 9:
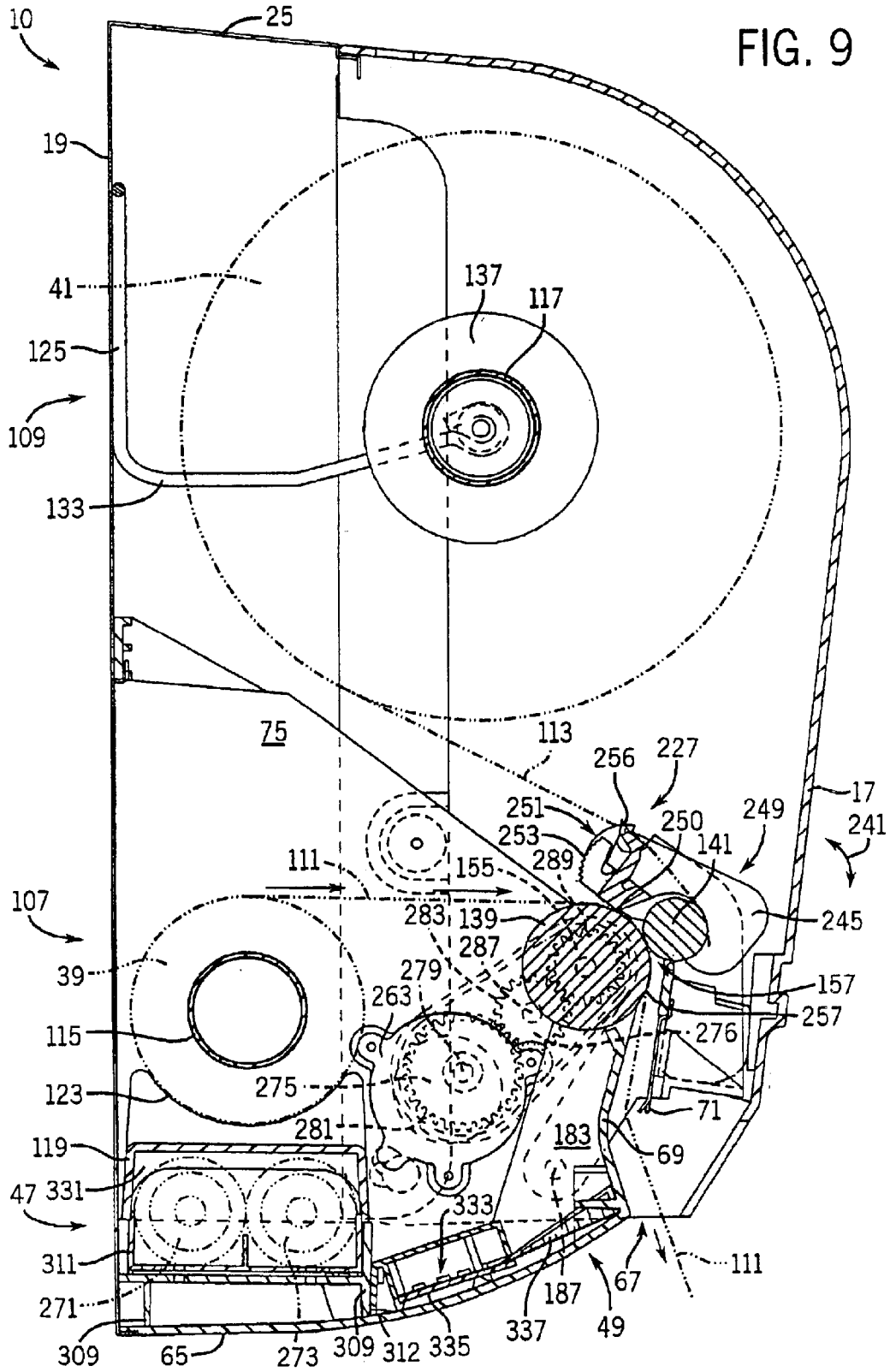
FIG. 9 is a sectional view of the exemplary dispenser taken along section 9—9 of FIG. 1. Sheet material is being dispensed from the primary roll. Certain hidden parts are shown in dashed lines.
Figure 10:
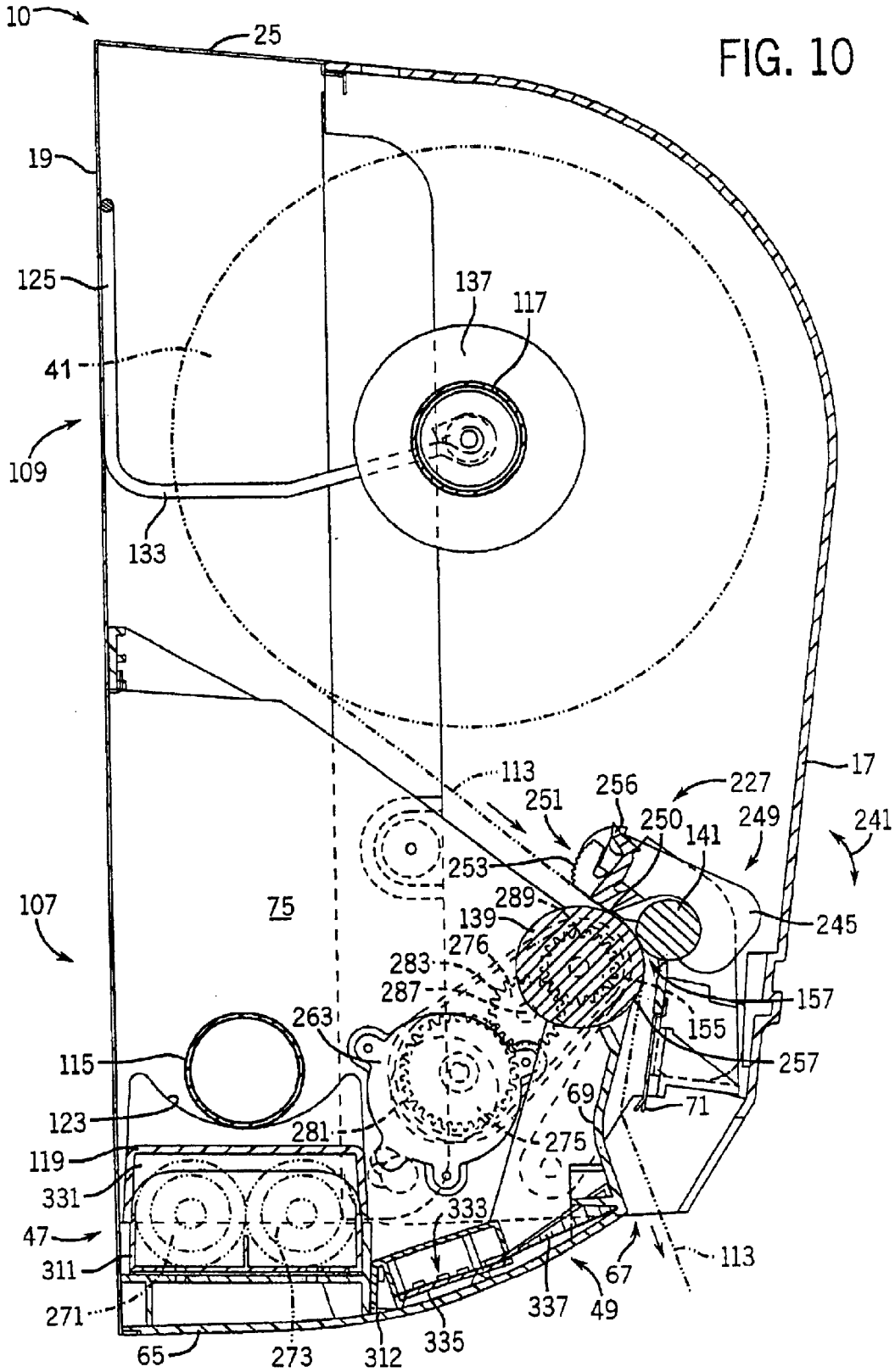
FIG. 10 is a sectional view of the exemplary dispenser taken along section 9—9 of FIG. 1. Primary roll sheet material is depleted and sheet material is being dispensed from the secondary roll following operation of the transfer mechanism. Certain hidden parts are shown in dashed lines.

The exemplary dispenser apparatus 10 includes apparatus for storing primary and secondary sources of sheet material 107, 109. The sheet material in this example is in the form of primary and secondary rolls 39, 41 consisting of primary and secondary sheet material 111, 113 rolled onto a cylindrically-shaped hollow core 115, 117 having an axial length and opposed ends (not shown). Such cores 115, 117 are typically made of a cardboard-like material. As shown in FIG. 9, primary roll 39 sheet material 111 is being dispensed while secondary roll sheet material 113 is in a "ready" position prior to dispensing from that roll 41. FIG. 10 illustrates the dispenser 10 following a transfer event in which sheet material 113 from roll 41 is transferred to the nip 157 for dispensing from the dispenser 10 following depletion of primary roll 39 sheet material 111.

It is very highly preferred that the rolls 39, 41 are stored in and dispensed from housing interior 15. However, there is no absolute requirement that such rolls be contained within housing interior 15 or space 75.

Turning now to the preferred apparatus 107 for storing primary web roll 39, such storing apparatus 107 includes cradle 119 with arcuate support surfaces 121, 123 against which the primary roll 39 rests. Surfaces 121, 123 are preferably made of a low-friction material permitting primary roll 61 to freely rotate as sheet material 111 is withdrawn from roll 39.

Referring further to FIGS. 2–3 and 9, there is shown a preferred apparatus 109 for storing secondary web roll 41. Storing apparatus 109 includes yoke 125 attached in a suitable manner to housing rear wall 19, such as by brackets 127, 129 formed around yoke 125. Yoke 125 comprises arms 131, 133 and web roll holders 135, 137 mounted on respective arms 131, 133. Arms 131 and 133 are preferably made of a resilient material so that they may be spread apart to receive respective ends of hollow core roll on which the secondary sheet material web is wound.

Persons of skill in the art will appreciate that support structure, other than cradle 119 and yoke 125 could be used to support primary and secondary web rolls 39, 41. By way of example only, a single removable rod (not shown) spanning between walls 53, 59 or 21, 23 could be used to support rolls 39, 41. As a further example, primary web roll 39 could simply rest on frame bottom wall 65 without support at ends of the core 115.

A preferred discharge apparatus 43 for feeding sheet material 111, 113 from respective rolls 39, 41 and out of dispenser 10 will next be described. Such discharge apparatus 43 comprises drive roller 139, tension roller 141 and the related components as hereinafter described and as shown particularly in FIGS. 2–10.

Drive roller 139 is rotatably mounted on frame 13 and includes a plurality of longitudinally spaced apart drive roller segments 143, 145, 147 on a shaft 149. Drive roller 139 includes ends 151, 153 and drive gear 155 rigidly connected to end 153. Drive gear 155 is part of the drive apparatus 45 which rotates drive roller 139 as described in more detail below. Segments 143–147 rotate with shaft 149 and are preferably made of a tacky material such as rubber or other frictional materials such as sand paper or the like provided for the purpose of engaging and feeding sheet material 111, 113 through a nip 157 between drive and tension rollers 139, 141 and out of the dispenser 10 through discharge opening 67.

Shaft end 153 is inserted in bearing (for example, a nylon bearing) 159 which is seated in opening 161 in frame side wall 59. Stub shaft 152 at shaft end 151 is rotatably seated on bearing surface 163 in frame first side wall 53 and is held in place by arm 167 mounted on post 97.

A plurality of teeth 169 extend from guide surface 69 into corresponding annular grooves 172 around the circumference of drive roller outer surface 257. The action of teeth 169 in grooves 172 serves to separate any adhered sheet material 111, 113 from the drive roller 139 and to direct that material through the discharge opening 67.

Figure 8:
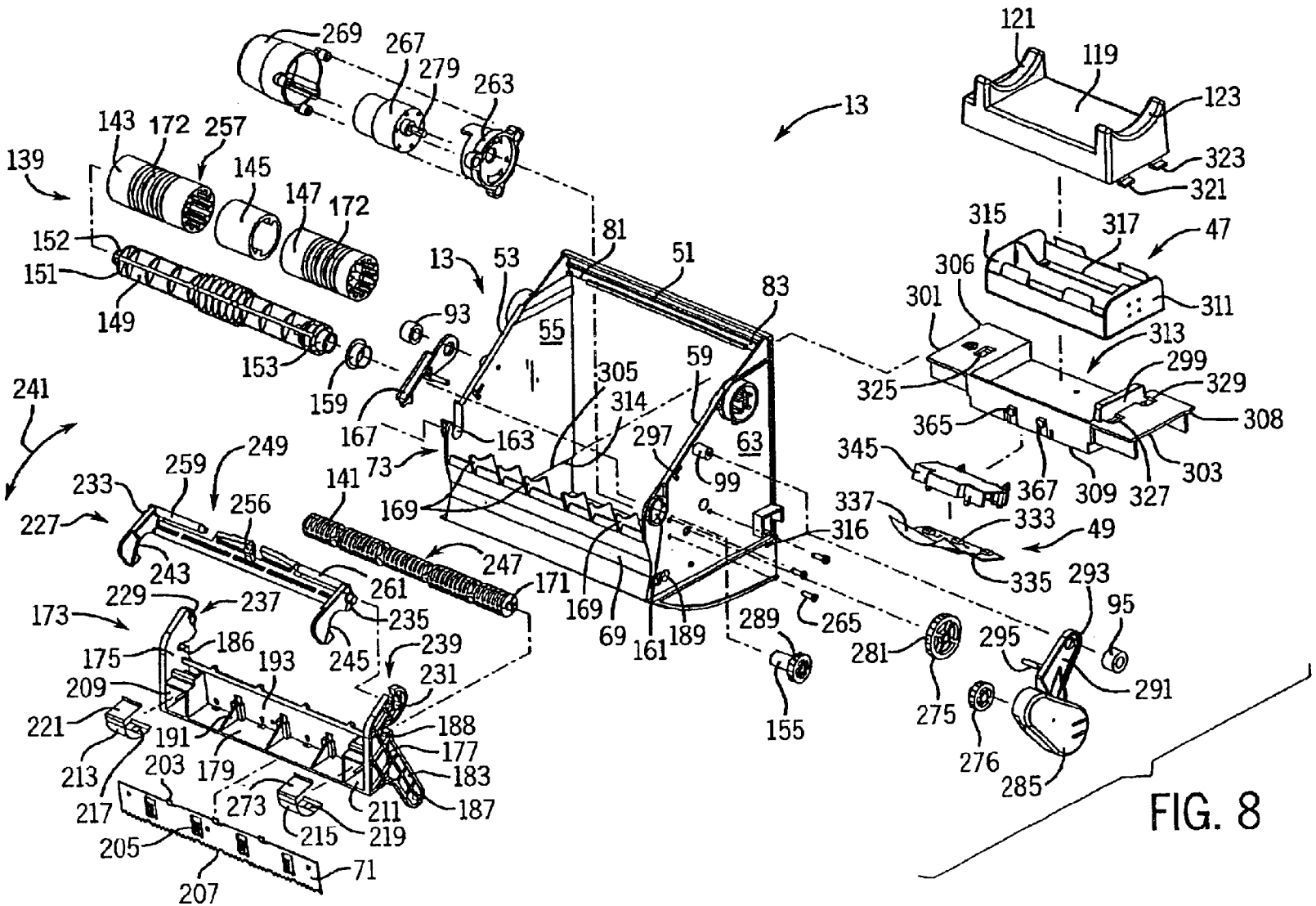
FIG. 8 is an exploded perspective view of the frame and certain preferred mechanical components mounted with respect to the frame.

The tension roller 141 is mounted for free rotation on a roller frame assembly 173. Roller frame assembly 173 includes spaced apart side wall members 175, 177 interconnected by a bottom plate 179. Roller frame assembly 173 is provided with arm extensions 181, 183 having axially-oriented inwardly facing posts 185, 187 which extend through coaxial pivot mounting apertures in frame sidewalls 53, 59 one of which 189 is shown in FIG. 8 (the other identical aperture is hidden behind guide surface 69) pivotally mounting roller frame assembly 173 to frame 13. Reinforcement members, such as member 191, extend from the bottom plate 179 to an upstanding wall 193. Bearing surfaces 186, 188 are located at the top of the side walls 175, 177 to receive respective stub shafts 170, 171 of tension roller 141 as described in detail below.

Tear bar 71 is either mounted to, or is integral with, the bottom of the roller frame assembly 173. The tear bar 71 may be provided with tabs 203 and clips 205 for attachment to the bottom of the roller frame assembly 173 if the tear bar 71 is not molded as part of the roller frame assembly 173. A serrated edge 207 is at the bottom of tear bar 71 for cutting and separating the sheet material 111, 113 into discrete sheets.

Roller frame assembly 173 further includes spring mounts 209, 211 at both sides of roller frame assembly 173. Leaf springs 213, 215 are secured on mounts 209, 211 facing forward with bottom spring leg 217, 219 mounted in a fixed-position relationship with mounts 209, 211 and upper spring leg 221, 223 being mounted for forward and rearward movement. Cover 17, when in the closed position of FIG. 1, urges springs 213, 215 and roller assembly 173 rearwardly thereby urging tension roller 141 firmly against drive roller 139.

An optional transfer assembly 227 is mounted interior of tension roller 141 on bearing surfaces 229, 231 of the roller frame assembly 173. Transfer assembly 227 is provided to automatically feed the secondary sheet material 113 into the nip 157 upon exhaustion of the primary sheet material 111 thereby permitting the sheet material 113 from roll 41 to be dispensed. The transfer assembly 227 is provided with a stub shaft 233 at one end in bearing surface 229 and a stub shaft 235 at the other end in bearing surface 231. Each bearing surface 229, 231 is located at the base of a vertically-extending elongate slotted opening 237, 239. Each stub shaft 233, 235 is loosely supported in slots 237, 239. This arrangement permits transfer assembly 227 to move in a forward and rearward pivoting manner in the direction of dual arrows 241 and to translate up and down along slots 237, 239, both types of movement being provided to facilitate transfer of sheet material 113 from secondary roll 41 into nip 157 after depletion of sheet material 111 from roll 39 as described below.

The transfer assembly 227 is mounted for forward and rearward pivoting movement in the directions of dual arrows 241. Pivoting movement in a direction away from drive roller is limited by hooks 243, 245 at opposite ends of transfer assembly 227. Hooks 243, 245 are shaped to fit around tension roller 141 and to correspond to the arcuate surface 247 of tension roller 141.

A transfer mechanism 249 is positioned generally centrally of the assembly 227. Transfer mechanism 249 includes a drive roller contact surface 250, an arcuate portion 251 with outwardly extending teeth 253 which are moved against drive roller arcuate surface 257 during a transfer event as described below. A catch 256 is provided to pierce and hold the secondary sheet material 113 prior to transfer of the sheet material to the nip 157. Opposed, inwardly facing coaxial pins 259, 261 are mounted on respective ends of transfer assembly 227 also to hold the secondary sheet material 113 prior to transfer to the nip 157. Operation of transfer assembly 227 will be described in more detail below.

The drive and tension rollers 139, 141, roller frame assembly 173, transfer assembly 227 and related components may be made of any suitable material. Molded plastic is a particularly useful material because of its durability and ease of manufacture.

Referring now to FIGS. 3–4, 6–9 and 11, there are shown components of a preferred drive apparatus 45 for powering drive roller 139. A motor mount 263 is mounted to inside surface 61 of frame side wall 59 by fasteners of which screw 265 is exemplary. A direct current geared motor 267 is attached to mount 263. A suitable DC geared motor is the model 25150-14 50 motor available from Komocon Co. Ltd. of Seoul, Korea. Motor 267 is enclosed by motor housing 269 mounted over motor 267 to mount 263. Motor 267 is preferably powered by four series-connected 1.5 volt D-cell batteries, two of which 271, 273 are shown in FIGS. 9 and 10. Optionally, motor 267 may be powered by direct current from a low-voltage transformer (not shown).

Motor 267 drives a power transmission assembly consisting of input gear 275 intermediate gear 276, and drive gear 155. Input gear 275 is mounted on motor shaft 279. Input gear teeth 281 mesh with teeth 283 of intermediate gear 276 which is rotatably secured to housing 285 by a shaft 287 extending from housing 285. Teeth 283 in turn mesh with drive gear teeth 289 to rotate drive gear 155 and drive roller 139.

Housing 285 covers gears 155, 275 and 276 and is mounted against side wall outer surface 63 by armature 291 having an opening 293 fitted over post 99. Bushing 95 secured between walls 23 and 59 by fastener 91 urges armature 291 against side wall outer surface 63 holding housing 285 in place. Further support for housing 285 is provided by pin 295 inserted through mating opening 297 in side wall 59.

FIGS. 6–10 show a preferred power supply apparatus 47 for supplying electrical power to motor 267. Power supply apparatus 47 has a power source output which may be the voltage or current produced by the power supply apparatus 47. While the preferred power supply apparatus 47 is described in connection with dry cell batteries, such as batteries 271, 273, it is to be understood that other types of power sources may be used in conjunction with the invention. Such power sources could include low voltage AC from a transformer or power from photovoltaic cells or other means.

Base 299 is mounted in frame 13 by mechanical engagement of base end edge surfaces 301, 303 with corresponding flanges 305, 307 provided along inner surfaces 55, 61 of respective walls 53, 59 and by engagement of tabs 306, 308 with slots 314, 316 also provided in walls 53, 59. Tabs 310, 312 protruding from frame bottom wall 65 aid in locating base 299 by engagement with base bottom edge 309. Base 299 and frame 13 components are sized to permit base 299 to be secured without fasteners.

Battery box 311 is received in corresponding opening 313 of base 311 and may be held in place therein by any suitable means such as adhesive (not shown) or by fasteners (not shown). Battery box 311 is divided into two adjacent compartments 315, 317 each for receiving two batteries, such as batteries 271, 273, end to end in series connection for a total of four batteries. Positive and negative terminals and conductors (not shown) conduct current from the batteries to the drive, sensor and control apparatus 45, 49 and 50.

Cradle 119 is removably attached to base 299 by means of tangs 319, 321, 323 inserted through corresponding openings 325, 327, 329 in base 299. Cradle 119 includes a hollow interior portion 331 corresponding to the profile of battery box 311. Cradle 119 receives battery box 311 therein when cradle 119 is attached to base 299. Tangs 319–323 are made of a resilient material permitting them to be urged out of contact with base 299 so that cradle 119 may be removed to access battery box 311, for example to place fresh batteries (i.e., 271, 273) into battery box 311.

The mechanical structure of a proximity detector apparatus 49 according to the invention will be now be described particularly with respect to FIGS. 8–13. Proximity detector 49 comprises circuit components 333 mounted on printed circuit board 335 ("PC board") and a sensor 337 comprising first and second conductors 339, 341 deposited on substrate 343. The circuit components 333 shown in the drawings are provided for illustrative purposes only and do not represent the actual components utilized in the invention. A detailed description of the actual circuit components and circuit operation will be provided below with respect to FIGS. 16–19.

Figure 11:
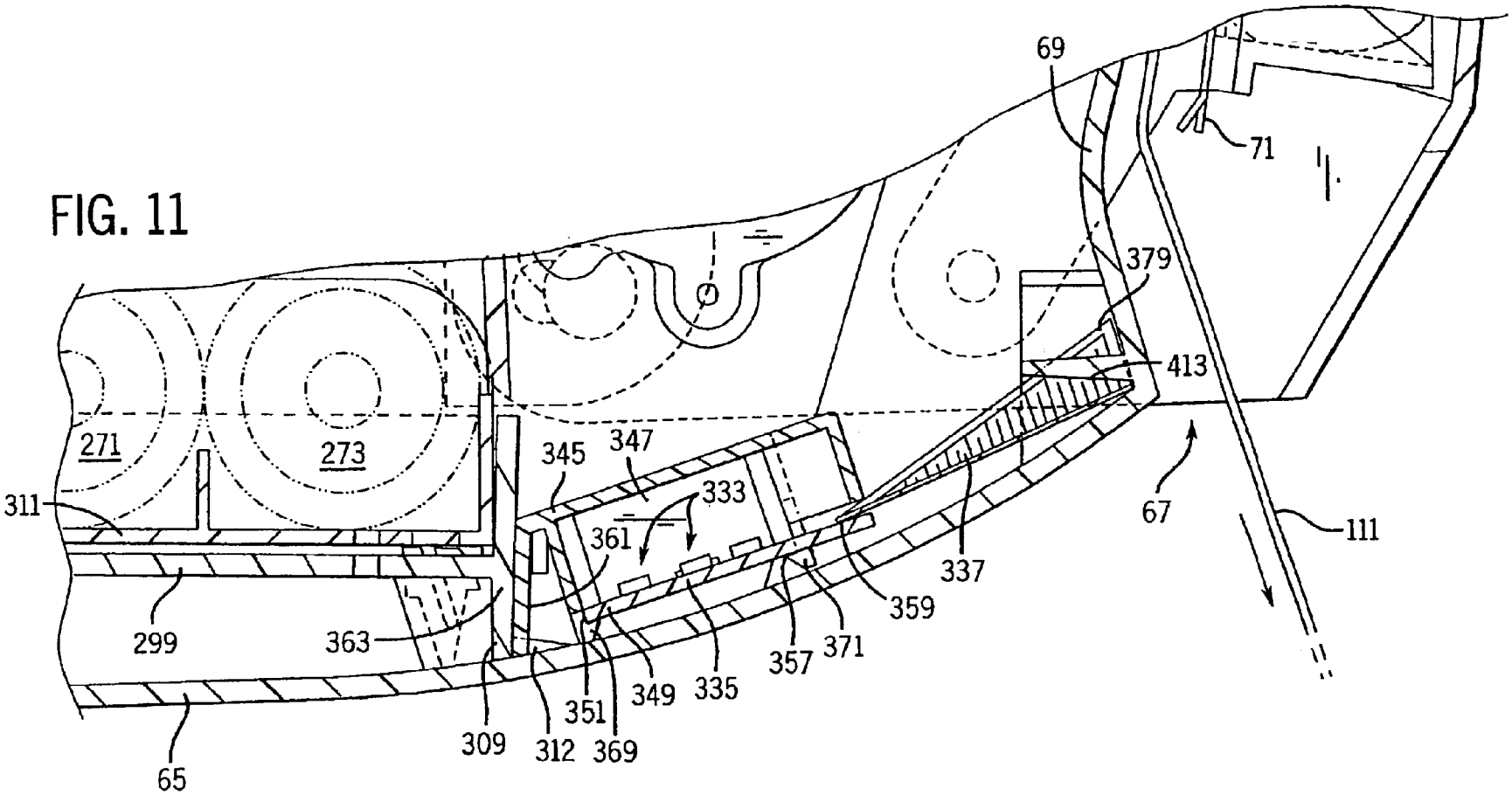
FIG. 11 is an enlarged partial sectional view of the exemplary dispenser of FIGS. 9 and 10. Certain hidden parts are shown in dashed lines.

PC board 335 on which components 333 are mounted is a rigid resin-based board with electrical conductors (not shown) deposited thereon between the appropriate components 333 as is typical of those used in the electronics industry. PC board 335 is mounted in frame 13 by attachment to housing 345. Housing 345 has a hollow interior space 347 in which components 333 are received. PC board rear edge 349 is inserted in slot 351 and front edges of PC board 353, 355 are inserted in co-planar housing slots, one of which 357, is shown in FIG. 11 and the other of which is a mirror image of slot 357. Housing 345 includes a front opening 359 through which substrate 343 extends out of housing 345 toward the front of the dispenser 10. As best shown in FIGS. 8–11, housing 345 is held in place along frame bottom wall 65 with housing rear wall 361 abutting base front wall 363 with tangs 365, 367 engaged with corresponding openings (not shown) in housing rear wall 361. Housing front and rear legs 369, 371 rest on frame bottom wall 65.

Substrate 343, is preferably made of a thin flexible material, such as MYLAR®, polyamide, paper or the like for a purpose described in detail below. By way of example only, a preferred substrate thickness may be approximately 0.008" thereby permitting the substrate to be shaped. Substrate 343 is initially die-cut, preferably in a trapezoidal configuration best shown in FIGS. 12–14. Substrate 343 is provided with a front edge 373, a center 375 front corners 377, 379 side edges, 381, 383, rear edge 385 and top 387 and bottom 389 surfaces. Substrate 343 is mechanically fastened along rear edge 385 to PC board 335 by solder joints at terminals 403, 405. An adhesive or mechanical fasteners could additionally be provided to further join substrate 343 to PC board 335.

Figure 12:
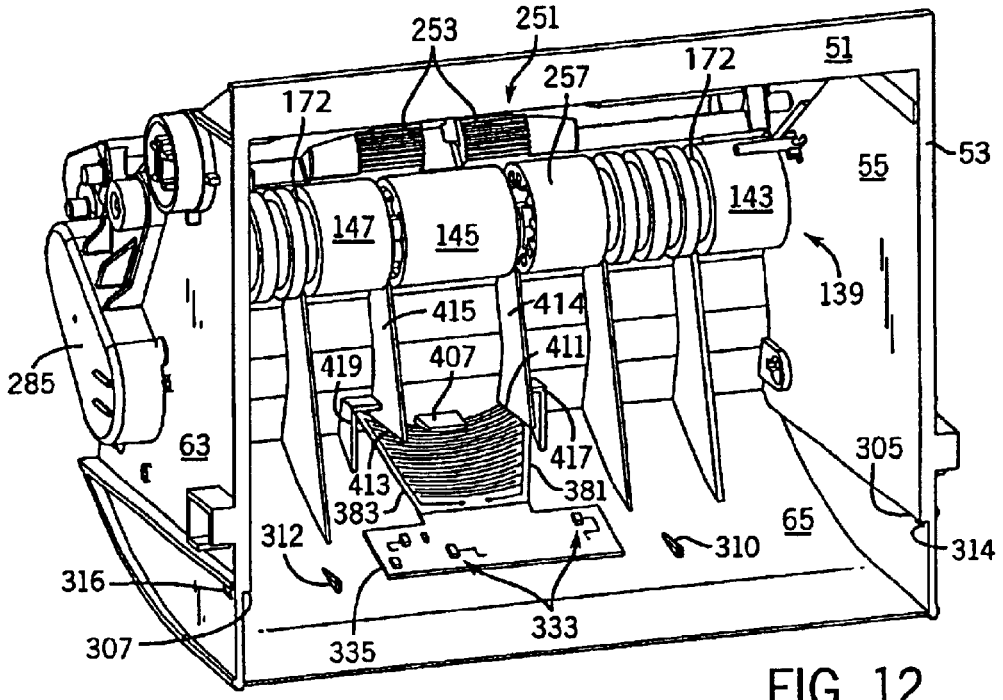
FIG. 12 is a rear perspective view of the rear side of the dispenser frame showing an exemplary three-dimensional sensor and the location at which the sensor is positioned within the dispenser. Certain parts are removed from the dispenser. The electrical components shown are illustrative only and are not intended to represent the actual components.
Figure 13:
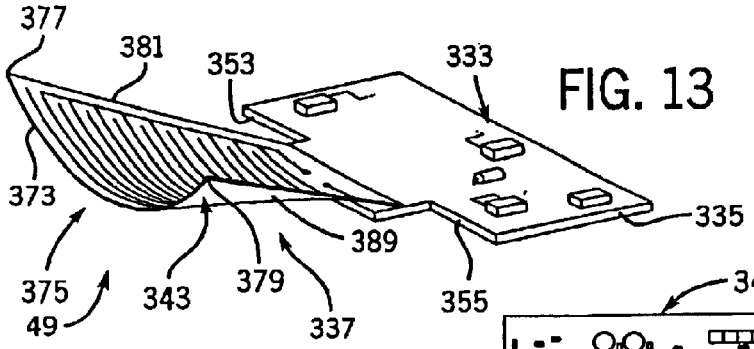
FIG. 13 is a perspective view the exemplary three-dimensional sensor of FIG. 12. The electrical components shown are illustrative only and are not intended to represent the actual components.
Figure 14:
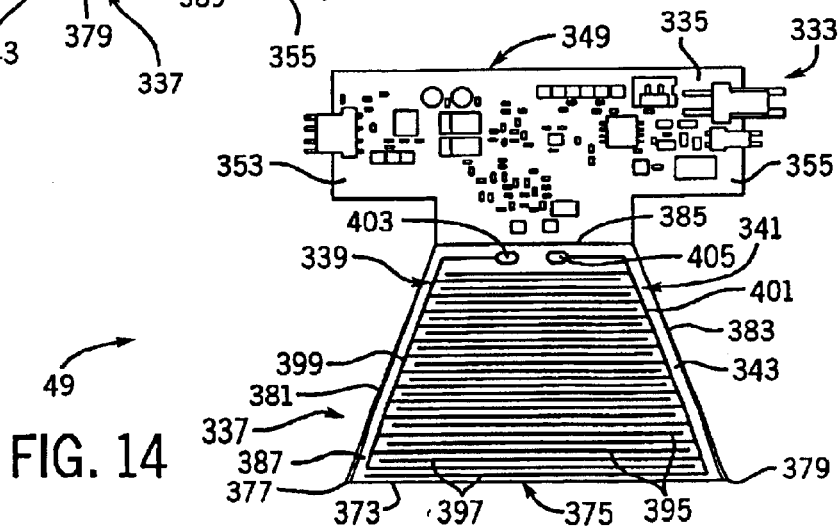
FIG. 14 is a top plan view the exemplary three-dimensional sensor of FIG. 12. The electrical components shown are illustrative only and are not intended to represent the actual components.

Referring to FIGS. 12–14, sensor 337 consists of first and second conductors 339, 341 made of electrically-conductive copper or the like deposited on substrate 343, preferably on substrate bottom 389 surface. Conductors 339, 341 are preferably deposited in the interdigital array shown in FIGS. 12–14. Specifically, first and second conductors 339, 341 each preferably include a plurality of parallel conductor elements 395, 397 deposited on substrate 343 each connected to respective main conductors 399, 401 which end in terminals 403, 405. Each parallel element 395, 397 is connected such that each element 395 of the first conductor 339 is connected to every other first conductor element 395 and each element 397 of the second conductor 341 is connected to every other second conductor element 397. Further, the parallel elements 395, 397 of each conductor 339, 341 are preferably arrayed such that elements 395, 397 alternate one after the other so that the nearest element 397 to each element 395 is an element 397 of the second conductor 341 and the nearest element 395 to each element 397 is an element 395 of the first conductor 399.

Sensor 337 most preferably has a three-dimensional geometry and generates a detection zone 400 advantageously directed toward positions about dispenser 10 most likely to be contacted by the outstretched hand or body part of user positioned to receive sheet material 111, 113 from web discharge opening 67. This advantageous result is achieved by providing substrate 343 and conductors 339, 341 with a pronounced arcuately-shaped architecture, preferably by bending the flexible substrate 343 and conductors 339, 341 so that substrate front corners 377, 379 and side edges 381, 383 are positioned above center portion 375 as shown in FIGS. 12–14. Clip 407 holds substrate 343 along the front edge 373 center portion 375. Slots 411, 413 in ribs 414, 415 are above clip 407 and receive the substrate 343 therein. Front corners 377, 379 are held against walls 417, 419 at a position above slots 411, 413. Conductors 339, 341 take on the three-dimensional configuration of substrate 343.

Sensor 337 is not limited to the specific three-dimensional structure described above. Other types of three-dimensional architecture may be used. For example, substrate 343 could be configured in the form of a cylindrical tube with conductors 339, 341 deposited across the outer surface of the tube. Sensor 337 will function with a flat substrate 343 having conductors 339, 341 deposited on the flat substrate 343 and such sensors are within the scope of the invention. However, such sensors are disadvantageous because, for the same size sensor, the detection zone of a flat sensor is far more limited, particularly in width across the dispenser housing, than the detection zone 400 of the three-dimensional sensor 337.

Figure 15:
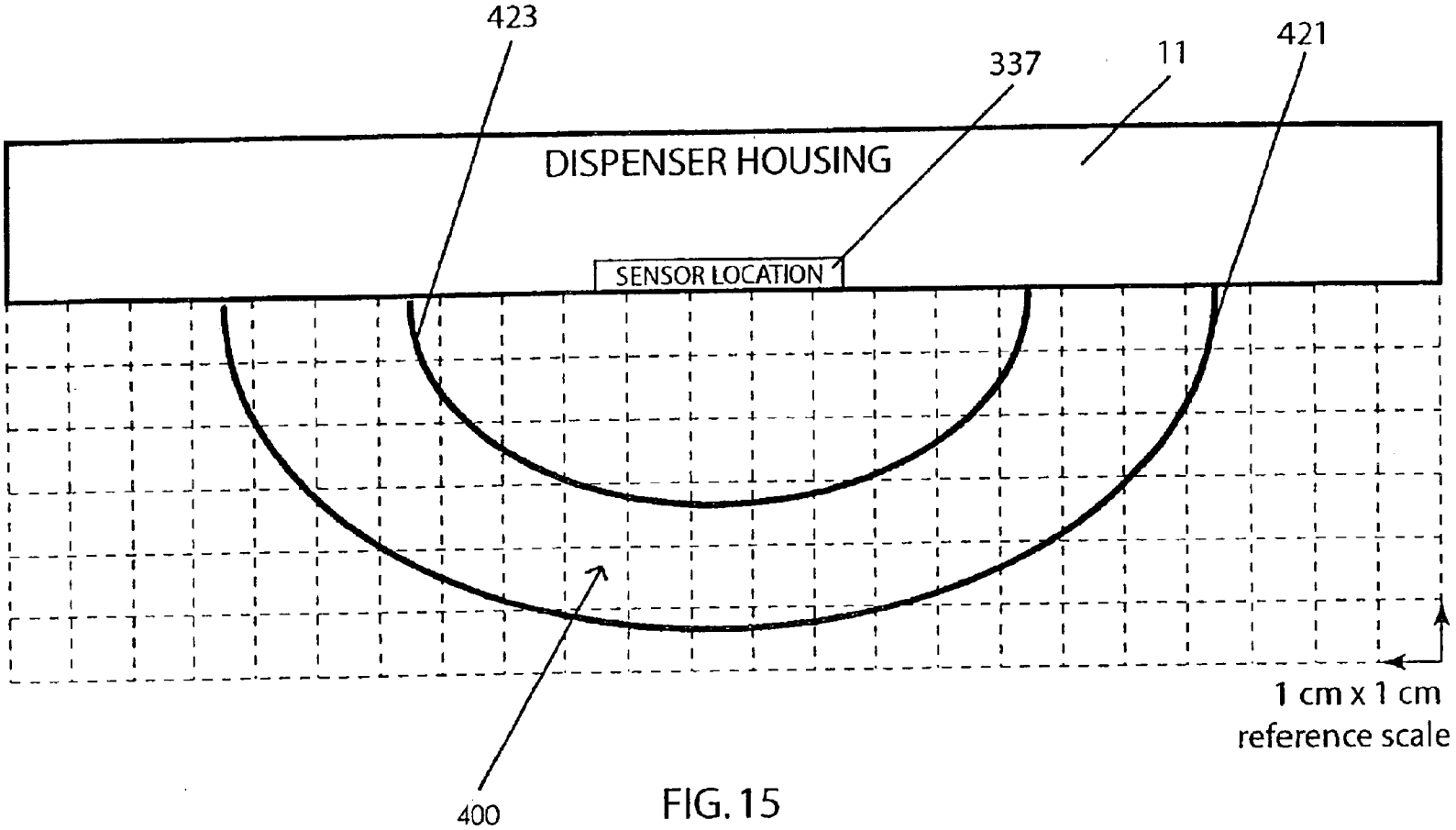
FIG. 15 is a graph demonstrating the directionally-oriented detection zone generated by an exemplary three-dimensional sensor.

FIG. 15 is a two-dimensional representation of the three-dimensional volume of detection zone 400 generated by a the three-dimensional sensor 337 of a detuned proximity detector 49 and control 50 with the sensor 337 at the location shown in FIGS. 9 and 10. The location of dispenser housing 11 and sensor 337 within housing 11 are indicated. For purposes of FIG. 15, dispenser 10 was positioned along a vertical wall surface. Measurements were taken of dispenser actuation at points across the width of the dispenser bottom wall 65 at distances 12 cm and 15 cm from the wall. The outermost points along which dispenser actuation occurred are represented by the curves shown on FIG. 15.

Curves 421, 423 represent the volume of the detection zone 400 provided by three-dimensional sensor 337 at locations 15 cm (421) and 12 cm (423) from the wall. As is apparent, the three-dimensional sensor 337 generates a shaped detection zone 400 which covers the region below the dispenser discharge opening central to the dispenser where a user would naturally place his or her hand to receive sheet material 111, 113 from discharge opening 67. The boundaries of detection zone may be expanded or contracted (i.e., tuned or detuned) as described in detail below.

Figure 16:
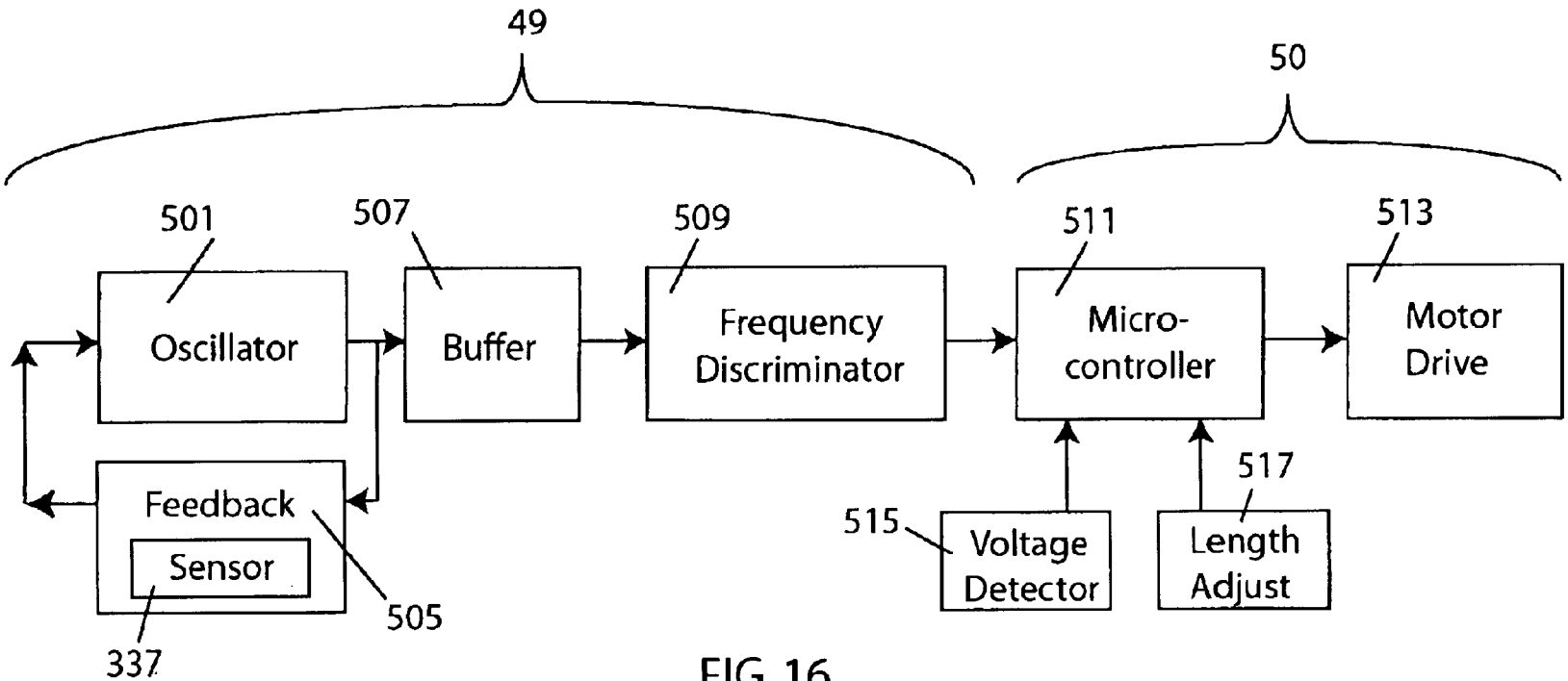
FIG. 16 is a block diagram illustrating the general operation of the proximity detector and control apparatus of the invention.

Referring now to FIGS. 16–18, those figures illustrate the components and operation of exemplary proximity detector apparatus 49 and control apparatus 50. FIG. 16 is a block diagram of the proximity detector 49 and control apparatus 50 in accordance with the present invention. FIGS. 17A–17D are schematic diagrams showing the electrical components of the proximity detector 49 and control apparatus 50 in accordance with the present invention. FIGS. 18A–18K comprise a series of idealized graphs which are used to describe operation of the differential frequency discriminator 509.

Turning first to block diagram FIG. 16, proximity detector 49 includes an oscillator 501 with a sensor 337 in its feedback path 505. As described in more detail below, oscillator 501 generates an oscillating voltage 551 (FIG. 18A) the frequency of which is affected by the electrical capacitance of sensor 337. The capacitance of sensor 337 is changed by the presence of a user (e.g., a user's hand) in proximity to sensor 337. A buffer 507, well-known to those skilled in electronics, serves to isolate the operation of oscillator 501 from other parts of the circuitry.

Differential frequency discriminator 509 is configured to be sensitive to changes of the oscillator frequency and produce an output which is used by a processor, such as micro-controller 511, to control motor drive 513 in order to dispense a length of sheet material. Micro-controller 511 controls the length of sheet material 111, 113 dispensed based on a signal from voltage compensation circuit 515 which is used to determine power source output (preferably voltage), and a signal from an optional sheet length adjustment control 517 provided to permit the operator to preselect a specific length of sheet material to be dispensed.

Central to operation of the proximity detector 49 shown in FIG. 16 is the operation of frequency discriminator 509. Discriminator 509 receives the output 551 from oscillator 501 and then processes that output 551 to detect very small changes in capacitance in the detection zone 400 resulting from the presence of the user's hand.

Operation of frequency discriminator 509 will be described in connection with FIGS. 18A–18K. References to the schematic diagrams of FIGS. 17A–17D will be made as appropriate.

The following explanation will be useful in understanding the data represented by FIGS. 18A–18K provided to describe operation of the frequency discriminator 509. In FIGS. 18A–18K, each graph includes an upper horizontal dotted line 547 and a lower horizontal line 549. Upper line 547 represents the logical high voltage level for the apparatus (about 3.3V for the circuits in FIGS. 17A–17D), and lower line 549 represents the logical low voltage level for the apparatus (about 0 V for the circuits in FIGS. 17A–17D, with one exception which will be noted later in the description of circuit operation). The graphs of FIGS. 18A–18K are somewhat idealized in that precise voltage levels are not shown, but the graphs completely represent the operation of frequency discriminator 509. FIGS. 18A–18I have time as the horizontal axis (dependent variable), and FIGS. 18J and 18K have oscillator frequency decrease as the horizontal axis (dependent variable).

Figure 18A:
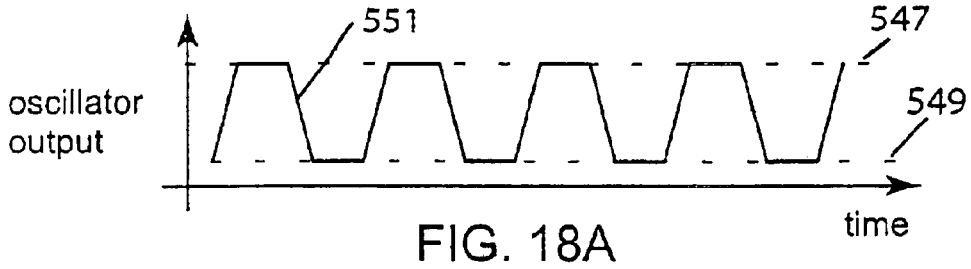
FIGS. 18A–18K are graphs illustrating the operation of a differential frequency discriminator according to the invention.
Figure 18B:
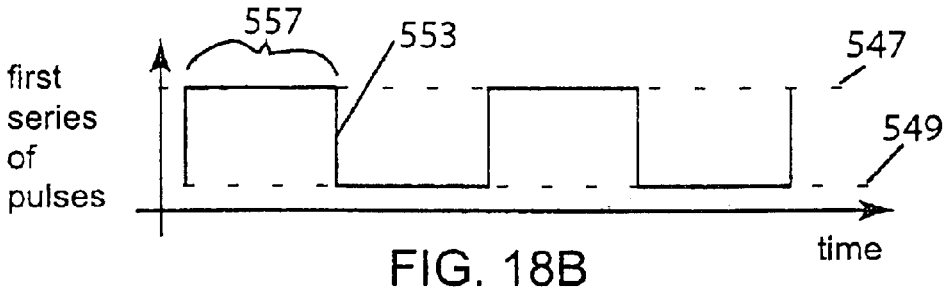
Figure 18C:
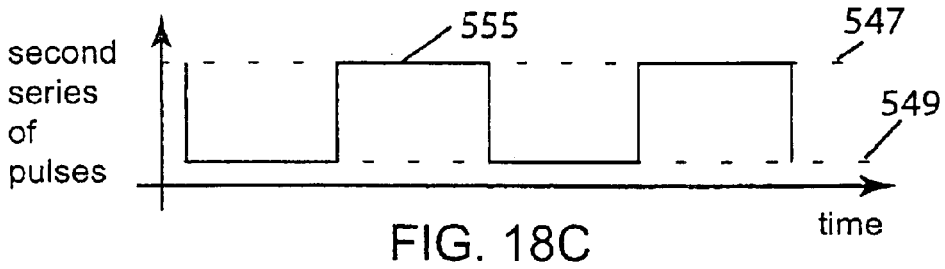

Referring now to FIG. 18A, that figure shows a somewhat idealized representation of oscillator output 551. A monostable multivibrator 521 (FIG. 17C) generates a first series of pulses 553 (shown in FIG. 18B) and a second series of pulses 555 (shown in FIG. 18C) which is the complement of first series 553. In the embodiment of the apparatus being described, circuit parameters within multivibrator 521 are set such that the frequency of first series 553 is half the frequency of oscillator output 551. (This frequency-halving is useful in this particular embodiment but not fundamental to the operation of discriminator 509.) The width of the high portion 557 of first series 553 is adjusted by a set point circuit 523 (FIG. 17C) within monostable multivibrator 521 such that the high portion of each cycle is approximately one-half of each cycle when the user is not in the detection zone 400 of sensor 337. Operation of multivibrator 521 is such that the width of high portion 557 remains unchanged when the frequency of oscillator output 551 changes.

Figure 18D:
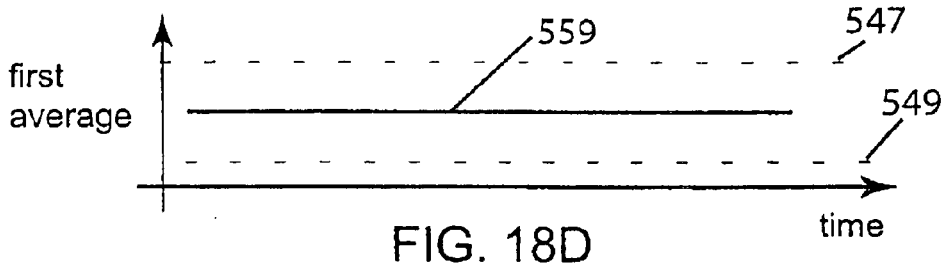
Figure 18E:
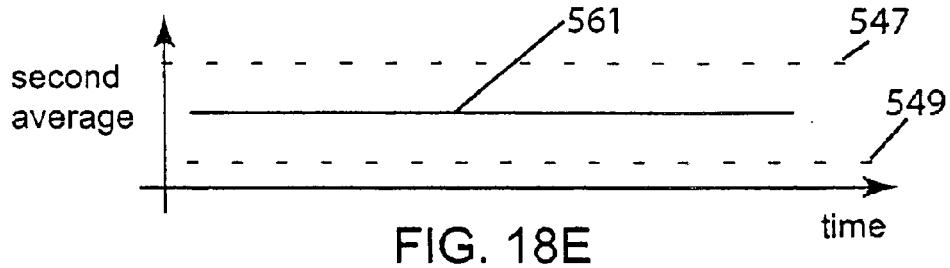
Figure 18F:
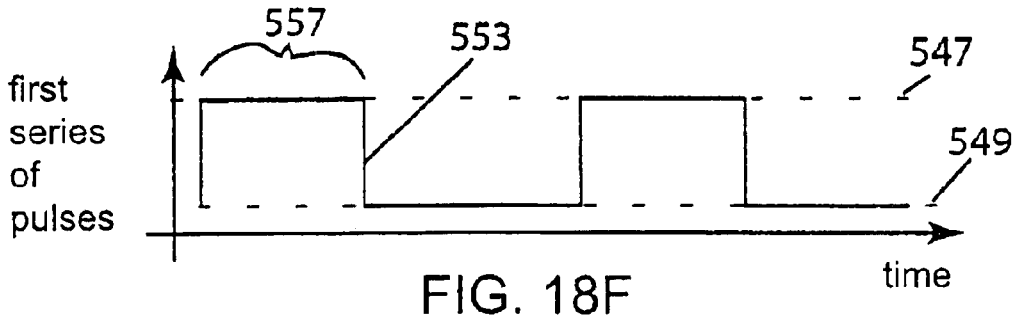
Figure 18G:
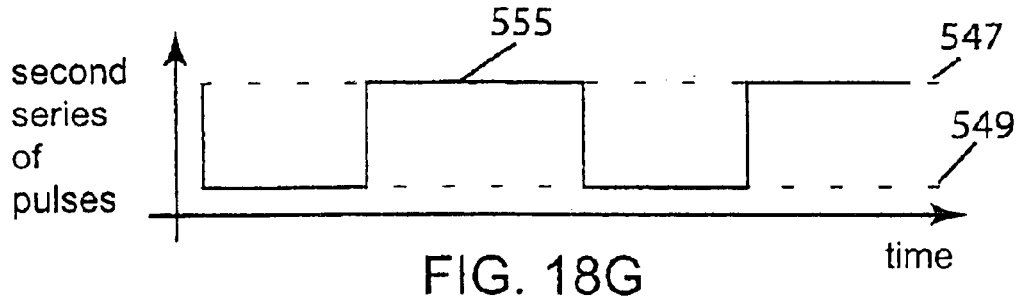
Figure 18H:
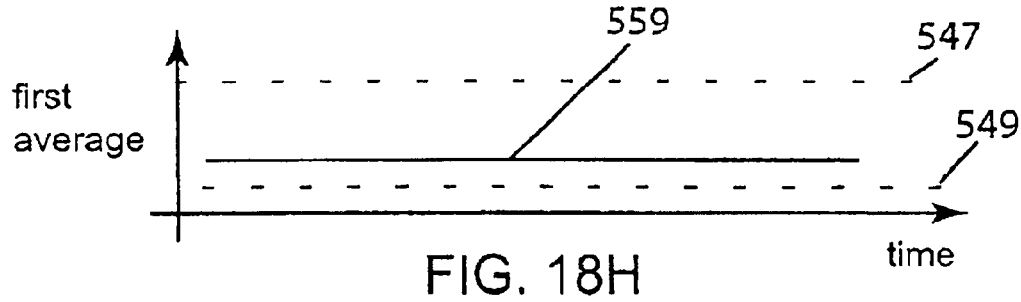
Figure 18I:
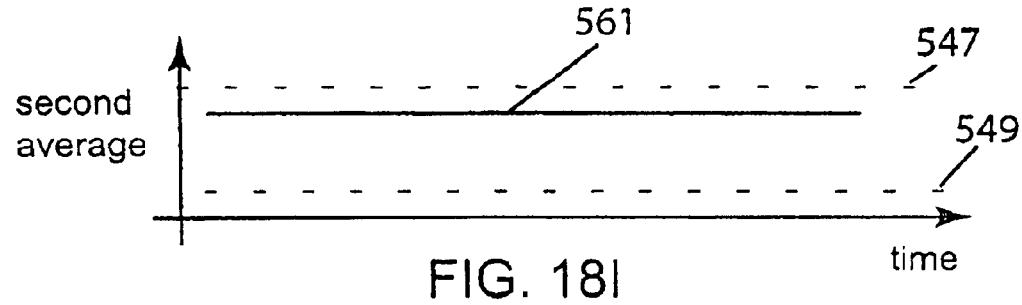

First series 553 and second series 555 are averaged by a first averaging circuit 525 (FIG. 17C) and a second averaging circuit 527 respectively, generating a first average 559 and a second average 561 illustrated respectively in FIGS. 18D and 18E. Since second series 555 is the complement of first series 553 and since the width of high portion 557 is about one-half of each cycle of series 553, first average 559 and second average 561 are nearly equal to each other.

When a user comes into the proximity of sensor 337, the sensor capacitance affects the oscillator 501 by lowering the frequency of oscillator output 551. Because the width of high portion 557 remains constant, first average 559 decreases and second average 561 increases, as illustrated in exaggerated fashion in FIGS. 18F–18I, which correspond to FIGS. 18B–18E respectively, and represent operation of discriminator 509 when a user is in the detection zone 400 proximate sensor 337. First average 559 and second average 561, by decreasing and increasing respectively with a decrease in the frequency of oscillator output 551, result in highly sensitive detection of changes in the capacitance of sensor 337.

Figure 18J:
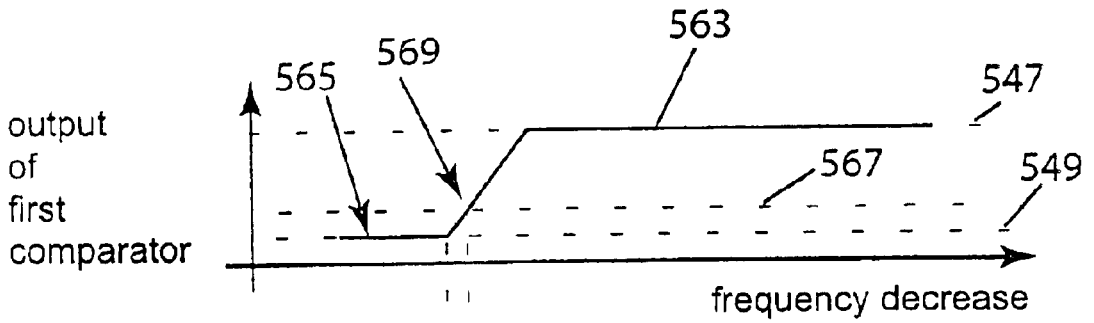
Figure 18K:
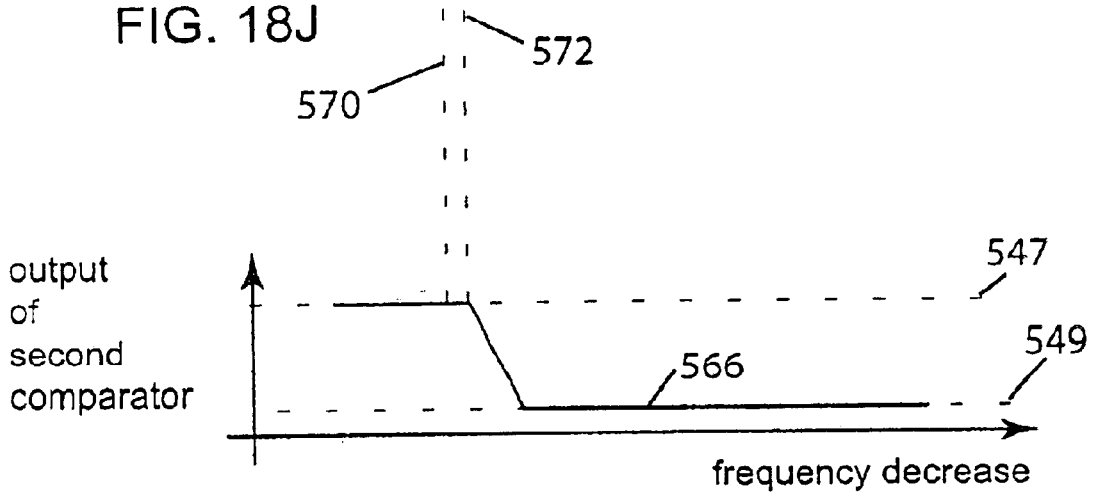

Referring to FIGS. 18J–18K, first average 559 and second average 561 are inputs to a first comparator 529 (FIG. 17C) which amplifies the difference between second average 561 and first average 559, generating an output 563 of first comparator 529 as shown in FIG. 18J. When no user is in detection zone 400, the value of output 563 is at operating point 565 because set point circuit 523 is set such that first average 559 and second average 561 are nearly equal. When a user is present in detection zone 400, output 563 goes high as shown at the right side of FIG. 18J. Note that for first comparator 529 (FIG. 17C), the logical low voltage level as indicated in FIG. 18J is about 1.5V, and the logical high voltage is 3.3V.

The proximity detector 49 may optionally be tuned or detuned to adjust the volume of the detection zone 400. This result is accomplished through use of a second comparator 531 and a threshold reference signal 567 which may be set at a preselected voltage level corresponding to the size of the frequency change necessary for detection of the user within zone 400. Referring then to FIGS. 18J and 18K, second comparator 531 generates an output 566 which is the result of comparing output 563 of first comparator 529 with the threshold reference signal 567 (represented by the dotted line voltage level labeled 567 in FIG. 18J). Output 566 in FIG. 18K is, therefore, the amplified difference between threshold reference signal 567 and output 563. Second comparator 531 is configured such that output 566 is low when a user is in proximity of sensor 337 as shown in FIG. 18K.

Operating point 565 represents no change in frequency (no user present) as indicated by the dotted line 570 correlating the signals of FIGS. 18J–18K. When first comparator 529 output 563 becomes higher than threshold signal 567, the presence of a user is indicated. This event (shown at the point labeled 569) occurs with a change in frequency indicated by dotted line 572 in FIGS. 18J–18K. Thus, frequency change 572 represents the frequency change at which output 566 changes as a result of first comparator output 563 becoming higher than threshold signal 567. Adjustment of the value of threshold reference signal 567 thereby adjusts the sensitivity of discriminator 509 to changes in oscillator frequency and thus in sensor capacitance. Therefore, higher levels of threshold reference signal 567 result in smaller detection zone 400 volumes since triggering requires a larger frequency change.

Threshold reference signal 567 also helps to reduce the sensitivity of discriminator 509 to changes in environmental conditions (temperature and humidity) by setting frequency change 569 outside of the range of frequency changes which expected variations of temperature and humidity would cause. This setting, combined with the differential nature of the discriminator and the selection of component values to set operating point 565, all result in operation of discriminator 509 which is insensitive to the normal temperature and humidity variations expected at locations in which the dispenser normally would operate.

Figure 17A:
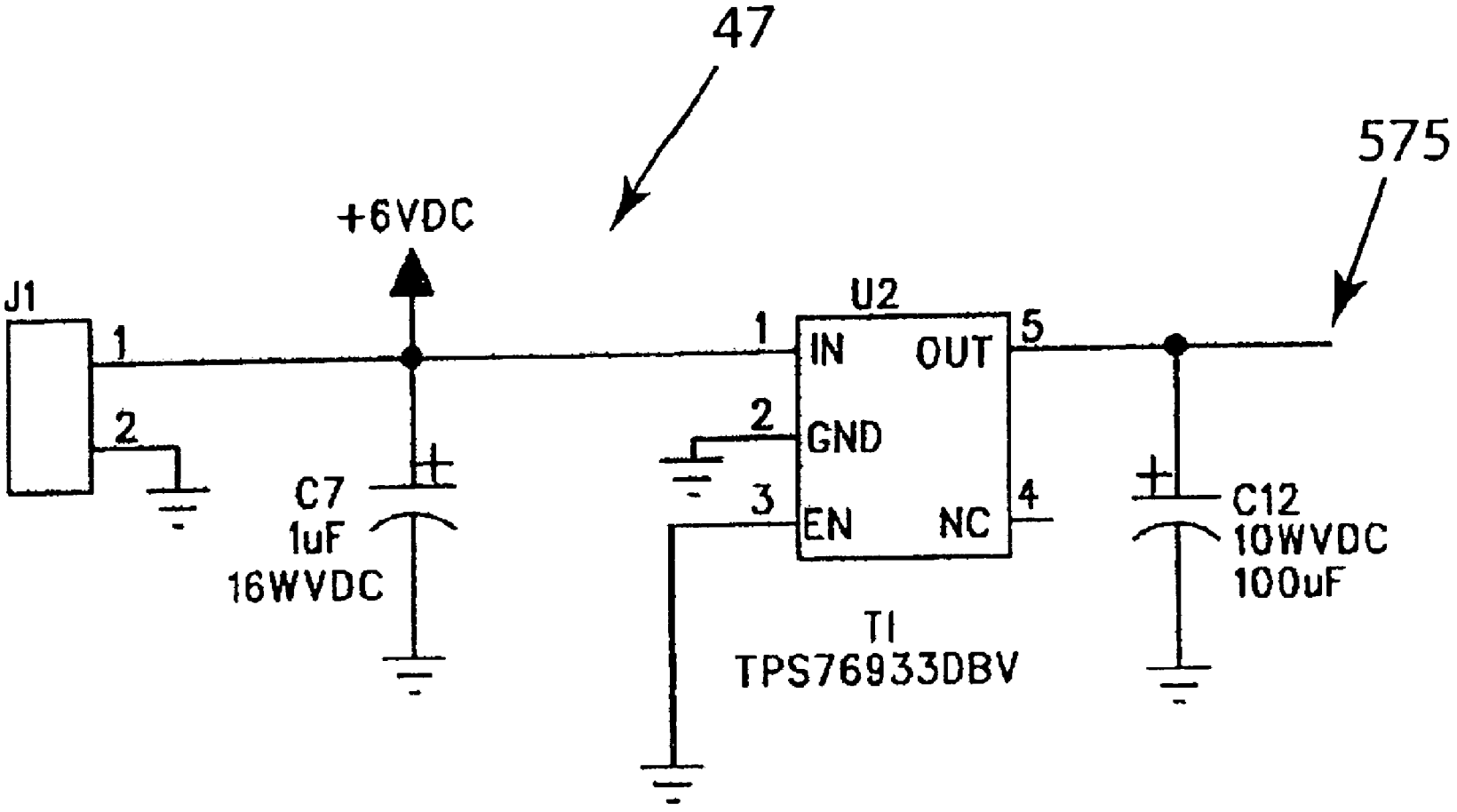
FIGS. 17A–17D are schematic diagrams showing the preferred electrical components of the control apparatus in accordance with the present invention.

The schematic of FIG. 17A shows a power supply apparatus 47 for powering the dispenser 10. Four 1.5V "D" cell batteries (such as batteries 271, 273) are connected in series at connector J1. The supply output of the battery-powered power supply apparatus 47 may comprise either the voltage, current or both provided by the batteries. Regulated power supply apparatus 47 receives the 6V electrical current from the batteries at connector J1 and converts the voltage to 3.3V DC of regulated power output which is supplied to the remaining circuitry at the point represented by reference number 575. Regulated power supply apparatus 47 is actually connected to the points labeled 3.3V throughout FIGS. 17B–17D. The circuitry and operation of regulated power supply apparatus 47 is well-illustrated in FIG. 17A and is known to those skilled in the art of electronic circuitry.

Figure 17B:
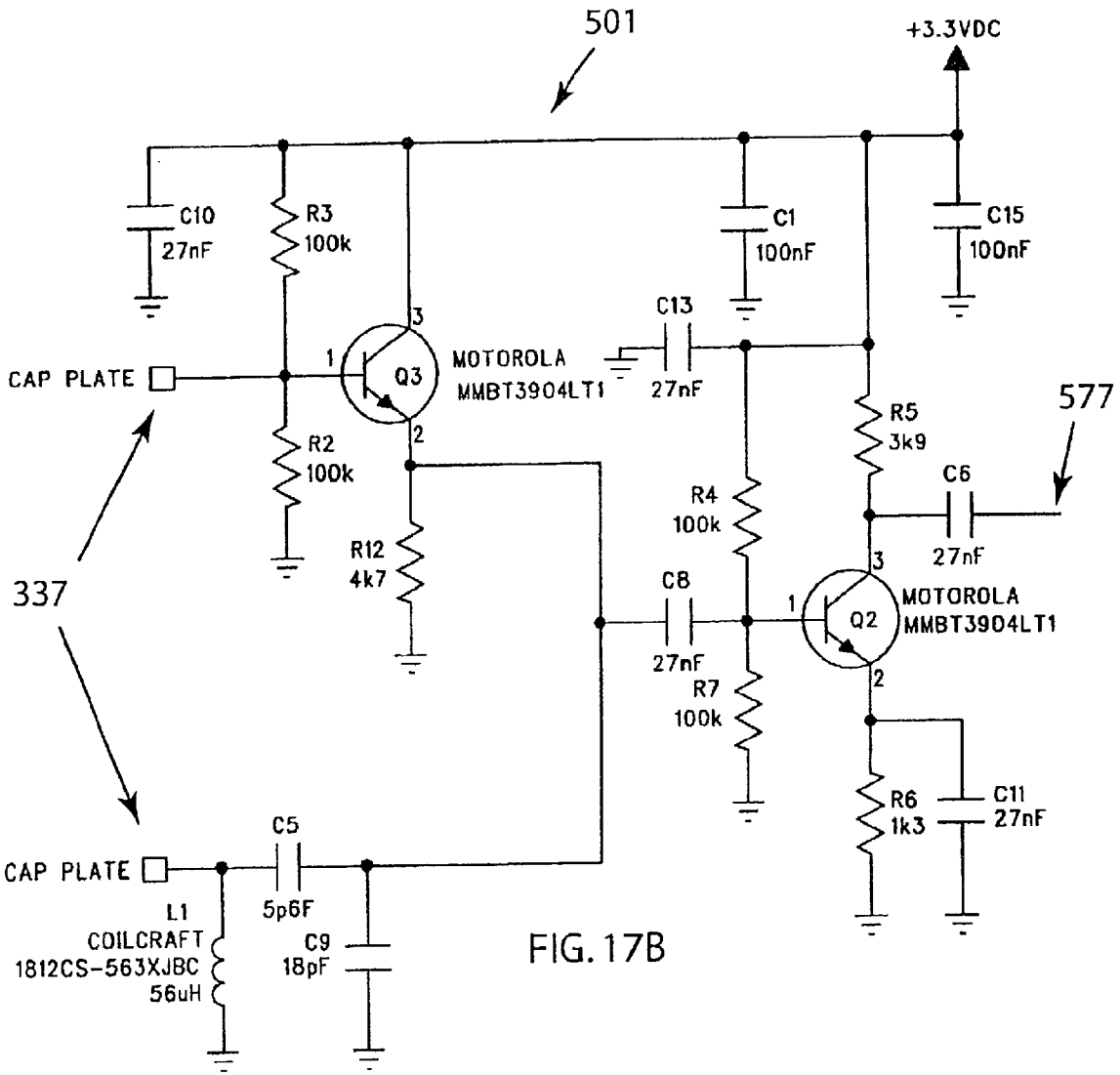
Figure 17C:
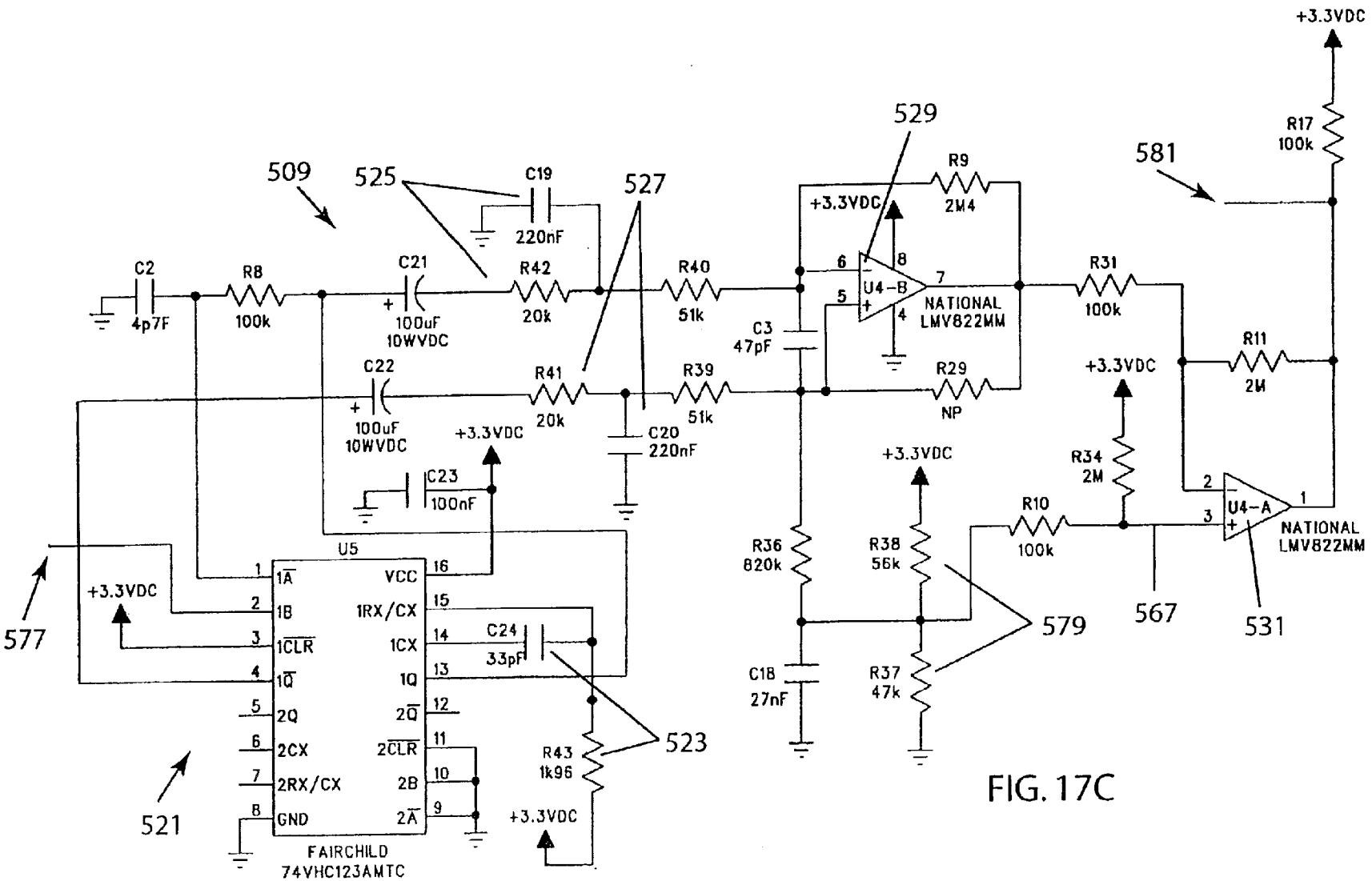

FIG. 17B is a schematic of oscillator 501 which includes sensor 337. Oscillator output 551 is found at the point in the circuit labeled 577, which then provides output 551 to discriminator 509, shown in FIG. 17C (also showing the point 577). The various circuits included in discriminator 509 have already been pointed out in the discussion above. Circuit elements labeled 579 (R38 and R37) are adjusted to set threshold signal 567.

Figure 17D:
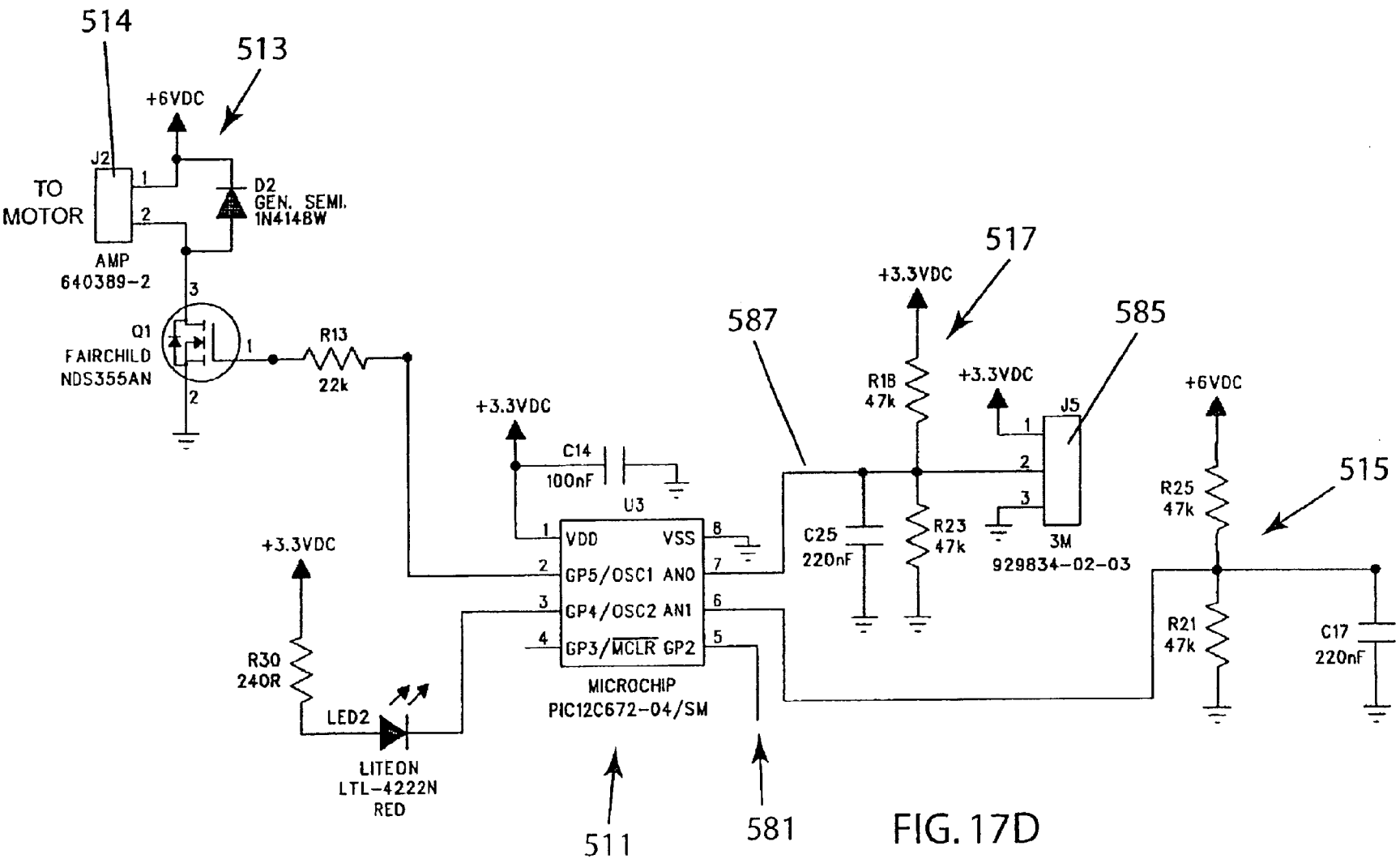

Output 566 of second comparator 531 is found at the point labeled 581, such point being further found as an input to the schematic of FIG. 17D which shows micro-controller 511 and motor drive circuit 513. Optional sheet material length selector 517 including control 585 and length signal found at the point labeled 587 set by selector 517. Control 585 is shown as a connector configured to receive a jumper between a pair of neighboring pins, or no jumper, such connector being a common element known to those skilled in the art.

Also as shown in FIG. 17D, a motor drive signal is available to the motor 267 (not shown in FIG. 17D) across the terminals of connector 514. The duration of the signal determines the length of the sheet material selected 517 based on the power supply voltage level compensation at voltage compensation circuit 515.

Method of Dispensing

Operation of exemplary automatic dispenser 10 and an exemplary method of dispensing will now be described. The method of dispensing will be adapted to the specific type of automatic dispenser apparatus utilized with the proximity detector.

The first step of the dispensing method involves loading the dispenser with product to be dispensed. For the sheet material dispenser 10, such loading is accomplished with respect to dispenser 10 in the following manner. The dispenser cover 17 is initially opened causing roller frame assembly 173 to rotate outwardly about axially aligned pivot openings positioned in frame sidewall 53, 59 one of which is identified by reference number 189 (FIG. 8). The rotational movement of frame assembly 173 positions tension roller 141 and transfer assembly 227 away from drive roller 139 providing unobstructed access to housing interior 15 and space 75.

When dispenser 10 is first placed in operation, a primary roll 39 of sheet material, such as paper toweling or tissue, may be placed on yoke 125 by spreading arms 131, 133 apart so as to locate the central portions of holders 135, 137 into roll core 117. The sheet material 111 is positioned over drive roller 139 in contact with drive roller segments 143–147. A fresh roll could be stored on cradle 119 awaiting use. Further, cradle 119 could be removed to insert fresh batteries into battery box 311. Thereafter, cover 17 is closed as shown in FIG. 1. Movement of cover 17 to the closed position of FIG. 1 causes the leaf springs 213, 215 mounted on the roller frame assembly 173 to come in contact with the inside of cover 17 resiliently to urge the tension roller 141 into contact with sheet material 111 from roll 39 thereby ensuring frictional contact between the sheet material 111 and the drive roller 139 and, more particularly, drive roller segments 143–147. The dispenser 10 is now loaded and ready for operation.

Subsequent steps involve the electrical components of the proximity detector and control apparatus 49, 50 and are illustrated in the block diagrams of FIGS. 19A–19E. It would be expected that the instructions for execution of the steps are provided in the form of software code embedded on firmware provided, for example with micro-controller 511. However, the instructions may be provided in other forms, such as in operating system software.

Figure 19A:
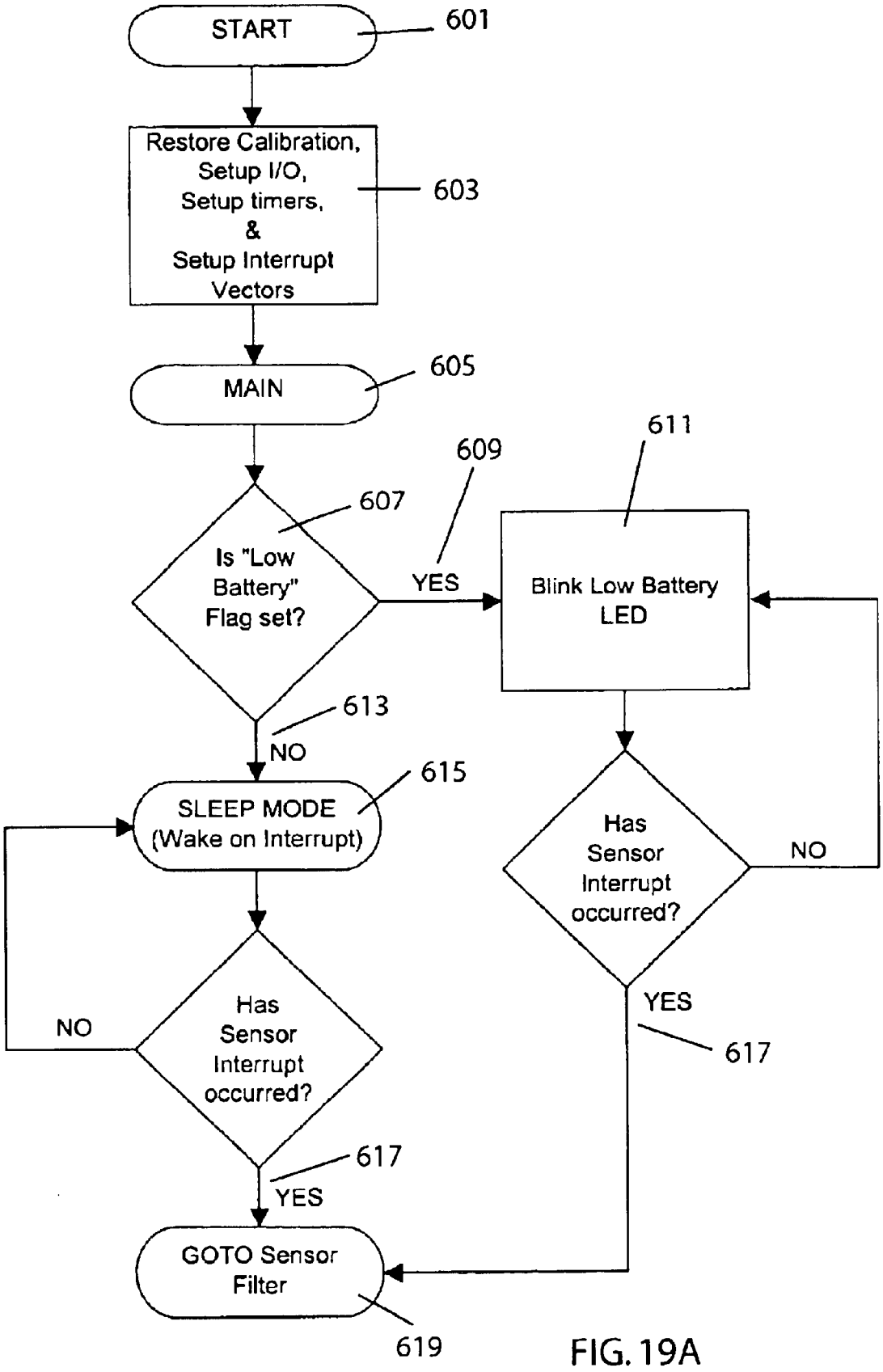
FIGS. 19A–19E are block diagrams showing the steps of a preferred method of dispensing according to the invention.
Figure 19B:
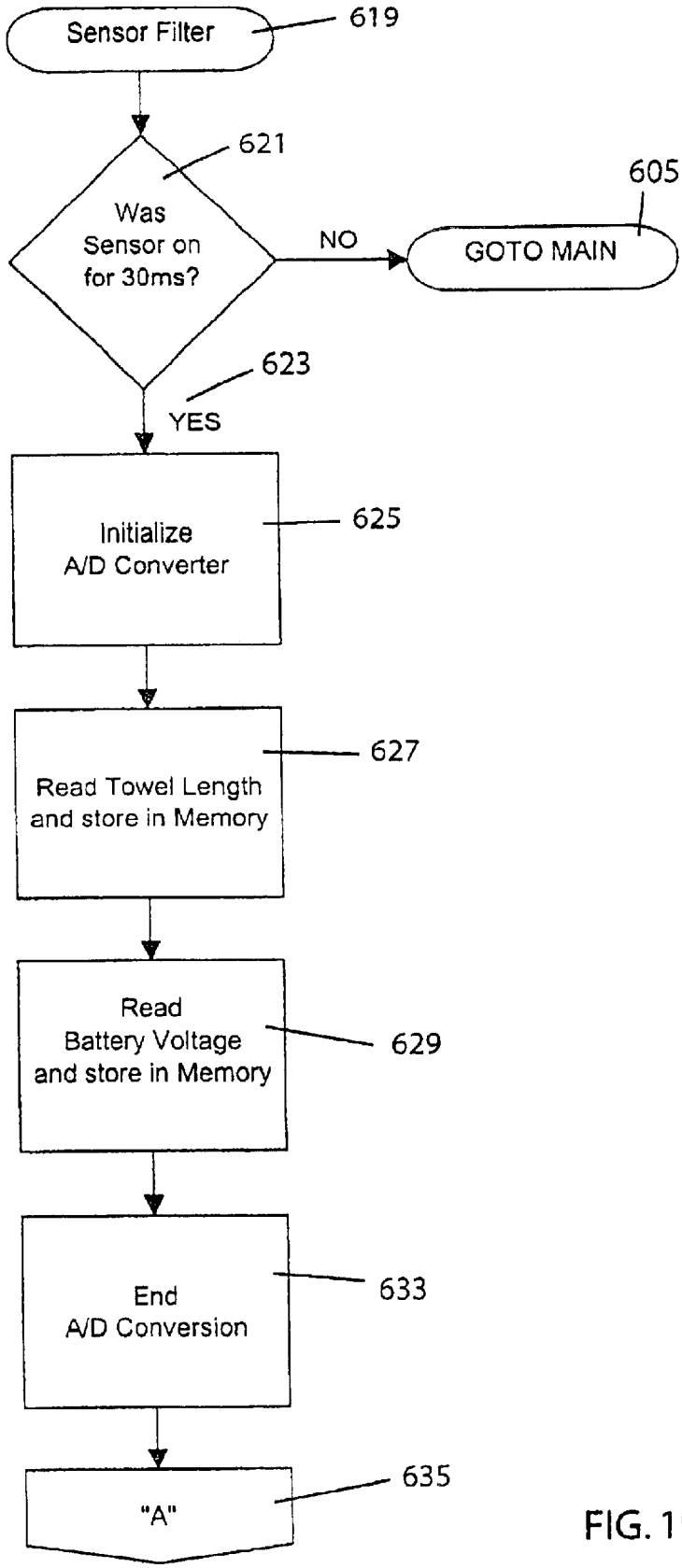
Figure 19C:
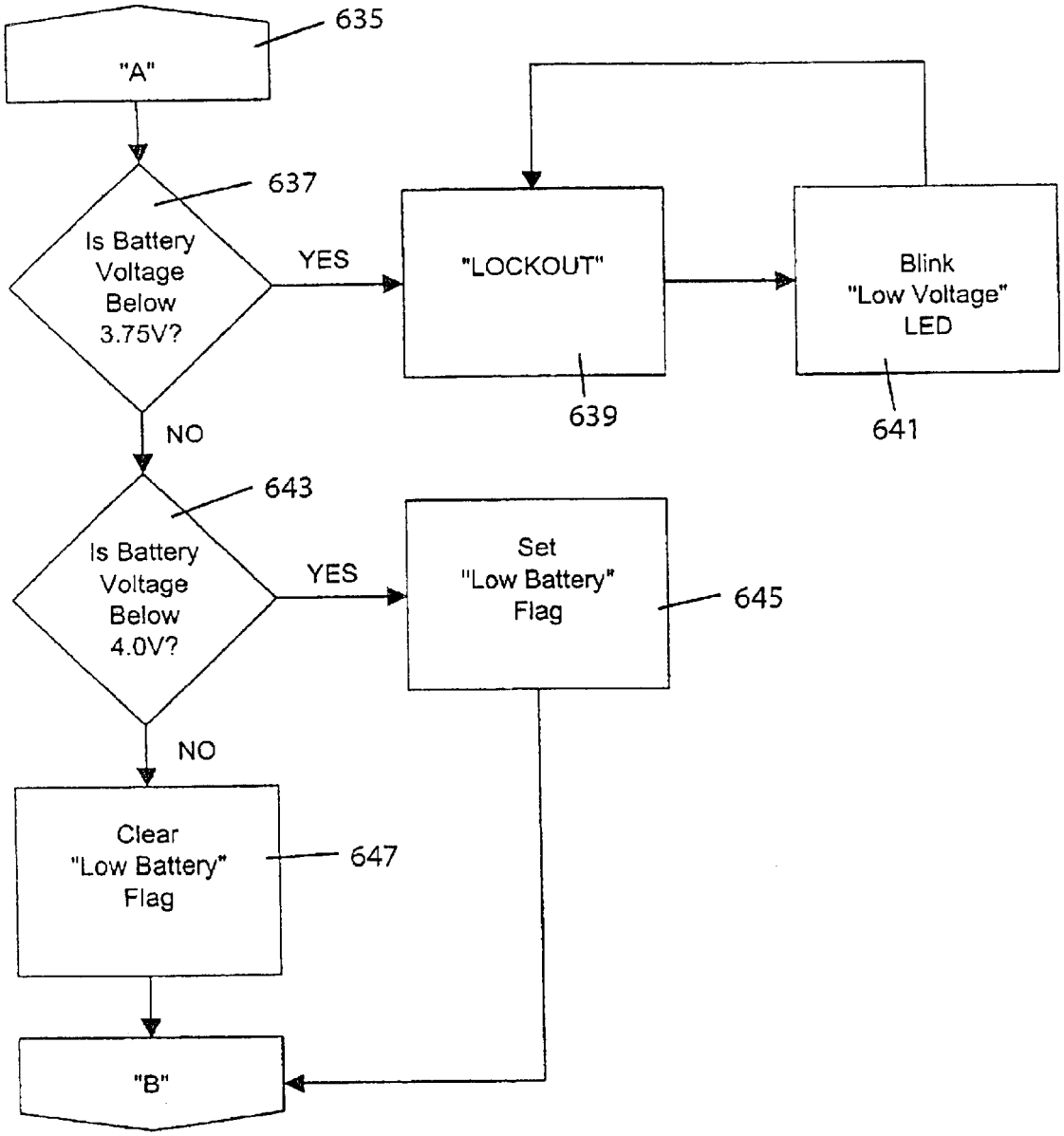

The loaded dispenser 10 is now in the "start" state 601 illustrated in FIG. 19A. While awaiting an input signal indicating the presence of a user, the dispenser firmware automatically restores calibration, initializes input/output and initializes timers and interrupt vectors, combined as step 603. Upon completion of this step, the dispenser is in the "main" state 605. In step 607, the dispenser 10 then determines whether the low battery flag has been set during a previous dispensing cycle. Setting of the flag would indicate that the batteries have a low voltage between preset values as described below. If the flag is set, the dispenser is in state 609 and the dispenser activates a signal in the form of an LED which is cycled on and off (step 611) to indicate to the attendant that the batteries require replacement. If the batteries have a voltage above the threshold (state 613) and if no user is present, the dispenser will enter a "sleep mode" (state 615) to conserve energy. The dispenser does not enter sleep mode if the low battery flag is set.

When a person approaches the dispenser and a change in capacitance is detected by the frequency discriminator 509, a "sensor interrupt" event (step 617) occurs.

In response to the sensor interrupt event 617, dispenser 10 next attempts to determine whether the detection was true or false by filtering out false detection. In the sensor filter state 619 represented in FIG. 19A and at the top of 19B, dispenser 10 determines whether the detection responsible for the sensor interrupt event exceeded a time duration threshold which is 30 ms in this example (step 621). Detection for less than the threshold duration means that the signal was false and the dispenser is returned to the main state 605. Detection in excess of the threshold indicates that the detection event is true (state 623).

A cascade of further steps occurs in response to a true sensor interrupt event. In step 625, the A/D converter is initialized. The sheet material length to be dispensed and battery voltage corresponding to the length of sheet material to be dispensed are read and stored in memory (steps 627 and 629), and A/D conversion is then complete (step 633), resulting in state 635.

Power supply voltage compensation circuit 515 is optionally provided to cause the dispenser to determine (step 637) whether the battery voltage is below a minimum voltage threshold (3.75V in this example) required to enable completion of a dispensing cycle. If the voltage is below the threshold then the dispenser is placed in a "lockout" condition (state 639) in which further mechanical operation is interrupted and the LED low battery flag is active (state 641). If the voltage is above the minimum threshold but below a secondary threshold (determined by step 643), lockout is avoided but the low battery flag is set (state 645). Detection of the low battery flag in an earlier step 607 results in actuation of the cycling LED indicator signal (state 611). If the voltage is above the secondary voltage threshold then any previous low battery flag is cleared in step 647. The battery condition is stored (step 648) in memory, and the dispenser proceeds to the next steps if sufficient power is available.

If an optional sheet material length adjustment selector 517 (FIGS. 16 and 17D) is included, the control apparatus 50 will next determine the appropriate length of sheet material to be dispensed. The towel length reading is read (step 649) and then, in step 651, is compared to three predetermined settings and set to the setting selected. Dispenser 10 is then in a state 653 ready for a voltage compensation step.

In step 655, control apparatus 50 accesses a look-up table with stored motor run times corresponding each towel length and to the stored battery voltage in step 648. Control apparatus 50 computes the dispense time (step 655), and generates a drive signal (step 656) which, when amplified by motor drive 513, turns on the drive motor 267 rotating drive roller 139 and drawing sheet material 111 through nip 157 and out of dispenser 10 through discharge opening 67. While the drive signal is being generated (step 656), the control apparatus 50 checks the low battery flag (step 657), blinks the low battery LED (state 659) if the low battery flag is set, and checks to see if the computed dispense time has been reached (step 661). When the dispense time has been reached, the drive signal is terminated and the motor 267 is turned off (step 663), a one second delay is inserted (step 665), and the dispenser is returned to main state 605. The user may then separate the sheet 111 into a discrete sheet by lifting sheet 111 up and into contact with tear bar 71 serrated edge 207 tearing the sheet 111.

After repeated automatic dispensing cycles, cover 17 is removed to permit replenishment of the sheet material. At this time, a portion of roll 39 remains and a reserve roll 41 of sheet material can be moved into position. As illustrated in FIG. 9, partially dispensed roll 39 (preferably having a diameter of about 2.75 inches or less) is now moved onto cradle 119 arcuate surfaces 121, 123. Sheet material 111 extending from roll 39 continues to pass over drive roller 139.

After primary roll 39 is moved to the position shown in FIG. 9, a fresh secondary roll 41 can be loaded onto yoke 125 as previously described. Sheet material 113 is then threaded onto the transfer assembly 227. More specifically, sheet material 113 is urged onto catch 256 which pierces through the sheet material 113. Sheet material 113 is further led under pins 259, 261 to hold sheet material 113 in place on the transfer assembly 227 as shown in FIG. 9. Transfer assembly surface 250 rests against sheet material 111. Surface 250 will ride along sheet material 111 without tearing or damaging material 111 as it is dispensed. The cover 17 is then closed to the position shown in FIG. 1.

After further automatic dispensing cycles, sheet material 111 from primary roll 39 will be depleted. Upon passage of the final portion of sheet material 111 through nip 157, transfer surface 250 will come into direct contact with arcuate surface 257 of drive roller 139. Frictional engagement of drive roller segment 145 and surface 250 causes transfer assembly 227 to pivot rearwardly and slide up along slots 237, 239. Movement of transfer assembly 227 as described brings teeth 253 along arcuate surface 251 into engagement with drive roller segment 145. Engagement of teeth 253 with the frictional surface of segment 145 forcefully urges sheet material 113 held on catch 256 into contact with drive roller surface 257 causing sheet material 113 to be urged into nip 157 resulting in transfer to roll 41 as shown in FIG. 10. Following the transfer event, transfer assembly 227 falls back to the position shown in FIG. 10. Thereafter, sheet material 113 from roll 41 is dispensed until depleted or until such time as the sheet material rolls are replenished as described above.

The invention is directed to automatic dispenser apparatus generally and is not limited to the specific automatic dispenser embodiment described above. For example, there is no requirement for the dispenser to dispense from plural rolls of sheet material and there is no requirement for any transfer mechanism as described herein. The sheet material need not be in the form of a web wound into a roll as described above. The novel proximity detector 49 and control apparatus 50 will operate to control the discharge and drive apparatus 43, 45 of virtually any type of automatic sheet material dispenser, including dispensers for paper towel, wipes and tissue.

The novel proximity detector 49 will operate with automatic dispensers other than sheet material dispensers. For example, the proximity detector will operate to control automatic personal care product dispensers, such as liquid soap dispensers (not shown). In the soap dispenser embodiment, the power supply apparatus 47, proximity detector 49 and control apparatus 50 components may be housed in an automatic soap dispenser apparatus. Discharge apparatus 43 and drive apparatus 45 may be a solenoid or other mechanical actuator. An appropriate fluid reservoir in communication with the solenoid or actuator (i.e., 43 and 45) is provided to hold the liquid soap. The solenoid or other actuator discharges soap from the dispenser through a fluid-discharge port. The detection zone 400 is generated below the soap dispenser adjacent the fluid-discharge port.

Operation of the soap dispenser may include steps/states 601–647 and 656–665 and the corresponding apparatus described with respect to the dispenser 10. (Steps 648–655 would not be relevant for the soap dispenser.) In the soap dispenser embodiment, the drive signal generated in response to a detected user (step 656 above) is available to the solenoid or other actuator in a manner identical to the manner in which the drive signal is generated in the dispenser embodiment 10. Generation of the drive signal actuates the solenoid or other actuator to dispense a unit volume of soap from the soap dispenser spout into the user's hand. The programmed instructions in micro-controller 511 will be tailored to the specific type of soap dispenser being used, for example to limit the number of dispensing cycles per detection event and to limit the dwell time between dispensing cycles.

Further Method of Dispensing

The block diagrams of FIGS. 20A–20G illustrate an alternative embodiment of instructions for use in controlling the operation of dispenser 10. The mechanical and electrical configuration of dispenser 10 used with the alternative instructions of FIGS. 20A–20G is identical to dispenser 10 previously described and such description of dispenser 10 is incorporated by reference. The instructions represented by the block diagram of FIGS. 20A–20G are typically provided for execution in the form of firmware embedded within a processor, such as micro-controller 511 of control apparatus 50.

The alternative embodiment of FIGS. 20A–20G provides instructions for improved operation of dispenser 10 across the life cycle of the batteries (such as D-cell batteries, two of which are indicated by reference nos. 271 and 273). Preferably, four 1.5V series-connected alkaline D-cell batteries are used to power dispenser 10 including motor 267. The output of the batteries is referred to herein as a power source output to indicate that a physical quantity (voltage or current) is measured to assess the state of the power supply. Such power source output is preferably expressed in terms of the voltage produced by the batteries. The power source output exists under both loaded and unloaded conditions. The instructions of FIGS. 20A–20G provide more accurate control over the length of sheet material 111 dispensed by dispenser 10 and provide for improved control over dispenser 10 operation as the power source output of the batteries diminishes across the battery life cycle.

Figure 21:
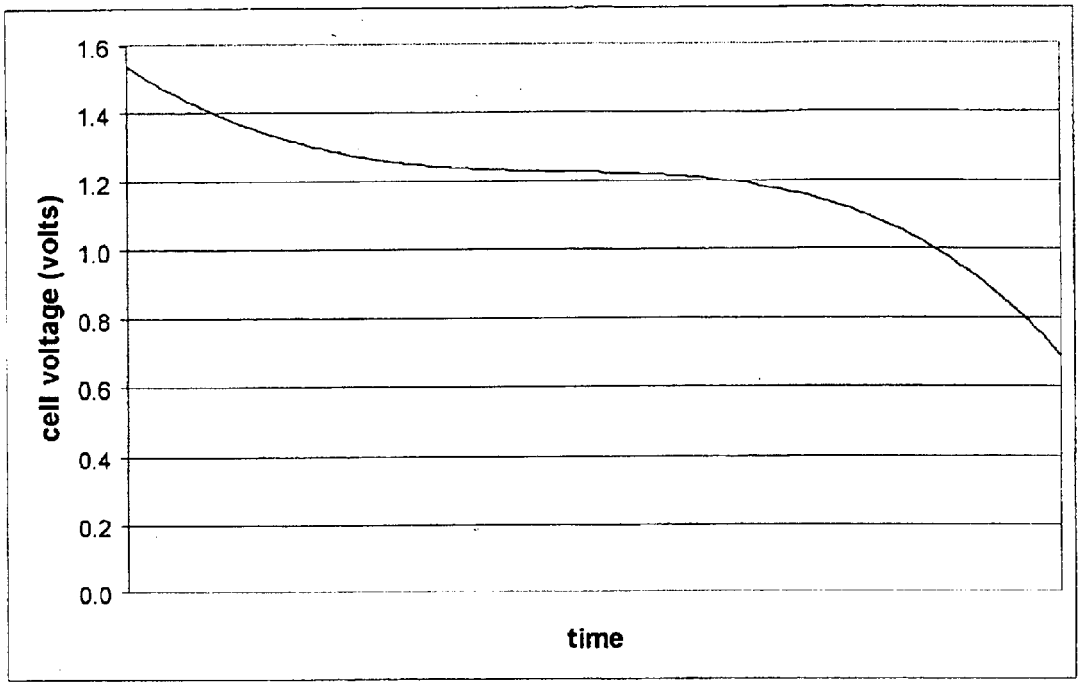
FIG. 21 is a graph showing the voltage of a representative alkaline battery cell over the life of the battery.

As is known, batteries produce voltages which depend on many different factors, including the chemistry of the type of battery cells being used, the length of time between manufacture and use, the rate of discharge, temperature and duty cycles. By way of example, FIG. 21 shows the changes in battery voltage of a representative 1.5V alkaline battery over the life cycle of the battery. The abscissa (time axis—time increasing from left to right) is not shown with a time scale since the purpose of the graph is only to illustrate the form of battery voltage vs. time as an alkaline battery is discharged. As shown in FIG. 21, after an initial voltage drop, the voltage of the 1.5V alkaline battery remains around 1.2V for an extended period of time, after which the voltage drops off rapidly as the battery approaches the end of its life cycle.

A challenge facing designers of battery powered dispensers is to ensure consistent operation of the dispenser as battery voltage decreases over the life cycle of the battery. One important object of dispenser operation is that the dispenser should discharge consistent lengths of sheet material over repeated dispense cycles. By consistent it is meant that the length of sheet material dispensed in repeated cycles is the approximately the same length. Put another way, the sheet material should be within a length range based on a preselected length.

Changes in battery voltage over the life cycle of the battery may adversely affect the consistency of the length of sheet material 111 discharged. This problem occurs because, as the power source output decreases, the motor 267 powering drive roller 139 runs more slowly (i.e., at decreased revolutions per minute). As battery voltage decreases over the life cycle of the batteries, the motor 267 is required to run for a longer time duration in order to dispense a consistent length of sheet material 111. By way of further example, battery voltage under load could increase if the dispenser 10 is moved from a location that is relatively cold to a location which is relatively warm. Such voltage increase may cause inconsistent lengths of sheet material 111 to be discharged from dispenser 10.

Because of the complex relationship between voltage and the various parameters which affect voltage, the inventors found that measurements of battery voltage under both unloaded and loaded conditions can yield reliable assessments of battery state. As set forth in the control sequence depicted in FIGS. 20A–20G, the dispenser 10 monitors battery state in both unloaded and loaded conditions to provide improved controlled operation of the dispenser 10 as battery voltage changes over the life cycle of the batteries. Among other things, the control sequence depicted in FIGS. 20A–20G compensates for decreasing battery voltage by generally increasing the time duration of motor 267 operation to enable the dispenser 10 to discharge a consistent length of sheet material 111 over many successive dispense cycles. The control sequence generally decreases the time duration of motor 267 operation when the voltage under load increases.

In the preferred embodiment, the change in the time duration of motor 267 operation occurs in the next dispense cycle; the motor run time for the then-occurring dispense cycle is predetermined and is not changed as described below. The then-occurring dispense cycle refers to the dispense cycle then taking place responsive to a user dispense request initiated by actuation of a user input device. In this example the input device is proximity detector 49. The preceding dispense cycle refers to the dispense cycle immediately before the then-occurring dispense cycle while the next dispense cycle refers to the next sequential dispense cycle after completion of the then-occurring dispense cycle.

Figure 20A:
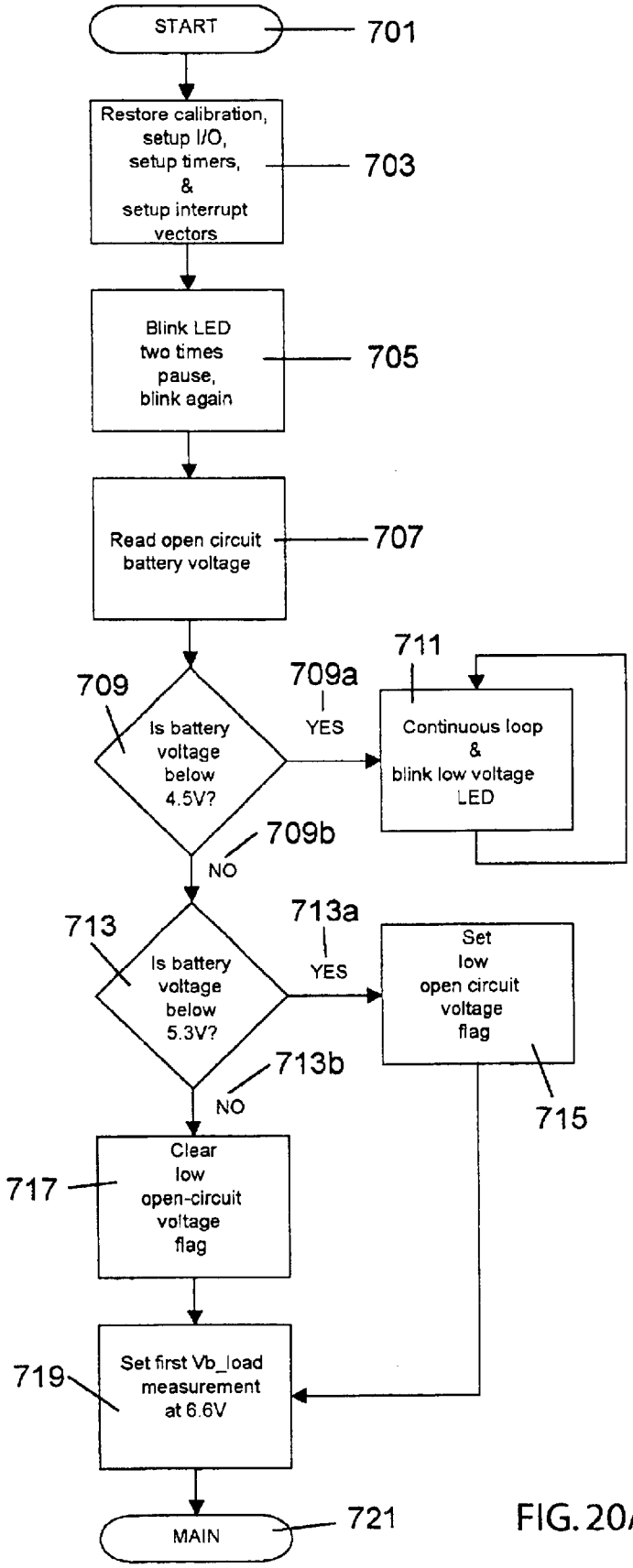
FIGS. 20A–20G are block diagrams showing the steps of a preferred alternative method of dispensing according to the invention.

Referring then to FIG. 20A, upon power-up, the loaded dispenser 10 enters the "start" state 701. The control sequence automatically restores calibration, initializes input/output and initializes timers and interrupt vectors, all of these steps are combined in FIG. 20A as step 703. Upon completion of step 703, the instructions of step 705 blink LED2 (see FIG. 17D) to indicate that step 703 is complete and further to indicate what version of the firmware code is present in micro-controller 511. (As shown in FIG. 20A, the blinking pattern of blink-blink-pause-blink indicates such a firmware version.) Before reaching the "main" state 721, control apparatus 50 now sequences through a series of steps (steps 709–719) in order to determine the condition of the batteries at the time of power-up and before motor 267 operation. Using the analog-to-digital conversion (A/D) feature of micro-controller 511, control apparatus 50 obtains the "open-circuit" (i.e., unloaded circuit voltage) battery voltage in step 707. In step 709, control apparatus 50 determines if the open-circuit battery voltage is below a preset voltage threshold V1 (in FIG. 20A, V1 is 4.5V). (Note that throughout the block diagrams of FIGS. 20A–20G, elements of the diagram shown as diamonds indicate that a determination is being made with two possible outcomes—"YES" or "NO". In each such case, the "YES" determination is labeled as XXXa and the "NO" determination is labeled as XXXb, where XXX is the number referring to the specific determining step in question.)

If the open-circuit voltage is below V1 (determination 709*a*) in step 709, control apparatus 50 enters continuous loop 711. The instructions of continuous loop 711 blink LED2 to indicate that the battery is in a low-voltage state and trap the dispenser in this loop, thereby preventing further operation of dispenser 10.

A "NO" determination 709*b* at step 709 enables determination step 713 to occur. In step 713, control apparatus 50 determines if the open-circuit battery voltage is below a preset voltage threshold V2 (in FIG. 20A, V2 is 5.3V). If the open-circuit voltage is below V2 (determination 713*a*) in step 713, control apparatus 50 sets a "low open-circuit voltage" flag (logical variable within micro-controller 511)

in step 715 to indicate that the battery is in a partially-discharged condition. If the open-circuit voltage is not below V2 (determination 713*b*) in step 713, control apparatus 50 clears the "low open-circuit voltage" flag in step 717.

In step 719 the control apparatus 50 sets the initial value of voltage $V_{b_load}$ to a preset initial value. Step 719 only occurs during the power up sequence. The initial value of $V_{b_load}$ is 6.6V, a level selected to be above the battery voltage of fresh batteries. With these power-up steps complete, control apparatus 50 enters its "main" state 721, which represents the point in the logic sequence of FIGS. 20A–20G through which the control loop passes each dispense cycle of the loop during dispenser operation.

Figure 20B:
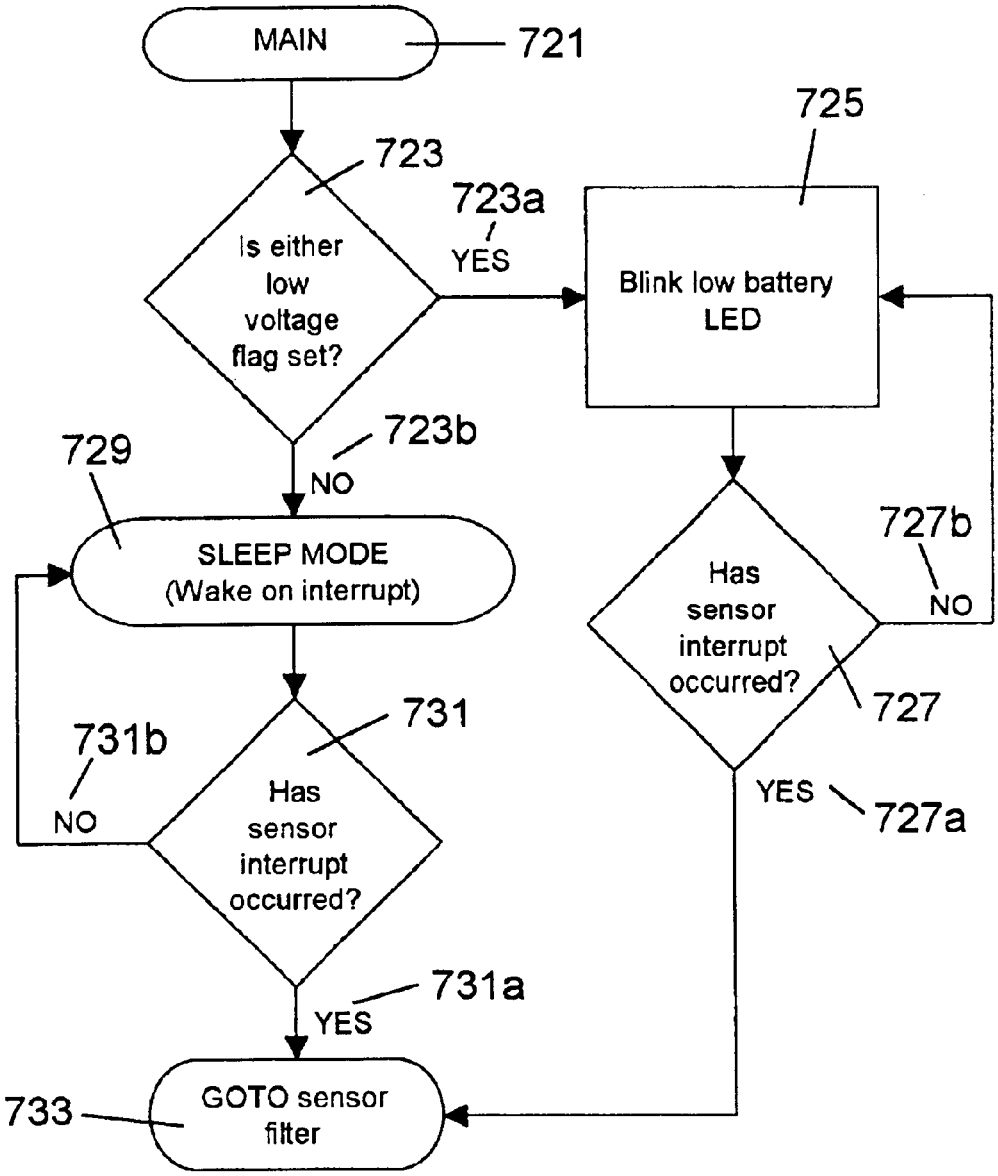

"Main" state 721 is shown at the bottom of FIG. 20A and at the top of FIG. 20B. Referring to FIG. 20B, following the entry of control apparatus 50 into "main" state 721, step 723 determines if either of the two low battery voltage flags is set. The two low battery voltage flags are the "low open-circuit voltage" flag of step 715 and the "low $V_{b_load}$" flag ($V_{b_load}$ is battery voltage under load) discussed in step 797 below. The two flags are either "set" or "cleared" as described above in the context of the low open-circuit voltage flag. The low $V_{b_load}$ flag is "cleared" during step 703 of the power-up sequence just described. If either low battery voltage flag is in the "set" state at step 723 (determination 723*a*), control apparatus 50 enters a loop which instructs LED2 to blink at step 725, indicating a low-battery condition within the dispenser 10. Step 727, a determination as to whether or not a sensor interrupt (from proximity detector 49) has occurred, is also part of this loop. As long as a sensor interrupt is not received from proximity detector 49 (determination 727*b*), LED2 continues to blink and the dispenser continues to monitor proximity detector 49 at step 727.

If neither low-battery-voltage flag is in the "set" state at step 723 (determination 723*b*), control apparatus 50 enters a different loop represented by steps 729 and 731 in FIG. 20B. Subsequent to determination 723*b*, control apparatus 50 enters sleep mode (or state) 729, which in the case of this embodiment, is provided as a built-in feature of micro-controller 511. In sleep mode, micro-controller 511 lowers its power consumption and waits until an interrupt signal is received, at which point micro-controller 511 is said to "wake", returning to normal operation at the point in the sequence at which it entered "sleep" mode. Upon micro-controller 511 being "wakened", step 731 determines if the received interrupt is a sensor interrupt (signal from proximity sensor 49). If it is not, determination 731*b* returns micro-controller 511 to sleep mode 729.

If the result of either determination step 727 or determination step 731 is "YES" (determination 727*a* or determination 731*a*), the dispenser control sequence proceeds to a sensor filter at step 733. A sensor interrupt occurs when a person approaches the dispenser and a change in capacitance is detected by the frequency discriminator 509, causing proximity detector 49 form of input device to produce the sensor interrupt signal. The detected change in capacitance represents the user's request that the dispenser discharge a length of sheet material 111. The presence of the sensor interrupt event indicates that the then-occurring dispense cycle has been commenced by the user dispense request.

In response to the sensor interrupt event as determined by step 727 or step 731, dispenser 10 next determines whether the detection event was true or false by filtering out false detection events based on the duration of the sensor interrupt signal. Sensor filter entry step 733 is shown at the bottom of FIG. 20B and at the top of FIG. 20C. At determination step 735, dispenser 10 determines whether the detection responsible for the sensor interrupt event is valid by determining whether the event has a duration which exceeds a preset time duration threshold, which in this example is 30 milliseconds. Detection for less than the duration threshold (determination 735*b*) is interpreted to mean that the signal was false, and control apparatus 50 is returned to the "main" state 721. Detection in excess of the threshold (determination 735*a*) indicates that the detection event is true.

The alternative embodiment of instructions for use in controlling the operation of dispenser 10 is not limited to use in a "hands-free" dispenser utilizing an input device in the form of proximity detector 49. For example, proximity detector 49 could be replaced with an input device in the form of a push button contact switch (not shown) located at a convenient location along, for example, front cover 17 of dispenser housing 11. Manual contact between the user and the push button contact switch would close the switch and generate the sensor interrupt event as determined by step 727 or step 731. In such an embodiment, step 735 would act as a debounce step responsive to closure of the push button contact switch by the user. Generation of the sensor interrupt event with the push button contact switch would initiate the then-occurring dispense cycle.

Figure 20C:
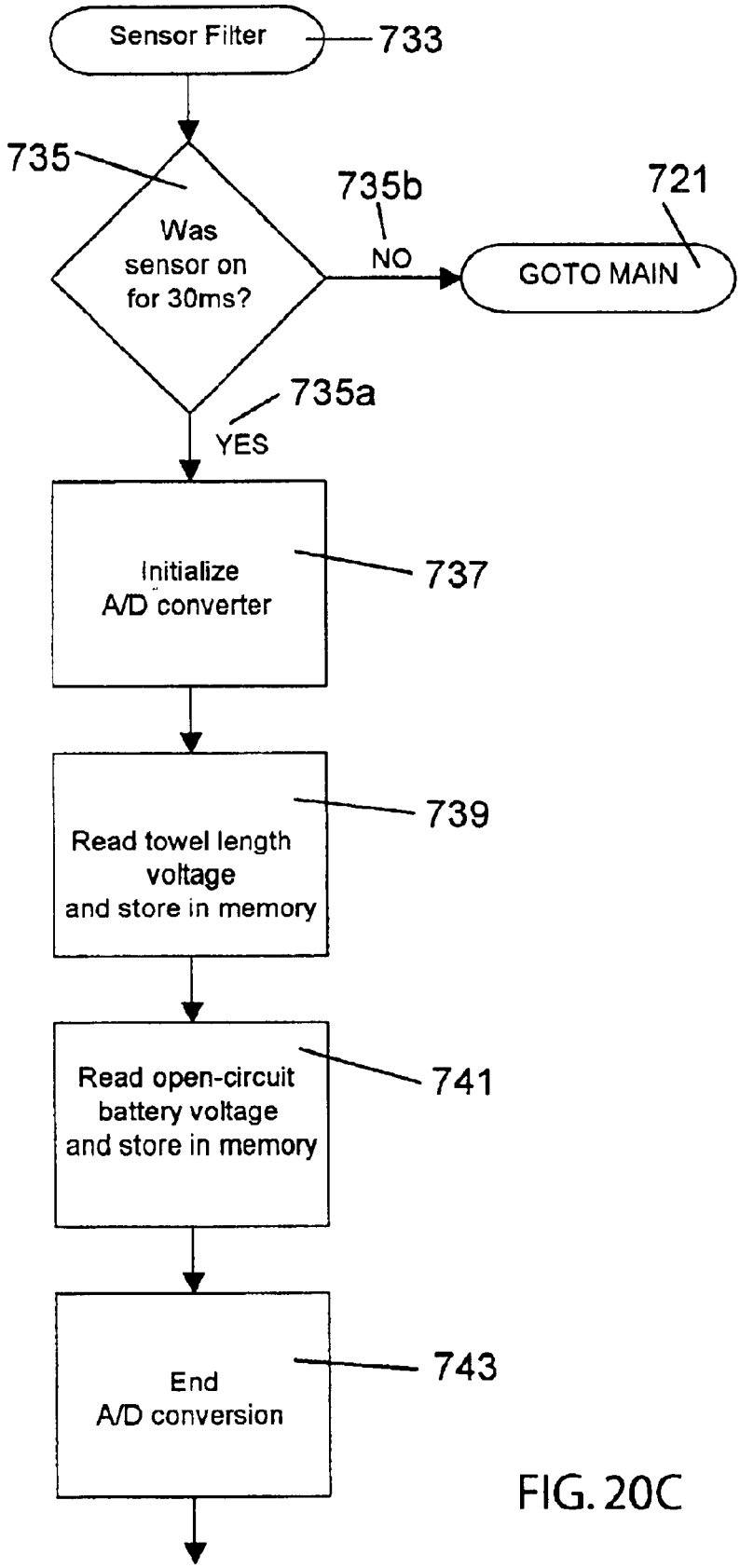

After a "YES" determination following step 735 (a "true" sensor interrupt event), the control sequence of control apparatus 50 proceeds with a cascade of further steps. In step 737, the A/D converter is initialized. Using the A/D converter of micro-controller 511, the sheet material length to be dispensed (represented by an analog voltage at pin 7 of micro-controller 511— see FIG. 17D) and the open-circuit battery voltage are read and stored in memory (steps 739 and 741 respectively). Step 743 ends A/D conversion. Step 743 is shown at the bottom of FIG. 20C and the top of FIG. 20D.

Figure 20D:
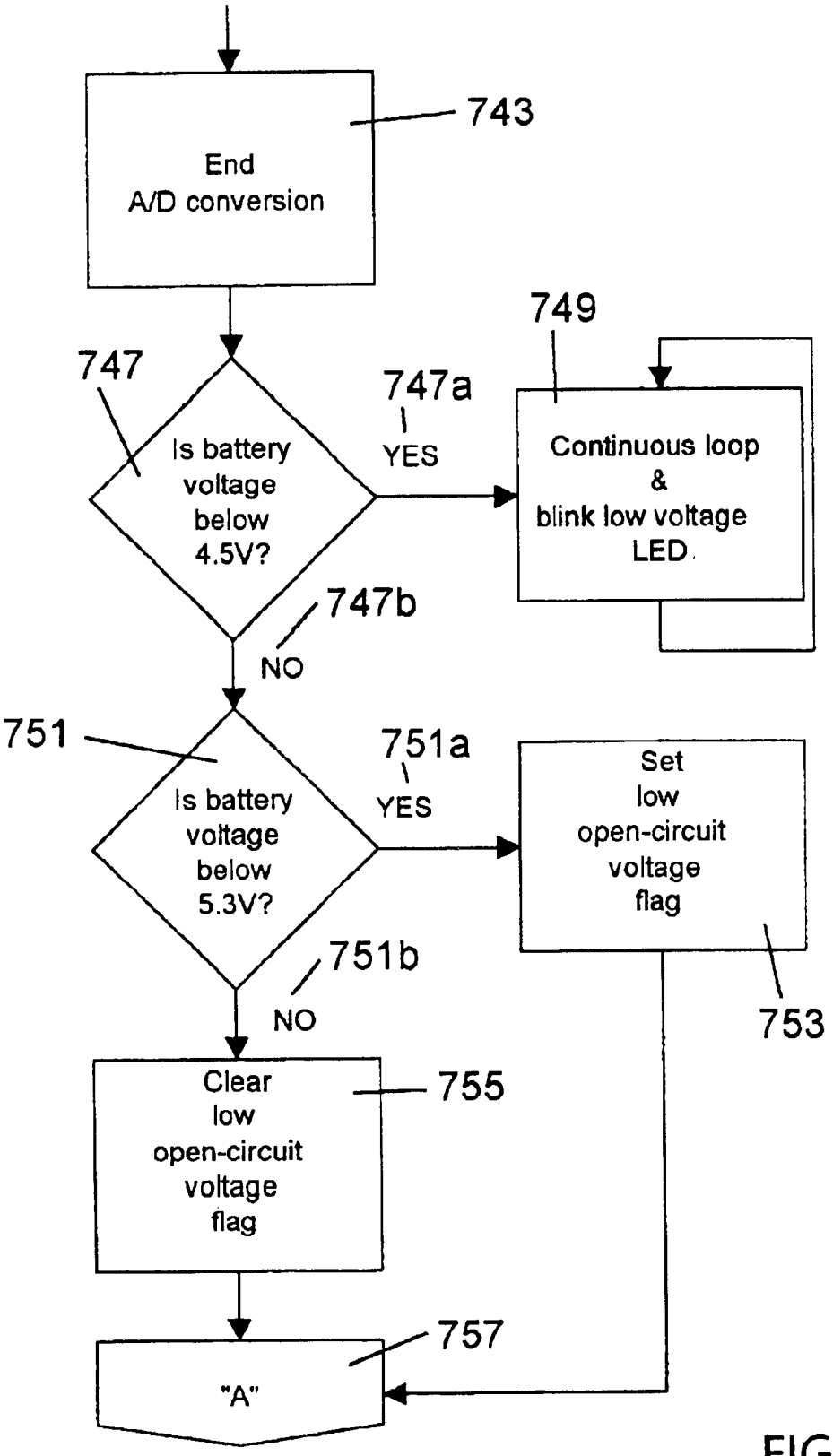

Referring now to FIG. 20D, using the open-circuit voltage measurement captured in step 741, control apparatus 50 compares this measurement with preset voltage threshold V1, in this example 4.5V (step 747). If it is determined that the open-circuit battery voltage is below V1 (determination 747*a*), control apparatus 50 enters continuous loop 749. The instructions of continuous loop 749 blink LED2 to indicate that the battery is in a low-voltage state and trap the dispenser in this state, thereby preventing further operation of the dispenser. A further comparison (determination 747*b*) is performed in step 751, comparing the open-circuit battery voltage with preset voltage threshold V2, in this example 5.3V. In step 751, if the open-circuit voltage is below V2 (determination 751*a*), control apparatus 50 sets the "low open-circuit voltage" flag in step 753 to indicate that the battery is in a partially-discharged condition. If the open-circuit voltage is not below V2 (determination 751*b*), control apparatus 50 clears the low open-circuit voltage flag in step 755. Following step 753 or step 755, the control sequence of the dispenser proceeds to set the length of towel to be dispensed. The block diagram element 757 labeled "A" in FIGS. 20D and 20E simply represents a convenient way-point in the description of the control sequence.

Figure 19D:
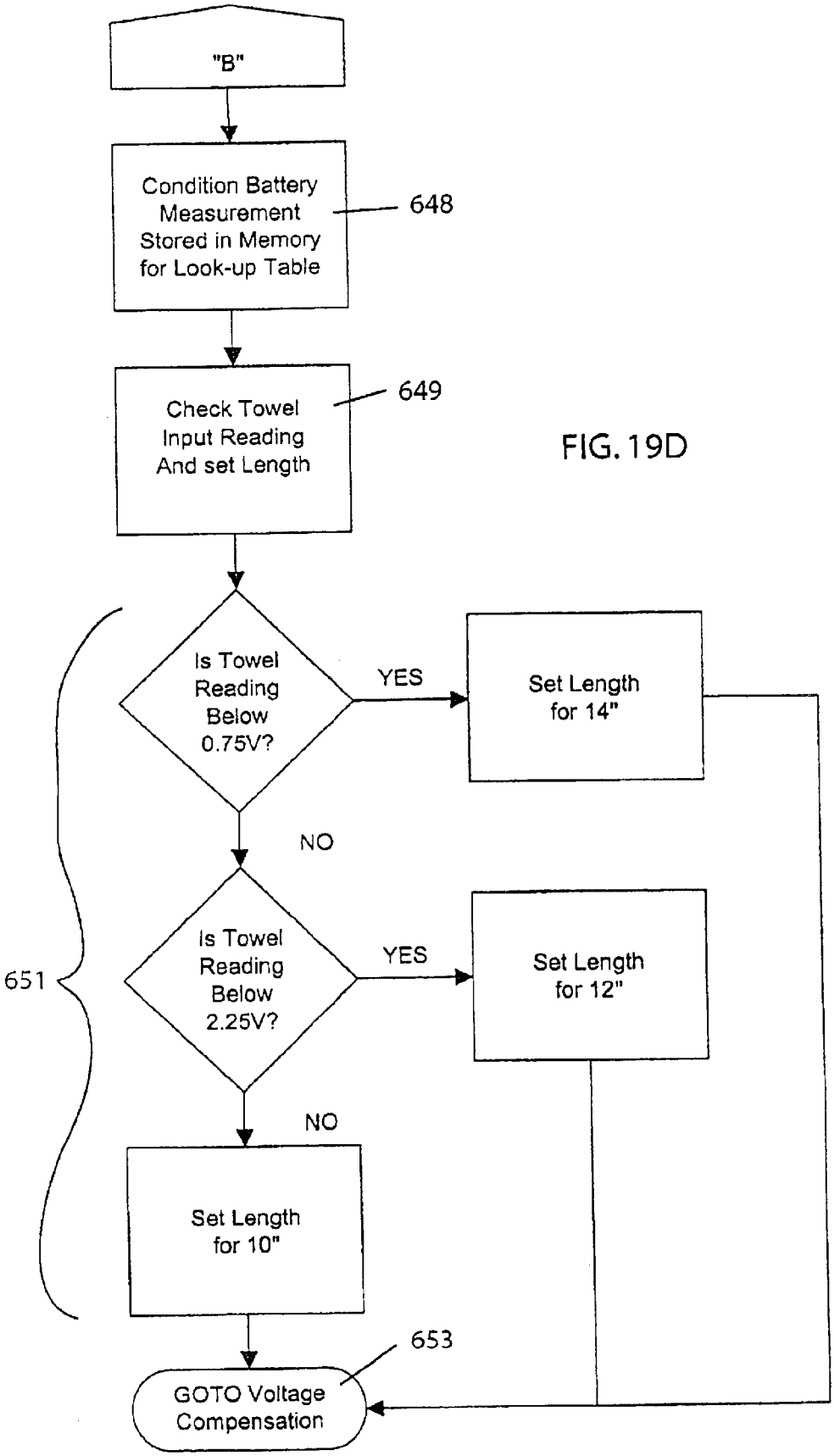
Figure 19E:
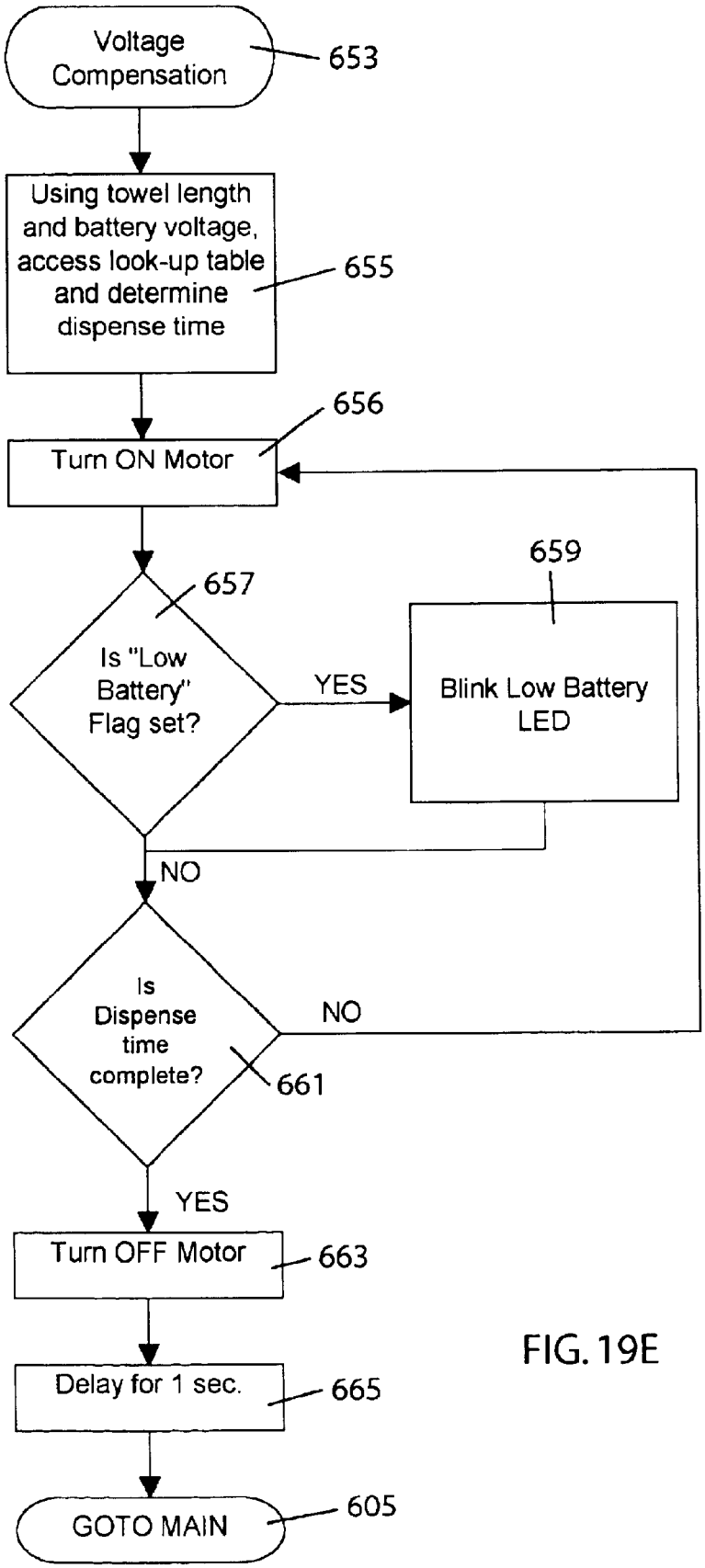
Figure 20E:
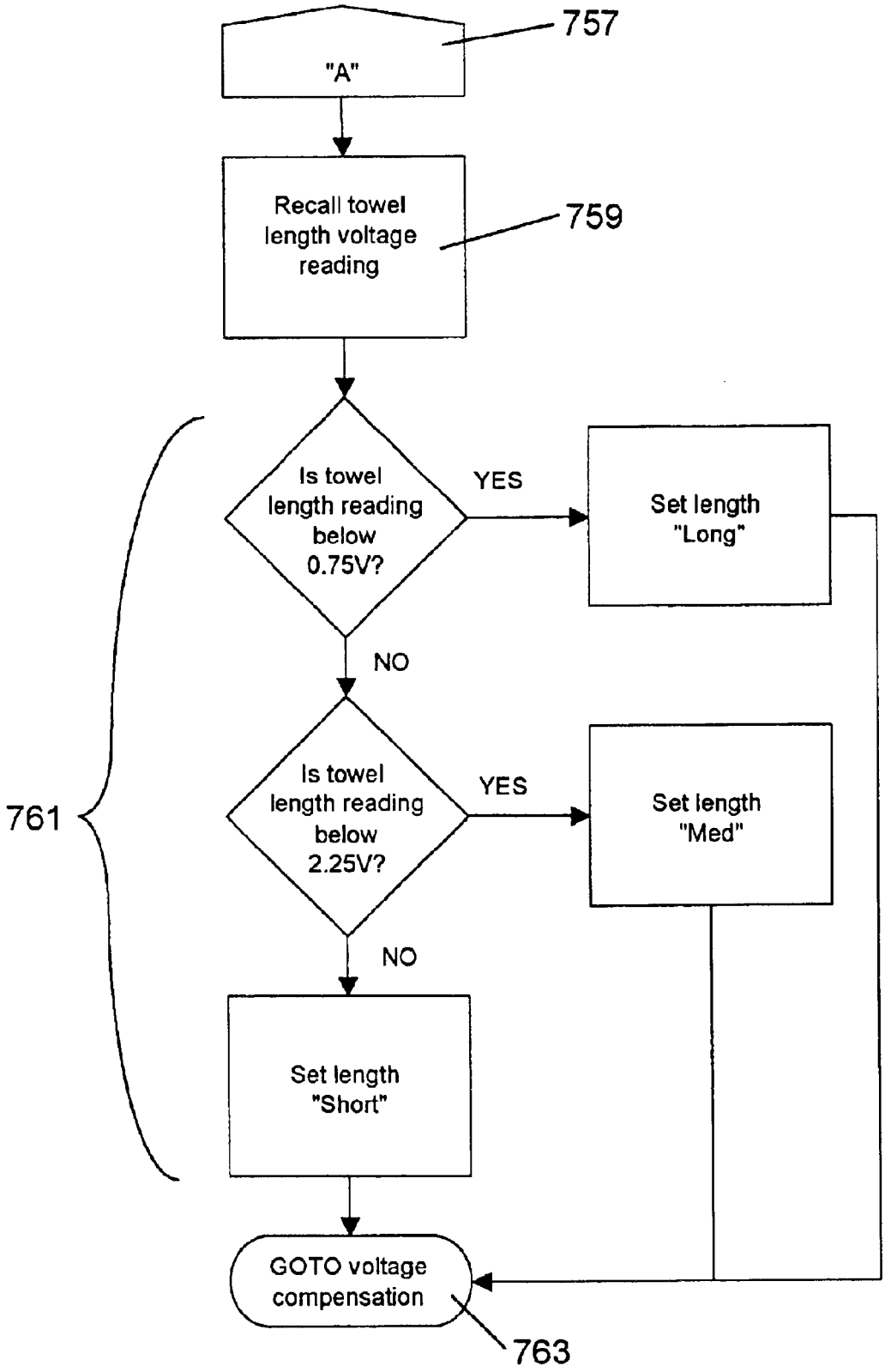

Referring to FIG. 20E, the control sequence continues in step 759 by recalling the towel length voltage previously stored in step 739 and then in the group of steps labeled 761 and in a fashion similar to steps 651 in FIG. 19D, determines the selected towel length ("short", medium", or "long") from the stored towel length voltage (stored after an A/D conversion in step 739) by comparing this voltage with preset voltage thresholds (in FIG. 20E, 0.75V and 2.25V).

Figure 20F:
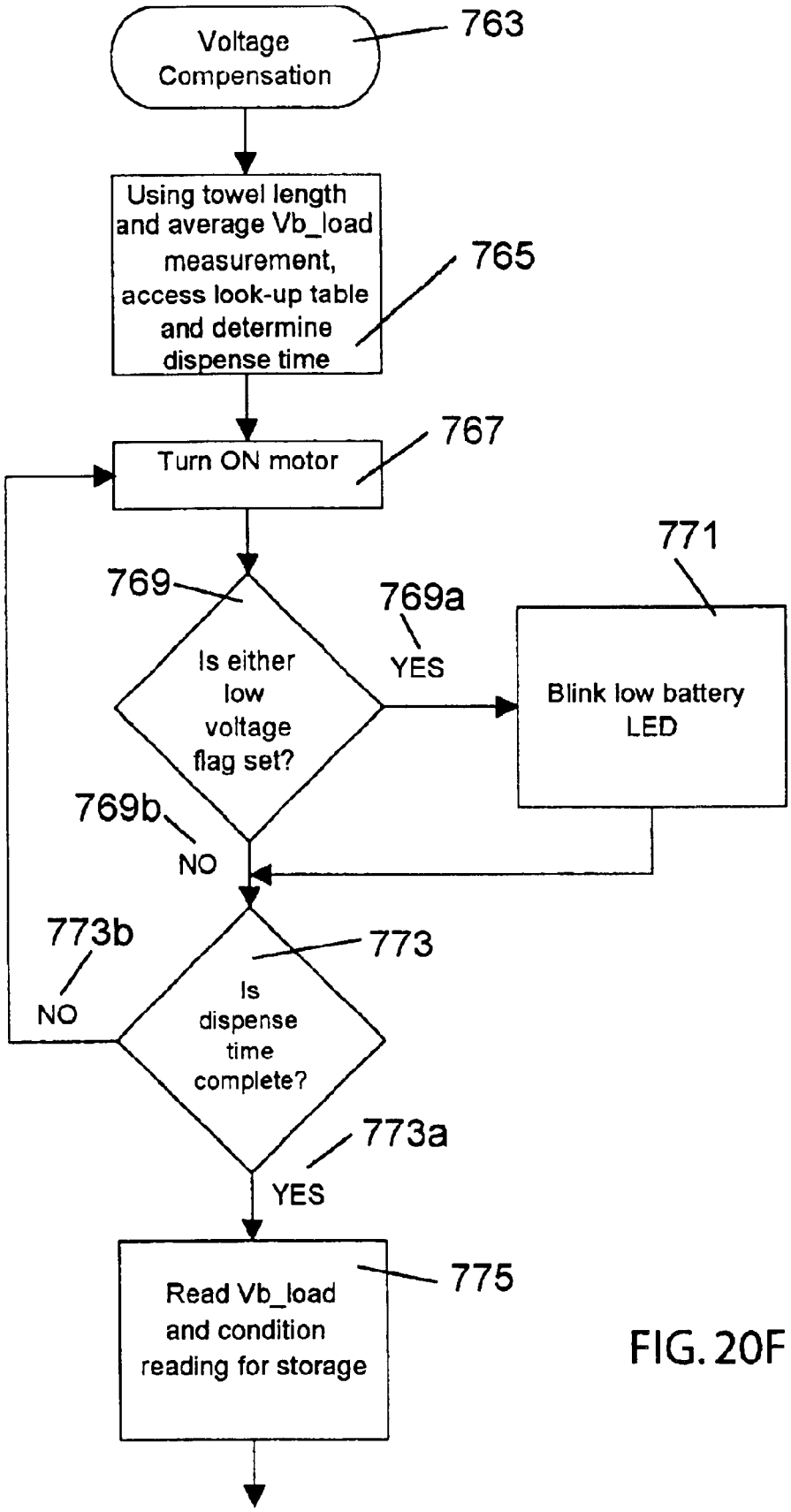

After the towel length determination is complete, the control sequence proceeds with voltage compensation, the start of which is represented by step 763 shown at the bottom of FIG. 20E and the top of FIG. 20F. The voltage compensation step 763 results in operation of the motor 267 such that the dispenser 10 discharges a consistent length of sheet material 111 in successive dispensing cycles even as battery voltage fluctuates over the life cycle of the batteries.

Referring then to FIG. 20F, the control sequence next determines (in step 765) the dispense time for the then-occurring dispense cycle. The control sequence utilizes a look-up table, preferably prestored in micro-controller 511. The use of look-up tables is common practice for those skilled in the use of micro-controller-based systems. The look-up table contains a series of motor run time values corresponding to the various towel lengths (in this example, "short", medium", or "long") and to intervals of average $V_{b_load}$ values along the full range of expected values for $V_{b_load}$. By way of example only, the motor run time values for a "long" length of sheet material 111 (e.g., ideally about 14 inches long) may range from a minimum of 0.671 seconds to a maximum of 1.643 seconds, the motor run time values for a "medium" length of sheet material 111 (e.g., ideally about 12 inches long) may range from a minimum of 0.576 seconds to a maximum of 1.409 seconds while the motor run time values for a "short" length of sheet material 111 (e.g., ideally about 10 inches long) may range from a minimum of 0.479 seconds to a maximum of 1.174 seconds.

Each motor run time value corresponds to an interval of average $V_{b_load}$ value for each of the three choices of sheet material 111 lengths. The average $V_{b_load}$ is a stored value (stored in micro-controller 511 memory) calculated near the end of the preceding dispense cycle as described in connection with step 775 below. Operation of the motor 267 for the motor run time corresponding to the interval in which the stored average $V_{b_load}$ falls, results in discharge of the desired length of sheet material from the dispenser 10. In general, the motor run time is of a shorter duration when the batteries are at the beginning of their life cycle and the average $V_{b_load}$ is greater and is of a longer duration near the end of the battery life cycle and the average $V_{b_load}$ is decreased. Under normal operating conditions, there is little change in the motor run time in sequential dispense cycles as alkaline batteries typically operate for in excess of 50,000 dispense cycles.

In step 765, the control apparatus accesses the look-up table and the stored average $V_{b_load}$. A motor run time is then determined for the then-occurring dispense cycle. In this example, the motor run time is based on the stored average $V_{b_load}$ from the preceding dispense cycle. Voltage measurements determined during the then-occurring dispense cycle do not affect the motor run time of the then-occurring dispense cycle.

Referring next to steps 767 through 773, such steps cooperate to run motor 267 for the motor run time in the then-occurring dispense cycle as determined in step 765 and to blink LED2 if either of the low voltage flags is set. In a dispense-time loop (steps 767–773), step 767 turns motor 267 on, step 769 determines if either low flag is set, step 771 blinks LED2 if either flag is set (determination 769*a*), and, after determination 769*b*, step 773 determines if the dispense time is complete. If the dispense is not complete (determination 773*b*), the loop continues by branching back to step 767. If the dispense time is complete (determination 773*a*), the control sequence exits the dispense-time loop, moving to step 775 at which a measurement of $V_{b_load}$ (i.e., power source output under load) is taken as discussed below in connection with FIG. 20F.

Figure 22:
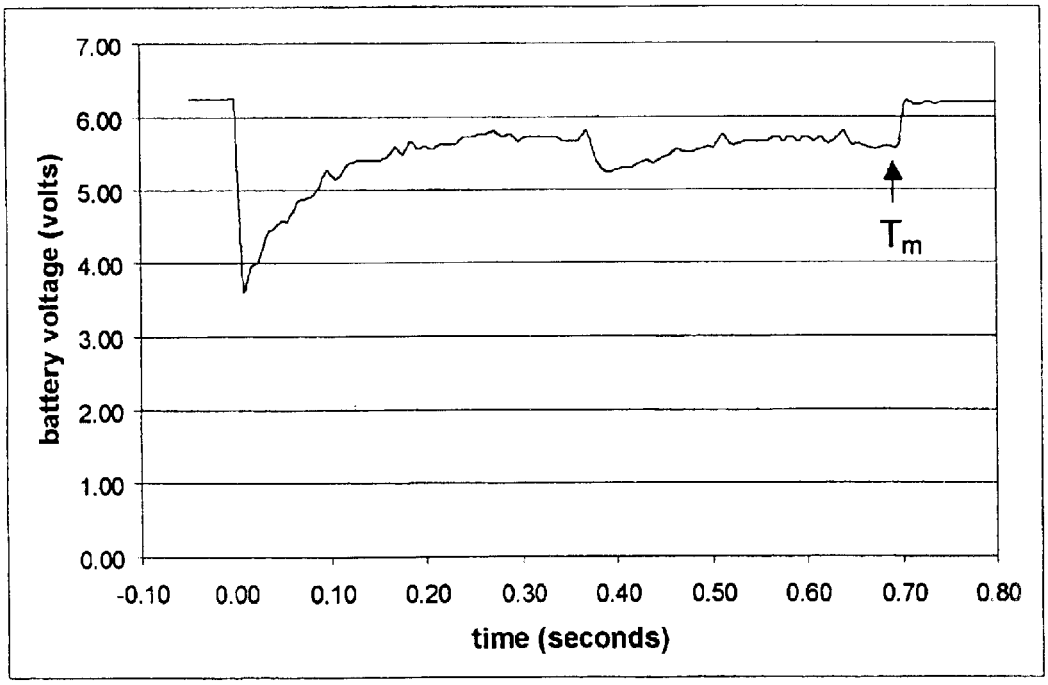
FIG. 22 is an exemplary battery power source output voltage trace during a dispense cycle.

FIG. 22 is provided to graphically illustrate the preferred point in the then-occurring dispense cycle at which the $V_{b_load}$ measurement is obtained in step 775. Referring to the exemplary battery power source output voltage trace of FIG. 22, dispense time (determined in step 765) within a dispense cycle spans the time between 0.00 seconds and about 0.70 seconds on the time axis of the graph. At the point marked $T_m$ at the end of this trace is the time at which the power source output measurement of step 775 is taken, just prior to turning motor 267 off in step 801. Note that although there are numerous steps in the control sequence between steps 773 and 801, the length of time required for an instruction to be completed within a typical micro-controller is extremely short (typically a few micro-seconds or less) compared to the overall dispense time. By obtaining the power source output measurement of $V_{b_load}$ at the end of the dispense time, "corrupting" the measurement of $V_{b_load}$ with the drop in battery voltage caused by the acceleration of the roll of towel (seen at the beginning of the trace in FIG. 22) is avoided. The measurement of $V_{b_load}$ is stored in memory of micro-controller 511.

Figure 20G:
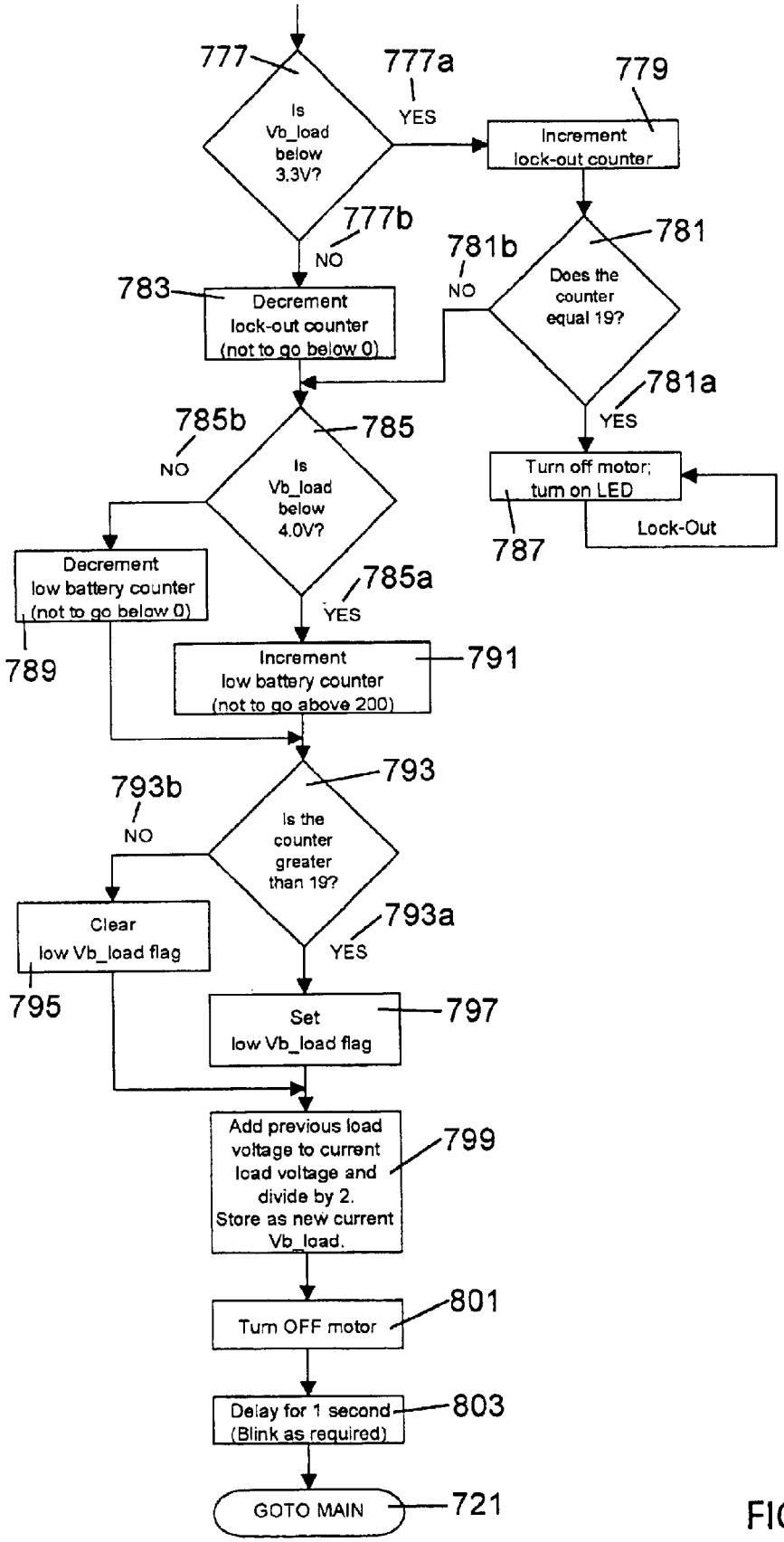

Referring now to FIG. 20G, the control sequence next determines the battery voltage to estimate remaining battery life so that the operator can be alerted if the batteries are near the end of their life cycle. The control sequence continues with step 777 which is a comparison of this measurement of $V_{b_load}$ with a preset voltage threshold V3 (in FIG. 20G, V3 is 3.3V). If $V_{b_load}$ is not below V3 (determination 777*b*) in step 783, control apparatus 50 decrements a lock-out counter (internal variable within micro-controller 511) by one count in step 783, and the control sequence continues to step 785. If $V_{b_load}$ is below V3 (determination 777*a*), control apparatus 50 increments the lock-out counter by one count (step 779) and in step 781 checks to see if the count in the lock-out counter is equal to a preset value (in FIG. 20G, this preset value is 19). If this count is equal to the preset value (determination 781*a*), the dispenser is locked out from further operation in step 787. If the count is not equal to the preset value (determination 781*b*), the control sequence continues on to step 785, during which $V_{b_load}$ is compared with yet another preset voltage threshold V4 (in FIG. 20G, V4 is 4.0V). If $V_{b_load}$ is below V4 (determination 785*a*), a low-battery counter is incremented by one count (step 791), and if $V_{b_load}$ is not below V4 (determination 785*b*), the low-battery counter is decremented by one count (step 789). Step 793 is a comparison of the low-battery counter to yet another preset value (in FIG. 20G, this preset value is also 19 although it is not required that these two counter preset values be equal). The comparison of step 793 is used to set or clear the low $V_{b_load}$ flag, with a "YES" (determination 793*a*) causing the low $V_{b_load}$ flag to be set and a "NO" (determination 793*b*) causing the low $V_{b_load}$ flag to be cleared.

The use of the lock-out and the low-battery counters enables reliable assessment of battery condition by assuring that (1) lock-out occurs only if the value of $V_{b_load}$ is persistently below preset threshold V3 and that (2) low battery indication is made (blinking LED2) only when $V_{b_load}$ is persistently below preset threshold V4. In other words, dispenser 10 is shut down only when it is determined that $V_{b_load}$ is repeatedly below a preset very low threshold V3, and the low-battery indication is made only when it is determined that the battery is getting near to the end of its life cycle, that is when $V_{b_load}$ is repeatedly and consistently below preset threshold V4 which is not as low as V3. In this way, anomalous $V_{b_load}$ measurements which may occur due to some outside interference with dispenser operation will not be misinterpreted as an indication of battery condition.

Following the setting or clearing of the low $V_{b_load}$ flag in steps 795–797, the measured value of $V_{b_load}$ is averaged in step 799 with its previous (stored) value, and this average value (i.e., the average $V_{b_load}$) is stored in place of the previously-determined average $V_{b_load}$ value. The average $V_{b_load}$ determined in the then-occurring dispense cycle is the new stored value for the next iteration through the control loop triggered by the next valid user request for a length of sheet material 111. Put another way, the stored average $V_{b_load}$ is used to determine the motor run time in step 765 of the next dispense cycle; such stored average $V_{b_load}$ does not affect the then-occurring dispense cycle.

Referring again to FIG. 22, the averaging which takes place in step 799 serves to smooth out the determination of dispense times, decreasing the sensitivity of value of the dispense time to the noise which typically is present in the battery voltage signal due to motor operation. The uneven trace of FIG. 22 illustrates the variations which can occur in the battery voltage of a dispenser.

In this example, for the first dispense cycle after a power-up sequence, the stored value of average $V_{b_load}$ is the initial value of voltage $V_{b_load}$ which is the preset value to which $V_{b_load}$ is set in step 719. (In FIG. 20A, the initial value of $V_{b_load}$ is 6.6V.) As a result of the average $V_{b_load}$ determination in step 799, the average $V_{b_load}$ approaches the actual $V_{b_load}$ within about 5 or 6 dispense cycles resulting in dispense cycles of sufficient time duration to dispense the desired length of sheet material.

Figure 23:
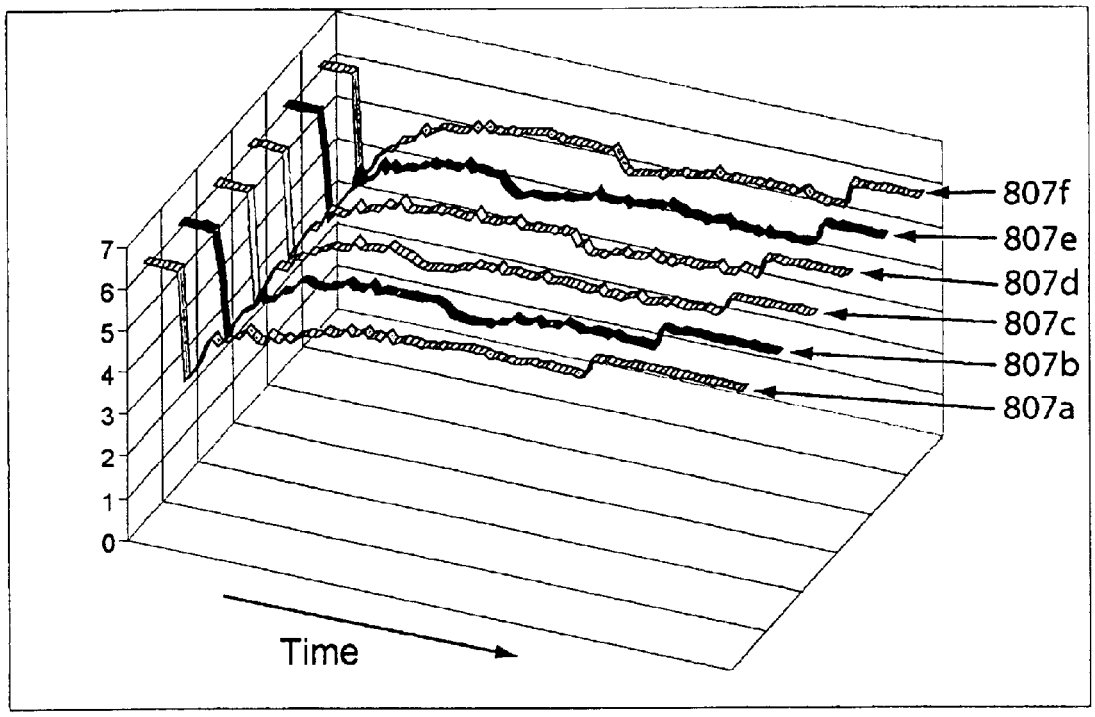
FIG. 23 is an exemplary set of six sequential battery power source output voltage traces.

FIG. 23 illustrates the effect of the averaging determination of step 799 for six sequential dispense cycles following power up. FIG. 23 is a graph showing the voltage traces of six sequential representative dispense cycles 807*a* through 807*f*. As with FIG. 22, the voltage traces shown in FIG. 23 each correspond to battery voltage during motor 267 operation during a dispense cycle. Dispense cycle 807*a* is the first dispense cycle following power up with fresh batteries. The motor run time of dispense cycle 807*a* is of a shorter time duration than the time duration of dispense cycles 807*b* through 807*f*. The shorter time duration of dispense cycle 807*a* is the result of $V_{b_load}$ being preset, in this example, to 6.6V. In the averaging step 799 of dispense cycles 807*a* through 807*f*, the average $V_{b_load}$ is decreased from the preset 6.6V to the actual $V_{b_load}$ (about 6V for fresh alkaline batteries) resulting in a longer motor run time determination in step 765 and longer time duration dispense cycles 807*b* through 807*f*. Dispense cycles 807*e* and 807*f* have near identical time durations indicating that the average $V_{b_load}$ determination in step 799 is approaching the actual $V_{b_load}$.

Since the dispense time has passed, motor 267 is turned off in step 801. The final step of the dispense cycle is step 803 which is a delay for a preset period of time (in FIG. 20G, this preset time is one second). Also during step 803, if the low battery flags require that the LED2 is blinking, such blinking is carried out. After the completion of the preset period of delay, the control sequence within control apparatus 50 returns to the "main" state 721 to begin its sequence of operation once again.

Figure 17E:
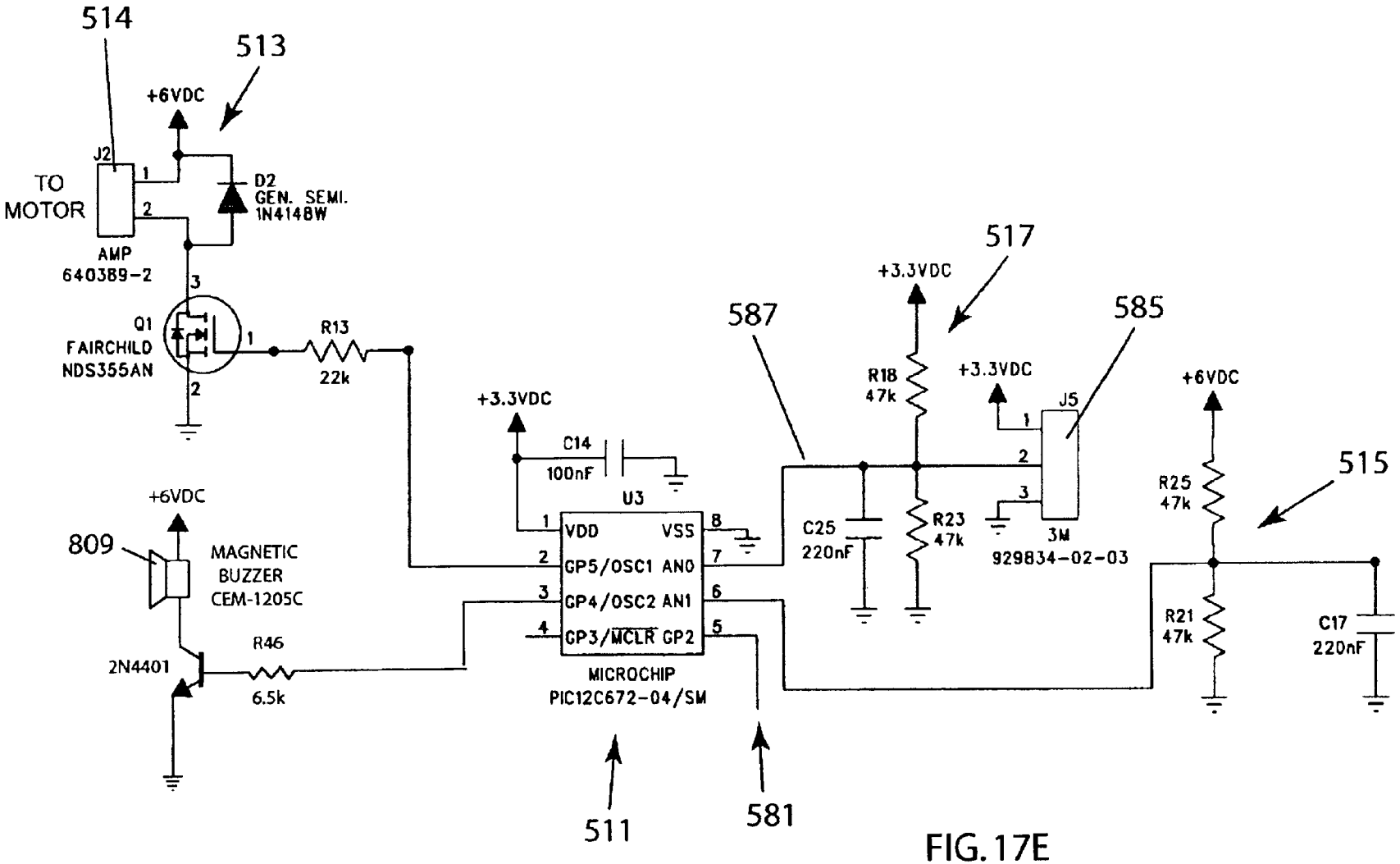
FIG. 17E is a schematic diagrams showing a sound emitter incorporated into the control apparatus in accordance with the present invention.

Low battery LED indicator lights, such as visible indicator LED2 (FIG. 17E), are extremely common in battery-powered devices. One disadvantage of such LED indicators is that, in common practice, the energized state of the LED is not always synonymous with a low battery condition and could be misinterpreted to mean that the dispenser 10 is powered and ready for operation, rather than to signify that the batteries are near the end of their life cycle. As shown in the schematic of FIG. 17E, LED2 may be replaced with an audible sound emitter as a low battery indicator. One such audible sound emitter is a magnetic buzzer 809 available from CUI, Inc., Beaverton, Oreg. as part number CEM-1205C. Generation of an audible sound is more likely to be associated with a low battery state and a need to service the dispenser than an indicator light because such sounds are typically associated with a device that requires some sort of service.

The dispenser apparatus of the invention may be made of any suitable material or combination of materials as stated above. Selection of the materials will be made based on many factors including, for example, specific purchaser requirements, price, aesthetics, the intended use of the dispenser and the environment in which the dispenser will be used.

While the principles of this invention have been described in connection with specific embodiments, it should be understood clearly that these descriptions are made only by way of example and are not intended to limit the scope of the invention.

We claim:

1. An electronic sheet material dispenser comprising:

a housing defining a space enclosing at least one sheet material roll;

an input device structured to obtain a user request;

a dispensing mechanism including a drive roller and a motor in power-transmission relationship with the drive roller;

a power source powering the motor and having a power source output; and control apparatus controlling operation of the dispenser, said control apparatus being structured to:

power the motor for a predetermined time in response to the user request;

obtain a power source output value during at least a portion of the predetermined time;

de-power the motor upon completion of the predetermined time; and determine a time duration for powering the motor in the next dispense cycle based at least in part on the power source output value.

2. The dispenser of claim 1 wherein the input device comprises a proximity sensor structured to detect a user's presence adjacent the housing.

3. The dispenser of claim 2 wherein the proximity sensor comprises a capacitive sensor having a capacitance which is changed by the user's presence within a detection zone projecting outwardly from the dispenser.

4. The dispenser of claim 3 wherein the dispenser further includes a signal detection circuit operatively connected to the capacitive sensor for detecting the capacitance change.

5. The dispenser of claim 4 wherein the signal detection circuit includes:

an oscillator having a frequency which is affected by the sensor capacitance; and a differential frequency discriminator which detects changes in the oscillator frequency, said detection being obtained by the control apparatus to control dispenser operation.

6. The dispenser of claim 5 wherein the differential frequency discriminator includes:

a signal conditioning circuit configured to produce: (1) a first series of pulses, each pulse being of fixed duration and the series of pulses having a frequency corresponding to the oscillator frequency; and (2) a second series of pulses, such second series being the complement of the first series;

a first averaging circuit outputting a first average, such first average being the average of the first series of pulses;

a second averaging circuit outputting a second average, such second average being the average of the second series of pulses; and a first comparator which compares the first average and the second average and produces an output which is a discriminator difference multiplied by a gain factor of the first comparator, such discriminator difference being the difference between the second average and the first average, and such output corresponds to the presence of the user within the detection zone.

7. The dispenser of claim 6 wherein the differential frequency discriminator further includes a set point circuit which sets the discriminator difference substantially to zero when the user is not present in the detection zone.

8. The dispenser of claim 7 wherein the signal conditioning circuit includes a monostable multivibrator and the multivibrator is operative to generate the first and second series of pulses.

9. The dispenser of claim 1 wherein the input device is a contact switch structured to respond to contact by the user.

10. The dispenser of claim 1 wherein the power source comprises at least one battery.

11. The dispenser of claim 10 wherein the power source output is a voltage.

12. The dispenser of claim 10 further including an audible sound generator structured to emit a sound in response to a low battery condition.

13. The dispenser of claim 1 wherein the control apparatus includes a processor having a memory including instructions adapted to:

power the motor for the predetermined time in response to the user request;

obtain the power source output value during at least a portion of the predetermined time;

de-power the motor upon completion of the predetermined time; and determine the time duration for powering the motor in the next dispense cycle based at least in part on the power source output value.

14. The dispenser of claim 13 wherein the processor instructions are further adapted to:

store a first value based at least in part on a power source output value during powering of the motor in a preceding dispense cycle;

generate a second value based on an average of the first value and the power source output value during powering of the motor in the then-occurring dispense cycle;

store the second value in place of the first value; and determine the time duration for powering the motor in the next dispense cycle based at least in part on the second value.

15. The dispenser of claim 14 wherein the processor instructions are further adapted to determine, relative to the then-occurring dispense cycle, the time duration for powering the motor in the next dispense cycle such that:

the time duration is increased or not changed if the second value is less than the first value;

the time duration is decreased or not changed if the second value is greater than the first value; and the time duration is not changed if the second value is identical to the first value.

16. The dispenser of claim 13 wherein:

the control apparatus further includes a low battery indicator;

the processor further includes a low battery counter; and the processor instructions are further adapted to:

obtain a power source output value when the motor is de-powered;

determine whether the power source output value is below a threshold when the motor is de-powered; and power the low battery indicator if the power source output value is below the threshold.

17. The dispenser of claim 13 wherein:

the control apparatus further includes a low battery indicator;

the processor further includes a low battery counter; and the processor instructions are further adapted to:

increment a count for each dispense cycle in which the power source output value is below a low battery threshold;

decrement a count for each dispense cycle in which the power source output value is above the low battery threshold; and power the low battery indicator when incremented counts exceed decremented counts by a predetermined number.

18. The dispenser of claim 17 wherein the low battery indicator is an audible sound generator and the generator emits an audible sound when powered.

19. The dispenser of claim 13 wherein the processor further includes a lock-out counter and the processor instructions are further adapted to:

increment a count for each dispense cycle in which the power source output value is below a lock-out threshold;

decrement a count for each dispense cycle in which the power source output value is above the lock-out threshold; and lock out further powering of the motor when incremented counts exceed decremented counts by a predetermined number.

20. A sheet material dispenser for dispensing a length of sheet material during a dispense cycle comprising:

a housing defining a space enclosing at least one sheet material roll;

a proximity sensor structured to generate a dispense signal responsive to a user request;

a dispensing mechanism including a drive roller and a motor in power-transmission relationship with the drive roller;

a power source powering the motor and having a power source output; and control apparatus structured to control the length of sheet material dispensed during at least a then-occurring dispense cycle, said control apparatus including a micro-controller having a memory including instructions adapted to:

store a first value corresponding at least in part to a power source output value during powering of the motor in a preceding dispense cycle;

obtain the dispense signal in the then-occurring dispense cycle;

power the motor for a predetermined time in the then-occurring dispense cycle responsive to the dispense signal and based at least in part on the first value;

obtain a power source output value during at least a portion of the predetermined time;

generate a second value based on an average of the first value and the obtained power source output value;

store the second value in place of the first value; and de-power the motor upon completion of the predetermined time.

21. The dispenser of claim 20 wherein the micro-controller instructions are further adapted to determine, relative to the then-occurring dispense cycle, a time duration for powering the motor in a next dispense cycle such that:

the time duration for powering the motor is increased or not changed if the second value is less than the first value;

the time duration for powering the motor is decreased or not changed if the second value is greater than the first value; and the time duration for powering the motor is not changed if the second value is identical to the first value.

22. The dispenser of claim 20 wherein:

the control apparatus further includes a low battery indicator;

the micro-controller further includes a low battery counter; and the instructions are further adapted to:

obtain a power source output value when the motor is de-powered;

determine whether the power source output value is below a threshold when the motor is de-powered; and poweer the low battery indicator if the power source output value is below the threshold.

23. The dispenser of claim 22 wherein:

the control apparatus further includes a low battery indicator;

the micro-controller further includes a low battery counter; and the instructions are further adapted to:

increment a count for each dispense cycle in which the power source output value is below a low battery threshold;

decrement a count for each dispense cycle in which the power source output value is above the low battery threshold; and power the low battery indicator when incremented counts exceed decremented counts by a predetermined number.

24. The dispenser of claim 23 wherein the low battery indicator is an audible sound generator and the generator emits an audible sound when powered.

25. The dispenser of claim 23 wherein the micro-controller further includes a lock-out counter and the instructions are further adapted to:

increment a count for each dispense cycle in which the power source output value is below a lock-out threshold;

decrement a count for each dispense cycle in which the power source output value is above the lock-out threshold; and lock out further powering of the motor when incremented counts exceed decremented counts by a predetermined number.

26. The dispenser of claim 20 wherein the power source comprises at least one battery.

27. A method for dispensing sheet material with a sheet material dispenser comprising:

initiating a dispense cycle in response to a user request;

powering a motor with a power source for a predetermined time duration, said motor structured to power a dispensing mechanism to dispense a length of sheet material from the dispenser;

obtaining a power source output value during at least a portion of the predetermined time duration;

de-powering the motor upon completion of the predetermined time duration; and determining a time duration for a next dispense cycle based at least in part on the power source output value.

28. The method of claim 27 wherein the dispense cycle is a first dispense cycle, the next dispense cycle is a second dispense cycle and the method further comprises:

initiating the second dispense cycle in response to a user request;

powering the motor with the power source for the determined time duration, said motor powering the dispensing mechanism to dispense a second length of sheet material having a length substantially the same as the length of sheet material dispensed in the first dispense cycle;

obtaining a power source output value during at least a portion of the determined time duration of the second dispense cycle;

de-powering the motor upon completion of the determined time duration; and determining a time duration for a next dispense cycle based at least in part on the power source output value obtained during the second dispense cycle.

29. The method of claim 27 wherein the initiating step comprises:

sensing a user's presence with a proximity sensor; and initiating the dispense cycle responsive to sensing the user's presence.

30. The method of claim 29 wherein the sensing step comprises:

detecting a change in proximity sensor capacitance within a sensor detection zone proximate the dispenser;

generating a signal responsive to the change in proximity sensor capacitance;

obtaining the signal with a micro-controller, said micro-controller causing the motor to be powered responsive to the signal.

31. The method of claim 27 wherein the step of obtaining a power source output value comprises measuring a power source voltage.

32. The method of claim 27 further comprising;

storing a first value corresponding at least in part to a power source output value obtained during powering of the motor in a preceding dispenser cycle;

determining a second value based on an average of the first value and the power source output value obtained during powering of the motor in a then-occurring dispense cycle;

storing the second value in place of the first value; and determining a time duration for a next dispense cycle based at least in part on the second value.

33. The method of claim 32 wherein the step of determining the time duration for the next dispense cycle comprises:

increasing or not changing the time duration if the second value is less than the first value;

decreasing or not changing the time duration if the second value is greater than the first value; and not changing the time duration if the second value is identical to the first value.

34. The method of claim 27 further comprising:

obtaining a power source output value when the motor de-powered;

determining whether the power source output value is below a threshold when the motor is de-powered; and powering a low battery indicator if the power source output value is below the threshold when the motor is de-powered.

35. The method of claim 27 further comprising:

incrementing a count for each dispense cycle in which the obtained power source output value is below a low battery threshold;

decrementing a count for each dispense cycle in which the obtained power source output value is above the low battery threshold; and powering a low battery indicator when incremented counts exceed decremented counts by a predetermined number.

36. The method of claim 35 wherein the step of powering a low battery indicator comprises powering an audible sound generator to emit an audible sound.

37. The method of claim 27 further comprising:

incrementing a count for each dispense cycle in which the power source output value is below a lock-out threshold;

decrementing a count for each dispense cycle in which the power source output value is above the lock-out threshold; and locking out further powering of the motor when incremented counts exceed decremented counts by a predetermined number.

* * * * *

UNITED STATES PATENT AND TRADEMARK OFFICE

CERTIFICATE OF CORRECTION

PATENT NO. : 6,903,654 B2
APPLICATION NO. : 10/699457
DATED : June 7, 2005
INVENTOR(S) : Lawrence R. Hansen et al.

It is certified that error appears in the above-identified patent and that said Letters Patent is hereby corrected as shown below:

In column 1, line 7, delete “incorporate” and insert --incorporated--.

In column 4, line 6 after the first occurrence of “to” insert --be--.

In column 8, line 6 after “view” and insert --of--.

In column 8, line 10 after “view” and insert --of--.

In column 8, line 24, delete “diagrams” and insert --diagram--.

In column 12, line 12, delete “25150-1450” and insert --25150-50--.

In column 13, line 46, after “37” insert --,--.

In column 13, line 47, after “side edges” delete “,”.

In column 14, line 37 delete “a”.

In column 21, line 49, after “is” delete --the--.

In column 24, line 62, delete “medium”” and insert --“medium”--.

In column 25, line 15, delete “medium”” and insert --“medium”--.

In column 31, line 31, Claim 22, delete “poweer” and insert --power--.

In column 31, line 33, Claim 23, delete “22” and insert --20--.

In column 32, line 53, Claim 32 after “preceding,” delete “dispenser” and insert --dispense--.

In column 33, line 5, Claim 34 before “de-powered,” insert --is--.

Signed and Sealed this

Twenty-fourth Day of March, 2009

JOHN DOLL
*Acting Director of the United States Patent and Trademark Office*